US010026254B1

(12) United States Patent
Lad

(10) Patent No.: US 10,026,254 B1
(45) **Date of Patent: *Jul. 17, 2018**

(54) MECHANICAL LIFT FOR DELIVERY BINS IN VENDING MACHINES

(71) Applicant: Fawn Engineering Corporation, Clive, IA (US)

(72) Inventor: Santosh Lad, West Des Moines, IA (US)

(73) Assignee: Fawn Engineering Corporation, Clive, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/694,172

(22) Filed: Sep. 1, 2017

Related U.S. Application Data

(62) Division of application No. 14/680,949, filed on Apr. 7, 2015, now Pat. No. 9,870,671.

(60) Provisional application No. 61/976,231, filed on Apr. 7, 2014.

(51) Int. Cl.
*G07F 11/38* (2006.01)

(52) U.S. Cl.
CPC ..... *G07F 11/38* (2013.01)

(58) Field of Classification Search
CPC ..... G07F 11/16; G07F 11/04; G07F 11/10; G07F 11/165
USPC ..... 221/249, 112, 113, 192
See application file for complete search history.

(56) References Cited

U.S. PATENT DOCUMENTS 3,193,138 A 7/1965 Cox et al.
3,283,273 A 11/1966 Pearse
3,549,045 A 12/1970 Rosenhagen
3,606,959 A 9/1971 Stonor
3,741,619 A 6/1973 Dyer
3,796,294 A 3/1974 Hoffer et al.
3,862,704 A 1/1975 Millies et al.
4,108,333 A 8/1978 Falk et al.
4,171,667 A 10/1979 Miller et al.
4,216,877 A 8/1980 Dutro
(Continued)

FOREIGN PATENT DOCUMENTS

EP 0166539 1/1986
JP 5120539 5/1993
(Continued)

OTHER PUBLICATIONS

Cold Food Merchandiser Model 3007, Service Manual, Jan. 1990, 36 pages. Jan. 1990.

(Continued)

*Primary Examiner* — Timothy R Waggoner
*Assistant Examiner* — Ayodeji T Ojofeitimi
(74) *Attorney, Agent, or Firm* — McKee, Voorhees & Sease, PLC

(57) ABSTRACT

A mechanical lift for delivery bins and receptacles in vending and analogous machines includes a feature that partial opening of a delivery door allows at least partial access to the delivery bin or receptacle but that further opening of the door would lift the bin or receptacle floor. The assembly can be compact, relatively noncomplex and economical. It can come in basically a preassembled kit that can be retrofitted or original manufacture equipment. It can include additional features such as anti-cheat functions and dispense detect sensors. An additional feature can be a unique dispensing floor geometry.

12 Claims, 52 Drawing Sheets

(56) References Cited

U.S. PATENT DOCUMENTS

| | | | | |
|---|---|---|---|---|
| 4,393,971 | A * | 7/1983 | Wilson | G07F 17/32 194/343 |
| 4,398,651 | A | 8/1983 | Kumpfer | |
| 4,418,836 | A | 12/1983 | Christian | |
| 4,469,245 | A | 9/1984 | Fish et al. | |
| 4,483,459 | A | 11/1984 | Taylor et al. | |
| 4,530,444 | A | 7/1985 | Christian | |
| 4,549,170 | A | 10/1985 | Serres et al. | |
| 4,583,658 | A | 4/1986 | Israel | |
| 4,757,915 | A | 7/1988 | Albright et al. | |
| 4,858,743 | A | 8/1989 | Paraskevakos et al. | |
| 4,974,747 | A | 12/1990 | Ahistrom | |
| 4,986,441 | A | 1/1991 | Kanbe et al. | |
| 5,211,296 | A | 5/1993 | D'Heygere | |
| 5,273,183 | A | 12/1993 | Tuttobene | |
| 5,671,604 | A | 9/1997 | Rudick | |
| 5,791,516 | A | 8/1998 | Wittern, Jr. et al. | |
| 5,881,911 | A | 3/1999 | Burdette et al. | |
| 5,893,615 | A | 4/1999 | Hendricks | |
| 5,957,043 | A | 9/1999 | Font | |
| 6,003,725 | A | 12/1999 | Blankenau et al. | |
| 6,047,855 | A | 4/2000 | Lin | |
| 6,083,270 | A | 7/2000 | Scott | |
| 6,102,248 | A | 8/2000 | Yamamiya | |
| 6,112,497 | A | 9/2000 | Credle, Jr. | |
| 6,199,720 | B1 | 3/2001 | Rudick et al. | |
| 6,230,930 | B1 | 5/2001 | Sorensen et al. | |
| 6,230,932 | B1 | 5/2001 | Lowing et al. | |
| 6,247,610 | B1 | 6/2001 | Ziesel et al. | |
| 6,253,954 | B1 | 7/2001 | Yasaka | |
| 6,279,719 | B1 | 8/2001 | Israel | |
| 6,286,715 | B1 | 9/2001 | Ziesel et al. | |
| 6,328,180 | B1 | 12/2001 | Sorensen et al. | |
| 6,383,542 | B1 | 5/2002 | Khodor et al. | |
| 6,439,425 | B1 | 8/2002 | Masek | |
| 6,494,342 | B1 | 12/2002 | Wittern, III | |
| 6,513,677 | B1 | 2/2003 | Sorensen et al. | |
| 6,540,100 | B2 | 4/2003 | Credle, Jr. et al. | |
| 6,556,889 | B2 | 4/2003 | Rudick et al. | |
| 6,582,037 | B1 | 6/2003 | Rudick et al. | |
| 6,688,435 | B1 | 2/2004 | Will et al. | |
| 6,719,168 | B2 | 4/2004 | Nicolini | |
| 6,742,673 | B2 | 6/2004 | Credle, Jr. et al. | |
| 6,808,082 | B2 | 10/2004 | Ohkubo | |
| 6,983,418 | B1 | 1/2006 | Scott | |
| 7,055,716 | B2 | 6/2006 | Holdway et al. | |
| 7,222,748 | B2 | 5/2007 | Holdway et al. | |
| 7,246,749 | B2 | 7/2007 | Rumble | |
| 7,303,093 | B2 | 12/2007 | Ward | |
| 7,447,563 | B2 | 11/2008 | Dobos | |
| 7,451,891 | B2 | 11/2008 | Carter et al. | |
| 7,565,222 | B2 | 7/2009 | Popelka | |
| 7,686,185 | B2 | 3/2010 | Zychinski | |
| 7,712,628 | B2 | 5/2010 | Guindulain Vidondo | |
| 7,802,700 | B2 | 9/2010 | Ardem et al. | |
| 7,819,282 | B2 | 10/2010 | Israel | |
| 7,837,059 | B2 | 11/2010 | Hieb et al. | |
| 8,002,144 | B2 | 8/2011 | Percy | |
| 8,162,174 | B2 | 4/2012 | Hieb | |
| 8,534,494 | B2 | 9/2013 | Black, Jr. et al. | |
| 8,556,119 | B2 | 10/2013 | Skavnak et al. | |
| 2001/0000609 | A1 | 5/2001 | Rudick et al. | |
| 2003/0146238 | A1 | 8/2003 | Beuregard | |
| 2004/0140317 | A1 | 7/2004 | Forte | |
| 2005/0067426 | A1 | 3/2005 | Holdway et al. | |
| 2005/0155977 | A1 | 7/2005 | Popelka | |
| 2006/0042193 | A1 | 3/2006 | Elustondo | |
| 2006/0261080 | A1 | 11/2006 | Matsumoto et al. | |
| 2007/0021866 | A1 | 1/2007 | Coppola et al. | |
| 2007/0267087 | A1 | 11/2007 | Jones et al. | |
| 2008/0099501 | A1 | 5/2008 | Ward | |
| 2008/0148685 | A1 | 6/2008 | Kim | |
| 2009/0029016 | A1 | 1/2009 | Pfister et al. | |
| 2009/0184130 | A1 | 7/2009 | Miller | |
| 2010/0084421 | A1 | 4/2010 | Lazalier et al. | |
| 2010/0300041 | A1 | 12/2010 | Kim | |
| 2011/0024441 | A1 | 2/2011 | Mahn et al. | |
| 2012/0277904 | A1 | 11/2012 | Pritchard et al. | |
| 2012/0330461 | A1 | 12/2012 | Doom | |
| 2013/0144432 | A1 | 6/2013 | Canter | |

FOREIGN PATENT DOCUMENTS

| | | |
|---|---|---|
| WO | 9524145 | 9/1995 |
| WO | 9949429 | 9/1999 |
| WO | 2006130814 | 12/2006 |
| WO | 2009138864 | 11/2009 |

OTHER PUBLICATIONS

Department of Justice, "2010 ADA Standards for Accessible Design", pp. 1-4, 28-33, 118, 157-161, http://www.ada.gov/regs2010/2010ADAStandards/2010ADAstabards.htm [retrieved from Internet Mar. 14, 2010]. Sep. 15, 2010.

Food Merchandiser Service Manual, Model 3005, Part No. 4200258, Rev. Nov. 1988, 30 pages, Nov. 1988.

Fawn Engineering Corporation, PCT/US2012/020227, "Notification of Transmittal of the International Search Report and the Written Opinion of the International Searching Authority" dated Mar. 27, 2012.

JP5-120539—Sanden Corp—English Translation dated May 18, 1993.

* cited by examiner

ELEVATOR SHOWN IN STANDBY MODE

- READY TO VEND
- THE DELIVERY DOOR IS LOCKED AND THE SECURITY BAFFLE IS OPEN

SECTION A-A

SECTION A-A

SECTION A-A

SECTION A-A

MECHANICAL LIFT FOR DELIVERY BINS IN VENDING MACHINES

CROSS-REFERENCE TO RELATED APPLICATIONS

This is a divisional application of U.S. Ser. No. 14/680,949 filed Apr. 7, 2015, which claims priority to U.S. provisional application Ser. No. 61/976,231 filed Apr. 7, 2014, all of which are herein incorporated by reference in their entirety.

BACKGROUND OF THE INVENTION

Field of the Invention

The present invention relates to vending machines and analogous dispensing apparatus, and in particular, to dispensing bins, receptacles, and the like that collect dispensed items and allow access for the user of the machine.

Related Art

Conventional gravity-drop vending machine arrangements have plural horizontal trays spaced vertically in a cabinet. Each tray has plural dispensers across a substantial width of the vending machine cabinet (across each tray). Dispensed items drop by gravity in a drop zone (usually but not always) along a front vertical space in the cabinet. A dispensing bin below the lowest of dispensers, and across the width of the trays, is adapted to catch anything dropped from any of the dispensers. However, this could place the floor of the dispensing bin quite low in the cabinet.

FIG. 1 illustrates a typical vending machine 10 of this basic arrangement. Cabinet 112 is about 6 feet tall by 4 feet wide by 4 feet deep. By customer interface 114 (e.g. bill/coin/credit reader), a customer selects an item to be dispensed to a delivery bin. An access or delivery door 118 is near the bottom of cabinet 112. A conventional position for delivery bin 108 has been added to FIG. 1 in ghost lines. Note that its floor is below delivery door 118 and not far above the ground or floor.

The Americans with Disabilities Act (ADA) includes guidelines that apply to at least some vending machines or vending machine placements regarding minimum height or access to a vended product (e.g. 15-48 inches above the floor or ground). Some machines do not meet those guidelines. The ADA also has guidelines regarding the maximum amount of force required by a customer to access a vended product (e.g. 5 lbs. of force).

Attempts have been made to adapt vending machines to these ADA requirements. For example, the assignee of the present application has developed the following:

- U.S. Pat. No. 6,494,342 (incorporated by reference herein); and
- Published US Application US 2012/0277904 (incorporated by reference herein).

Each of the above provides some technique for raising the lower-most portion of a delivery bin or collection component towards a delivery door or access opening. One (U.S. Pat. No. 6,494,342) is a mechanically actuated sling. This can present issues regarding durability, access, and operation. Another (2012/0277904) utilizes an elevator with some sort of electrical controller and motor/actuator, that can raise the bin floor slightly or if needed all the way to the top of the dispensers in the cabinet. This can have benefits but can add cost and complexity.

An issue for adding lift potential for the bin can be efficient space utilization inside a vending machine cabinet. Added components to facilitate delivery bin floor lifting can use space that could have other beneficial uses. Another consideration is cooperation with other components of the vending machine. For example, when the delivery bin floor is lifted it may lift the top of such items past the access opening or at least make them difficult to access.

As can be appreciated by those skilled in the art, a number of competing factors exist regarding dispensing mechanisms and components. For example, in most retail vending situations, it is beneficial to have as large an interior machine space as possible for inventory to minimize time and resources spent restocking. This generally incentivizes operation components such as dispensers, and delivery boxes, bins, or receptacles to be as small as possible. However, because those things are at least partially mechanized, and because it can also be beneficial for a machine to vend a variety of products, minimizing the size of those components, including the bin size, can limit the size of products the machine can handle. Importantly, especially with retail vending applications, the customer experience must be taken into account. Simplicity, at least the feeling the customer has significant control, and versatility for various customers and vending situations, can be important. However, sometimes this is difficult to achieve with other needs for the machine. The designer is faced with sometimes antagonistic factors when trying to meet needs not only with retail, consumer/customer machines but in other dispensing situations.

It has been discovered that there is still room for improvement relative to providing a dispensing bin floor or the like that can lift from a home or normal position. For example, competing interests for use of interior space of a vending machine cabinet are always in play. Reduction in complexity can be very important. There can also be times when it is not needed or desired to lift the dispensing bin floor or collector.

Force/effort to access a dispensed product can also be a problem. This can include force needed to open a delivery door and, in the case of a mechanical lift, raise the product. Some machines vend relatively large, heavy beverage containers, tools, etc. Multiple products are sometimes vended in one selection/payment activity. Again, it has been identified there is room for improvement regarding the delivery experience from these types of dispensing machines, including the amount of effort needed to effectuate or improve visualization, access, and withdrawal of a vended or dispensed item.

Another factor the designer faces is flexibility. This includes not only flexibility as to the size, type, or form factor of items to be dispensed, but also to features and operations involved in the dispensing. This can implicate consumer satisfaction. It also can relate to space utilization in the machine. Further it can relate to providing adaptability and flexibility in an economical way, voiding complexity, as well as user confusion and effort.

The foregoing issues, as well as others, relate to vending machines such as illustrated in FIG. 1, U.S. Pat. No. 6,494,342, and U.S. 2012/0277904. They can also apply as well to a wide variety of other types of dispensers. Examples range not only from food/beverage/candy retail vending machines but to any machines that might deliver from an inventory of supplies (medical supplies in a hospital, tool bits in a manufacturing facility, bin items in an assembly plant, etc.).

The prior art machine of FIGS. 1A-D has a number of advantages. They include the ability to comply with ADA requirements. However, it is an electromechanical solution.

The inventor has recognized potential for improvements or different solutions in this area.

SUMMARY OF THE INVENTION

It is therefore a principle object, feature, advantage, and aspect of the present invention to provide a mechanical lift for delivery bins and receptacles of vending machines and analogous machines which solve or overcome some of the problems and deficiencies in this technical field.

Other objects, features, aspects, and advantages of the present invention include an apparatus, method, or system which;

1. is relatively compact for beneficial use of space inside the machine;
2. is relatively economical and non-complex relating to both cost of manufacturer/assembly, as well as installation and operation;
3. allows some selection or control by the customer as to whether or not floor lifting is needed or desired;
4. is purely mechanical and operated by manual operation of the customer;
5. can be compliant with the ADA accessibility regulations;
6. is easy, and effective for consumer or user operations;
7. is applicable to a wide variety of dispensing applications whether retail or not;
8. is adaptable to a wide variety of dispensable items.

A first aspect of the invention comprises a delivery bin assembly having a delivery bin with a vertically raisable floor and a bin opening substantially across and above the length and width of that floor. A customer delivery door provides access to the interior of the delivery bin. Linkage between the delivery bin and delivery door allows partial opening of the delivery door from a closed position to a partially opened position without raising of the bin floor, but then proportional raising of the bin floor upon further opening of the delivery door manually by the customer. Retrieval may be without floor lifting, but allows conscious selection of lifting if the customer desires. In one embodiment the proportional raising can be non-linear in the sense that user initiation of movement of the delivery door is not a 1:1 relationship to movement of the bin floor. In one particular embodiment of the invention, the bin floor does not begin to rise until after partial opening of the delivery door to give the customer an initial chance to visualize the dispensed item and control whether or not further opening of the door and/or raising of the floor is needed or desired.

Another aspect of the invention comprises a vending machine or analogous machine in combination with and which incorporates such an assembly.

A further object of the invention comprises a method of vending or dispensing items. A dispensed item is collected at a delivery bin floor at a first vertical height. A delivery door is manually openable by a customer for a first range of movement allowing at least some visualization of the vending machine floor and/or ability to reach in towards that floor in its lower-most or home position. Further opening of the delivery door raises the bin floor. The customer can elect further opening to raise the floor from its home position.

Another aspect of the invention comprises a concave receiving surface along the longitudinal (side-to-side) axis of the bin floor that promotes collection and fall-down of elongated items.

Another aspect of the invention comprises a dispensing bin that has relatively narrow depth for good space utilization in the machine.

Another aspect of the invention can include a combination and method allowing single-handed user control of access to a dispensed item based on user intuition through user tactile sensing of non-linear or proportional action between an access door, flap, lever, or the like, and a bin or receptacle or its floor, to promote better user experience.

These and other objects, features, aspects, and advantages of the invention will become more apparent with the accompanying specification.

DETAILED DESCRIPTION OF EXEMPLARY EMBODIMENTS OF THE INVENTION

Overview

For a better understanding of the invention, specific examples of forms it can take will now be described in detail. It is to be understood, however, that the invention can take many forms and embodiments and this example is neither inclusive nor exclusive of those forms.

Figure 1A:
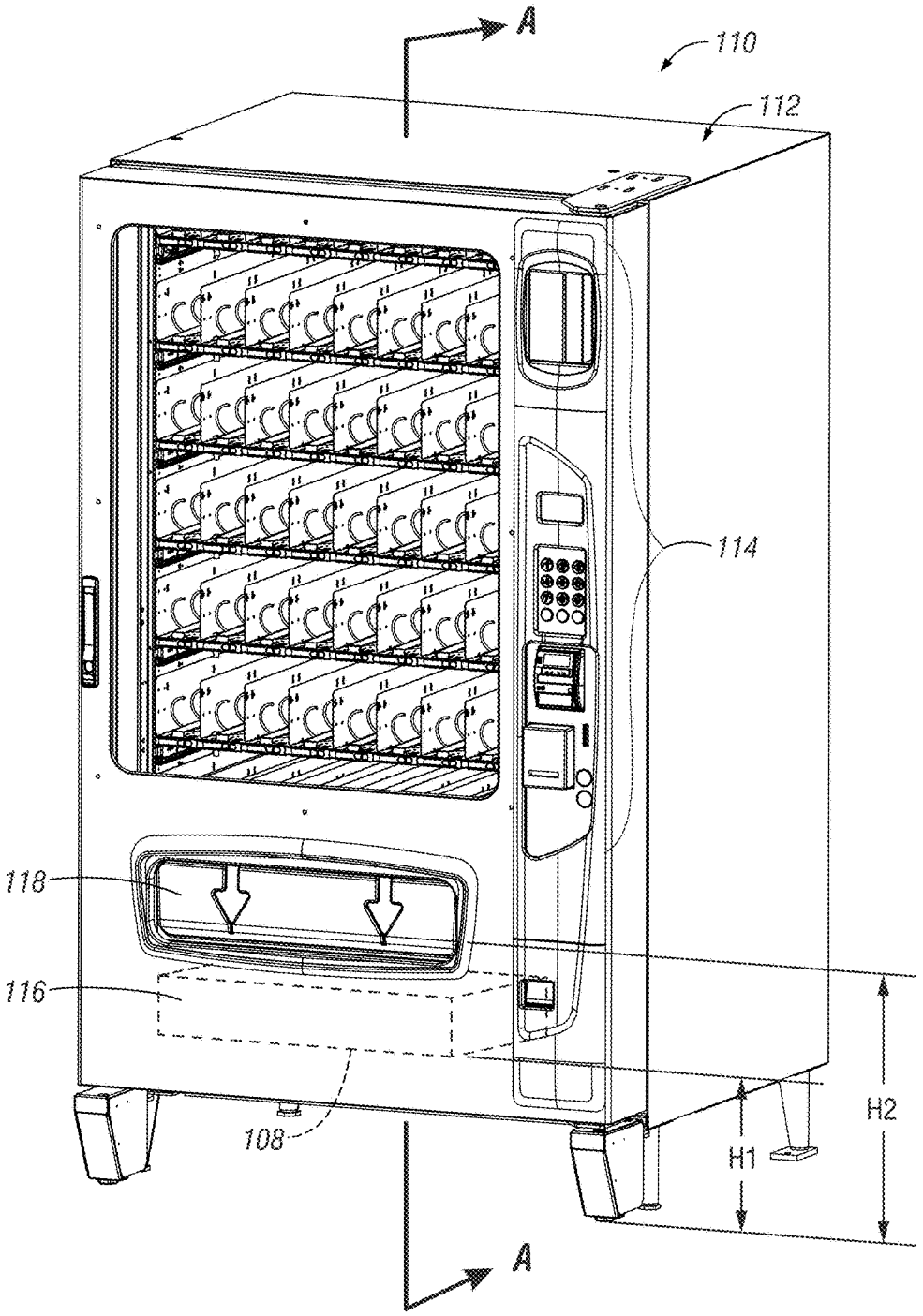
Fig. 1A (PRIOR ART)
FIG. 1A is a perspective scale-model view of a typical vending machine with an added illustration of a typical dispensing bin placement relative to a delivery door.
Figure 1B:
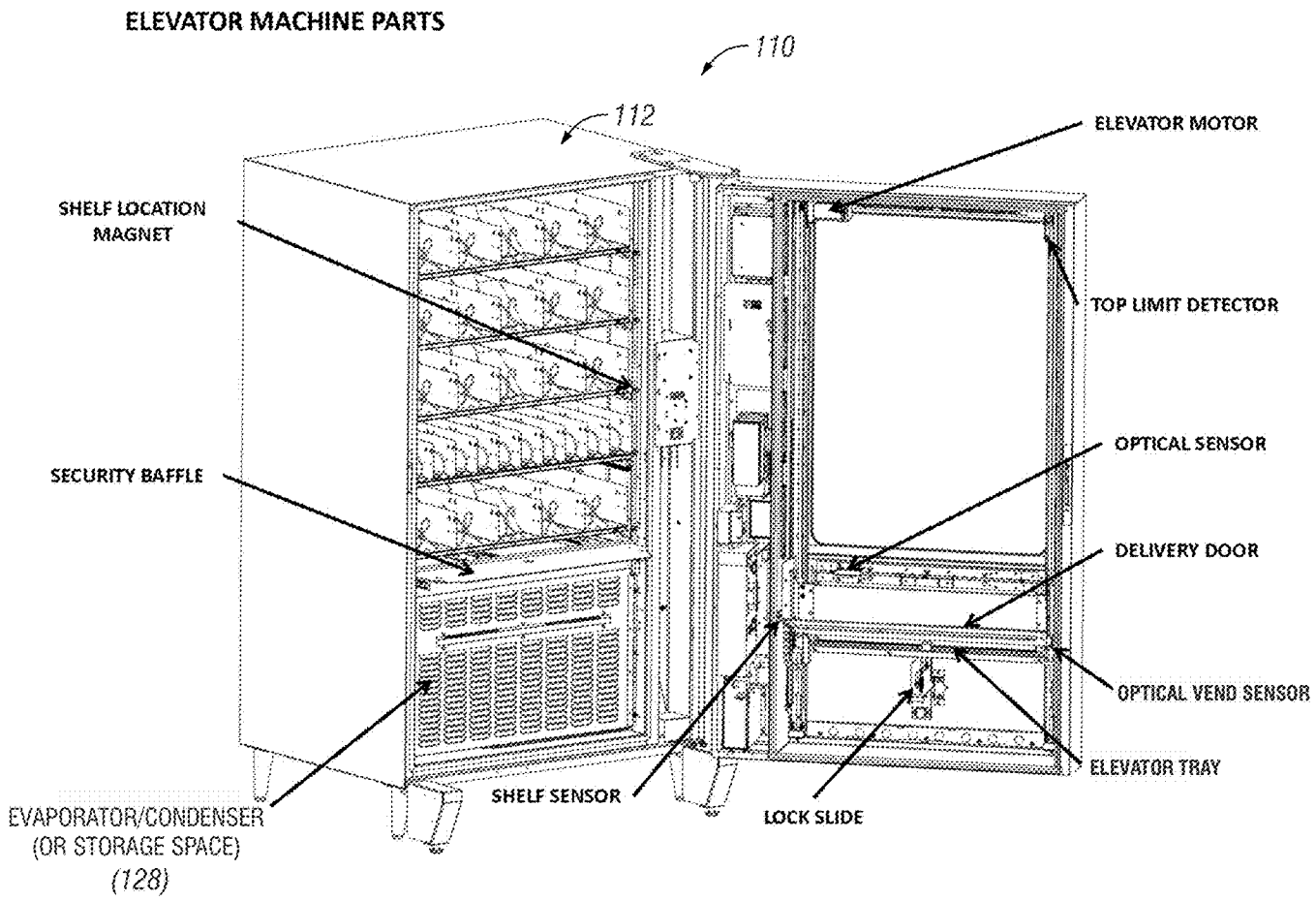
Fig. 1B (PRIOR ART)
FIG. 1B is an example of a machine of the general type of U.S. 2012/0277904 (an elevator lift) with front door open showing how a refrigerated machine needs space (reference number 5) near the bottom, under the dispensers, for an evaporator/condenser. It also illustrates height H1.
Figure 1C:
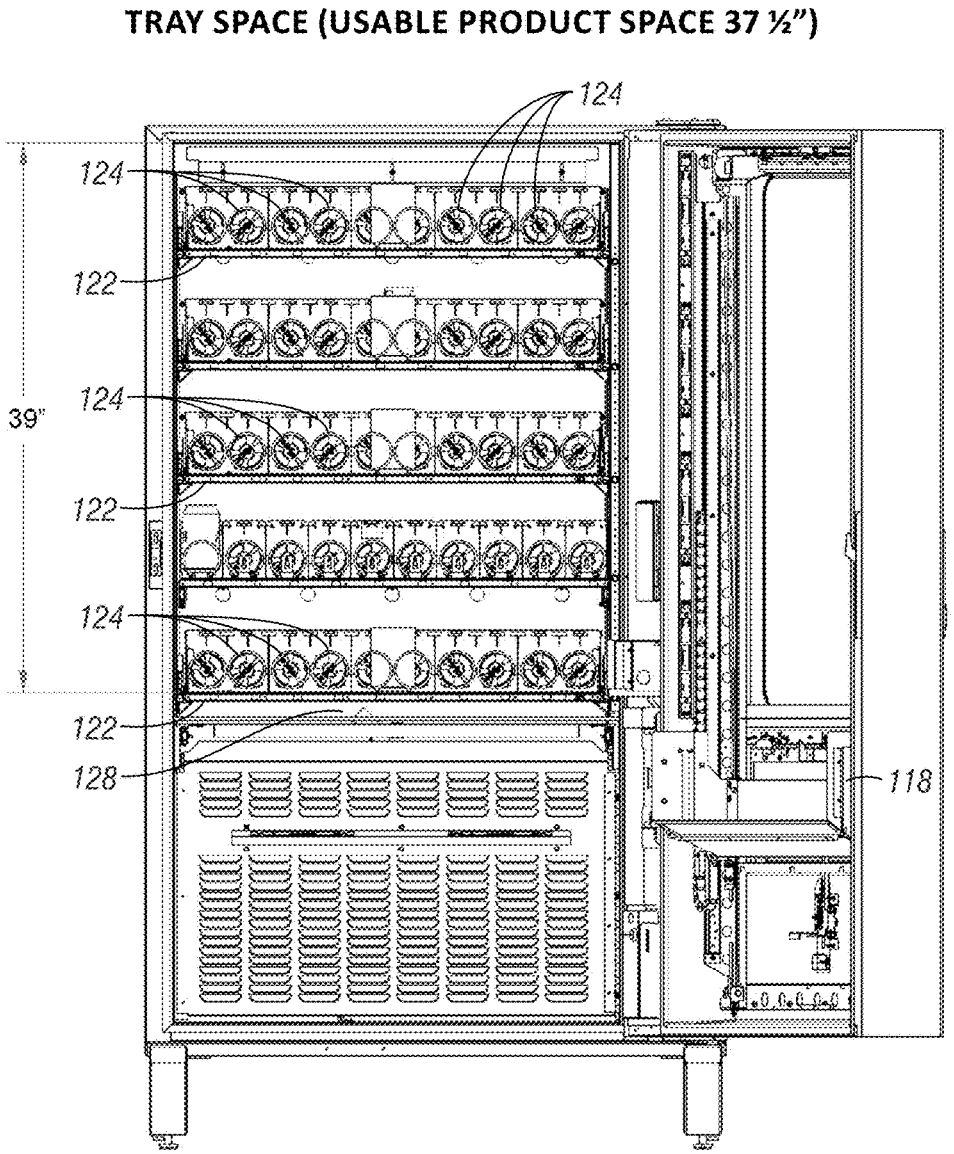
Fig. 1C (PRIOR ART)
FIG. 1C is a front plan view of FIG. 1B showing the elevator system for retrieving dispensed items and allowing lifting of a dispensing floor.
Figure 1D:
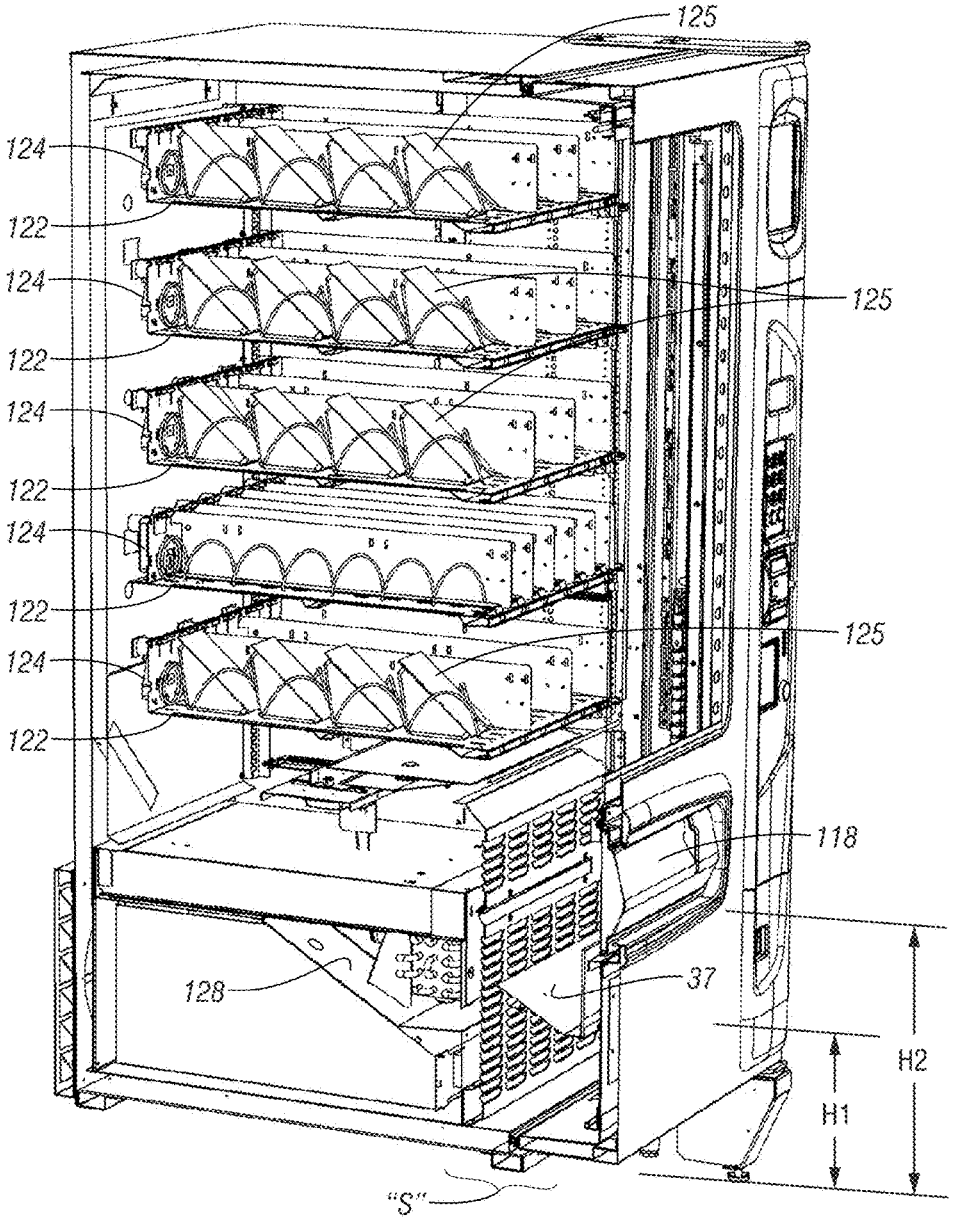
Fig. 1D (PRIOR ART)
FIG. 1D is a partial exposed view of FIG. 1B further illustrating the rather constrained space between front door and front of evaporator/condenser (see reference number S) as well as height (H1) to a home, lower-most position for a dispensing bin floor relative to the general height (H2) of the delivery door.
Figure 2A:
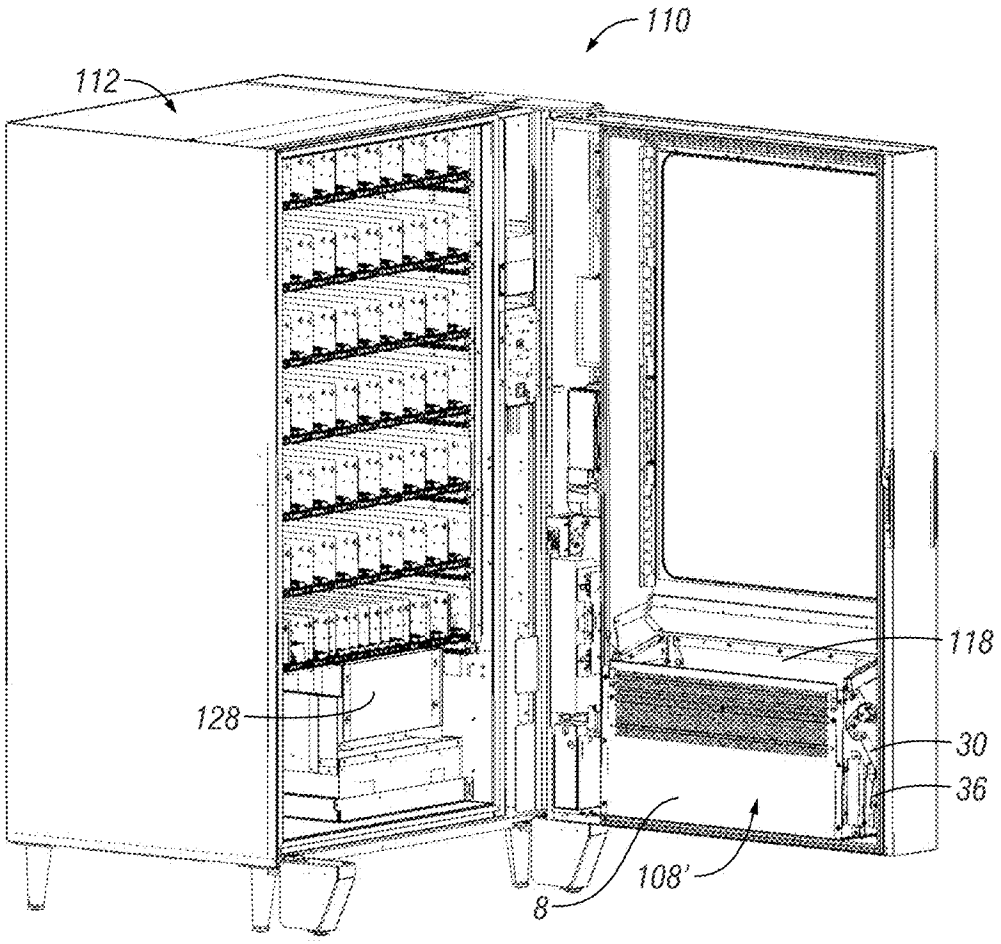
FIGS. 2A-C are similar to FIGS. 1B-D but illustrate an exemplary embodiment according to the present invention installed in a vending machine. The embodiment comprises a dispensing bin assembly 108' mounted along the inside lower part of the glass front door to the vending machine cabinet at or around the customer access opening door 118.
Figure 2B:
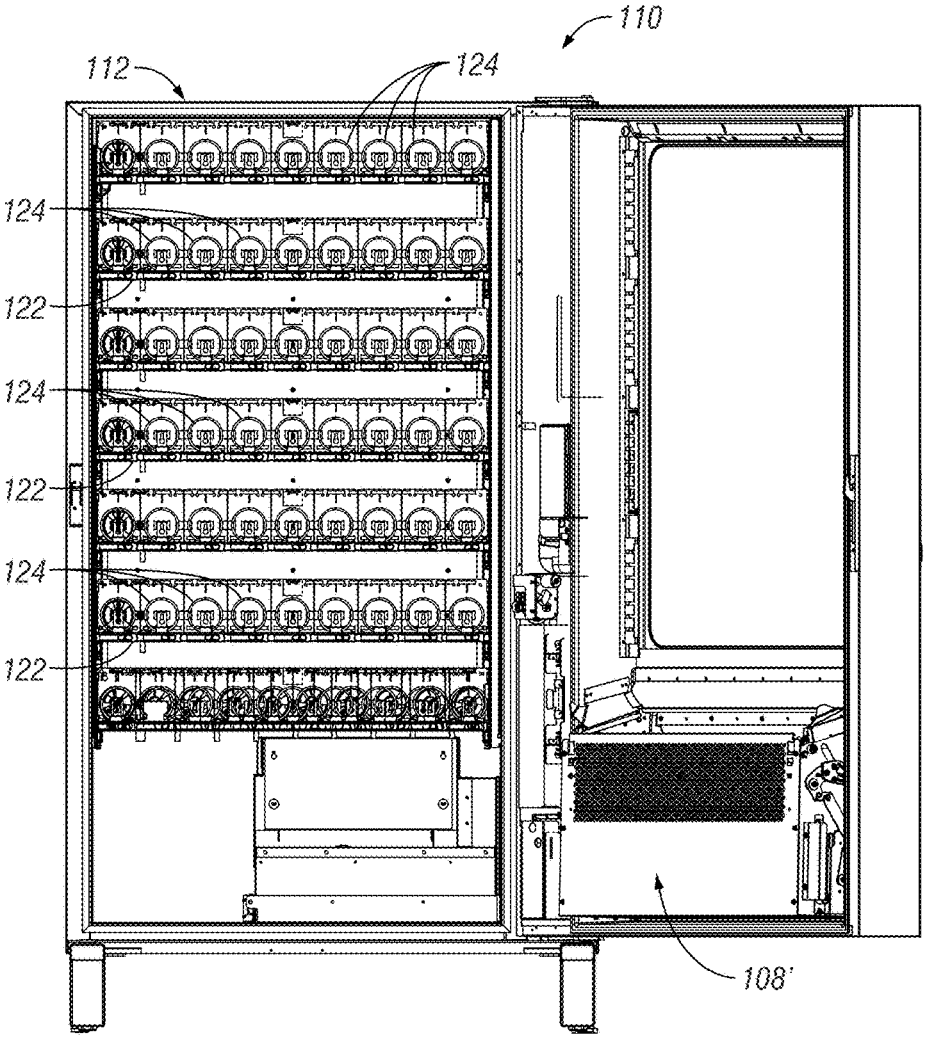
Figure 2C:
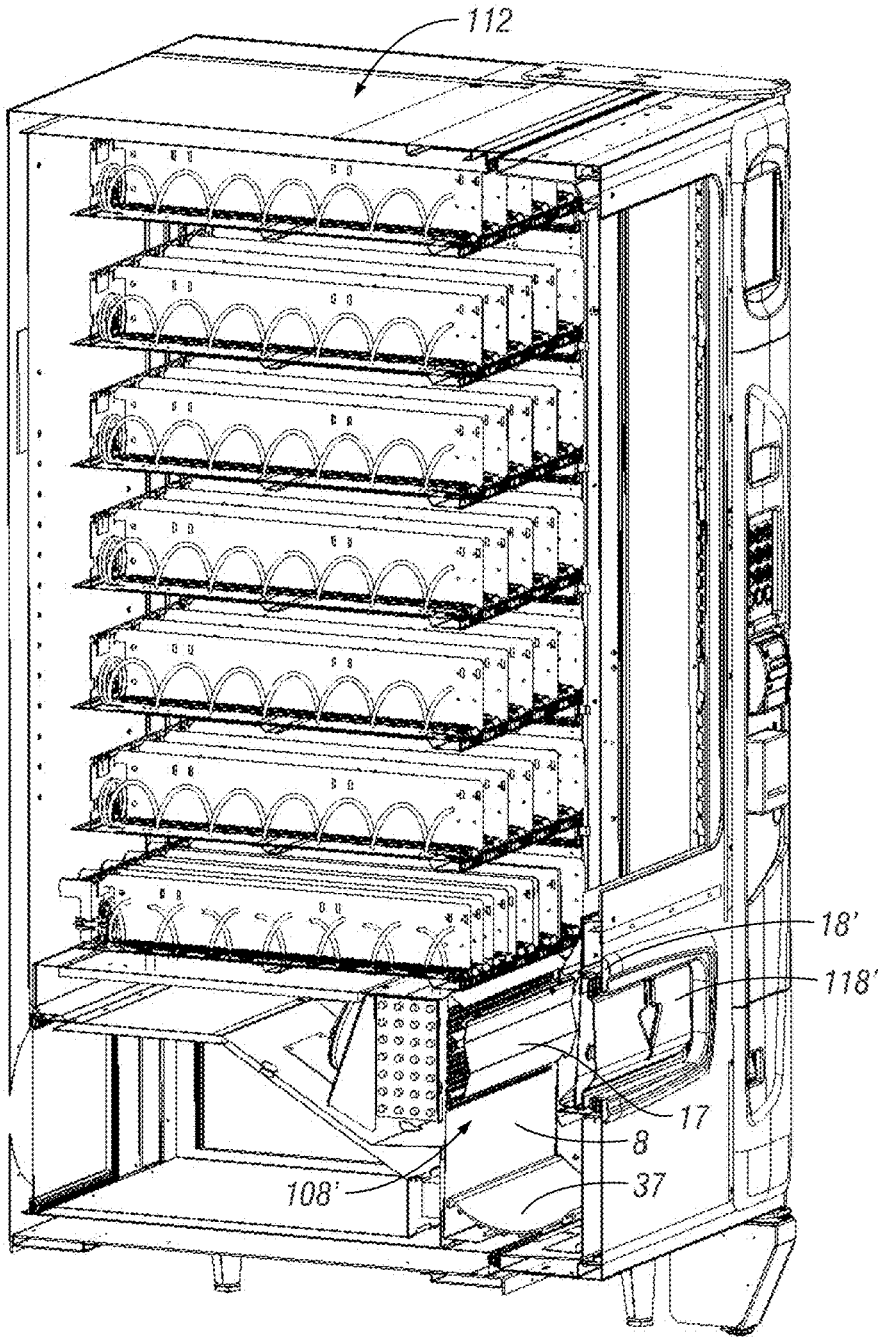

This embodiment will be described in the context of a vending machine that is refrigerated and which has a plurality of vertically spaced trays 122 above an evaporator/condenser 128 at the bottom of cabinet 112 (see FIGS. 1A-D generally for basic components of a vending machine but in particular FIGS. 2A-C with respect to a similar vending machine but with an exemplary embodiment of the invention installed therein). Plural helical dispensers 124 dispense products down vertical drop space S to the location indicated at 108 in FIG. 1A (below a delivery door/access opening and below the lowest of dispensers). As is illustrated in FIGS. 2A-C, the exemplary embodiment delivery bin assembly 108' can be removably fixed in place on the glass front cabinet door bottom by screws, bolts, or other fastening means. It is to be understood it could also be mounted inside of cabinet 112 at an appropriate location. However, in this embodiment, its mounting on the door at the customer access door 118 makes its cooperation with movement of access door 118 less complex. Dispensed items 125 would drop down across any portion of the width of space S to bin 108. A customer would have to push a delivery door to gain access.

It is to be understood, however, the invention can be applied to different types of vending machines/vertical drop dispensing systems. Likewise, it can be applied to all types of vending, dispensing, or analogous machines that dispense items in an analogous way. Examples would be non-food items which can include a variety of things like industrial tools, medical supplies, and other things such as are known in the industry. As can be appreciated by those skilled in the art, and as is well known to those persons, dispensing techniques such as those used in retail food/beverage/candy vending machines can also be applied to a wide variety of items such as the examples mentioned. The invention has the chance of applicability to any type of application that stores an inventory of items relative to at least one dispenser that a user can instruct to dispense (either one or plural) from that inventory. Therefore, the following description of possible embodiments is understood to be intended to apply to a variety of dispensing mechanisms and techniques as well as a variety of components to accomplish the same. Therefore, terms such as dispensing bin, delivery door, and their subcomponents are intended to convey examples that could be implemented with different form factors, materials, structures, or applications in analogous ways.

The prior art vending machine of FIGS. 1A-D shows a different way to lift a dispensing bin floor. Details are described in U.S. 2012/0277904. In contrast, the present invention differs in a number of ways including it is a mechanical lift instead of an electromechanical elevator as is U.S. 2012/0277904. FIGS. 2A-C illustrate the basic configuration of helical coil vending machines with vertical drop to a dispensing bin accessible through a customer-actuated delivery door.

It is also noted that the present invention will be described in the context of lifting a dispensing bin floor or the like. This can be used to assist compliance with ADA minimum vertical height rules. Those rules are publically available and discussed in U.S. 2012/0277904 and will not be repeated here. However, it is to be understood that the invention can be applied regardless of whether compliance with ADA is relevant or needed. As will be appreciated, the invention provides the capability of customer access to a dispensed item without lifting of the floor but allows the option of at least some lifting of the floor.

FIGS. 2A-C show how this embodiment promotes effective and efficient space utilization. Bin assembly 108' has a form factor and is made of materials engineered to maximize collection space or volume of the bin. As can be appreciated in FIGS. 2A-C, bin assembly 108' extends all across the width of the interior of cabinet 112 allowing it to have the best chance to capture any dispensed item from any level of dispensers through the height of the machine. This avoids any funnels or chutes that would occupy space and add costs and complexity. Effective space utilization also means that the height of the bin is specifically designed to accept a wide range of dispensed product sizes. This space utilization feature promotes handling of even larger dispensable items such as beverage bottles. Furthermore, by subtle and effective mechanical design, the mechanical pieces that effectuate the proportional but non-linear lifting of the bin floor are built-in along the vertical outside side walls of bin assembly 108' and do not extend substantially beyond the exterior peripheral three-dimensional dimensions of the walls of bin assembly 108'. As such, interior volume of the bin is maximized. It further promotes the ability to retrofit or otherwise mount as original equipment mount the bin assembly 108' into a variety of vending machines (sometimes with some scaling for specific machines). Furthermore, the mechanical solution is relatively economical, non-complex, and yet robust for cost, durability, and ease of maintenance benefits. Still further, as will be further demonstrated below, it can cooperate with or have added features such as a security baffle 28 and other enhancements, again with good space utilization and is economical and effective.

Apparatus

FIGS. 3A-E and 4A-D illustrate an exemplary embodiment according to one aspect of the invention.

The exemplary embodiment in FIGS. 3A-F includes a delivery box weldment or shell 8 having a base 81, an open front, back wall 82 and opposite side walls 83, 84. The sheet metal shell basically defines the interior space of a delivery box sized to be positioned such as is generally shown at 108 in FIG. 1A. As indicated in FIGS. 2A-C, the inventive non-linear lift option delivery bin will be generally referred to at reference numeral 108'. It can, of course, be scaled up or down according to need or desire. The back wall can be perforated to enhance air exchange and keep bin 8 cold.

Figure 3A:
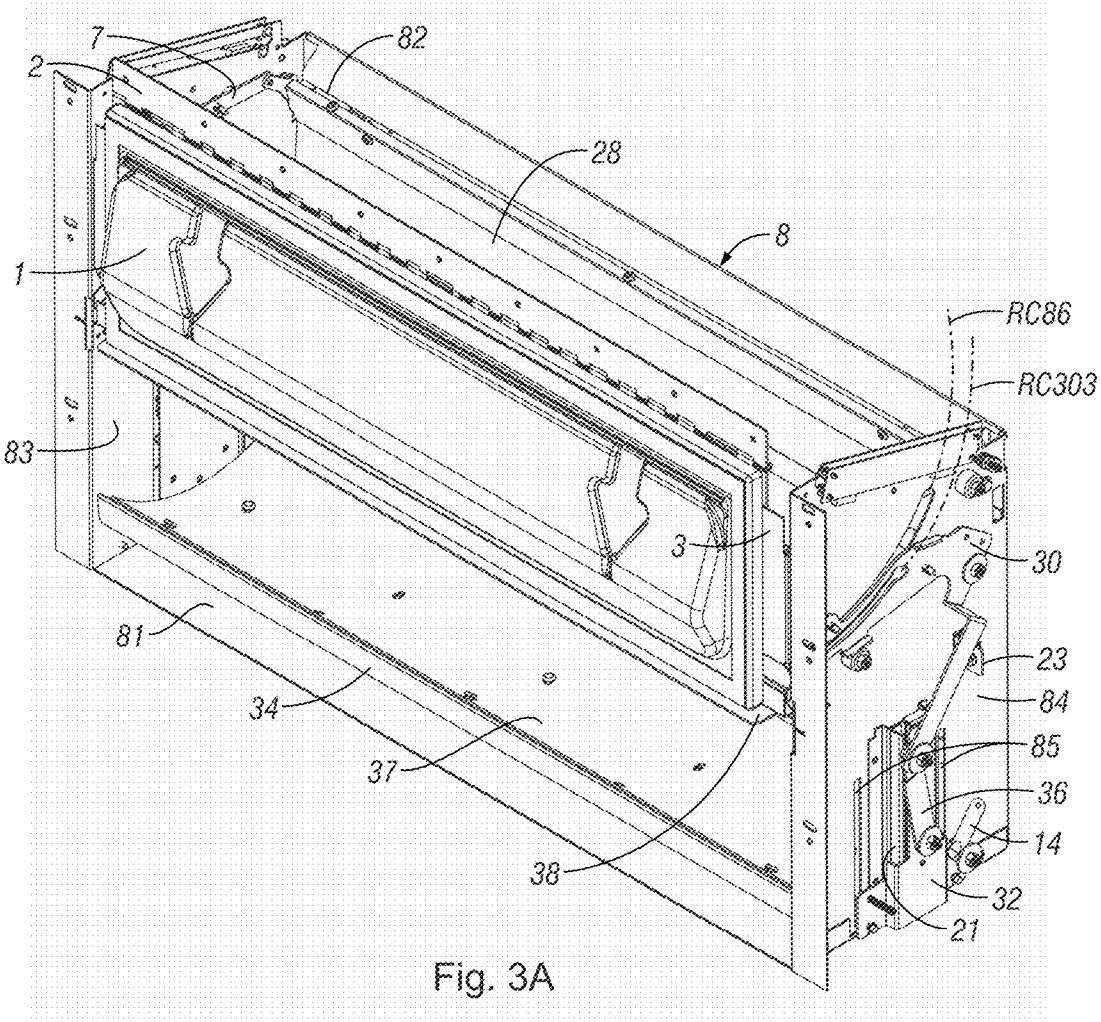
FIGS. 3A-F are scale model perspective views and isometric views of a mechanical lift and dispensing bin assembly according to a first exemplary embodiment of the invention with the delivery door in a closed position and the dispensing floor in a lowered home position.
Figure 3B:
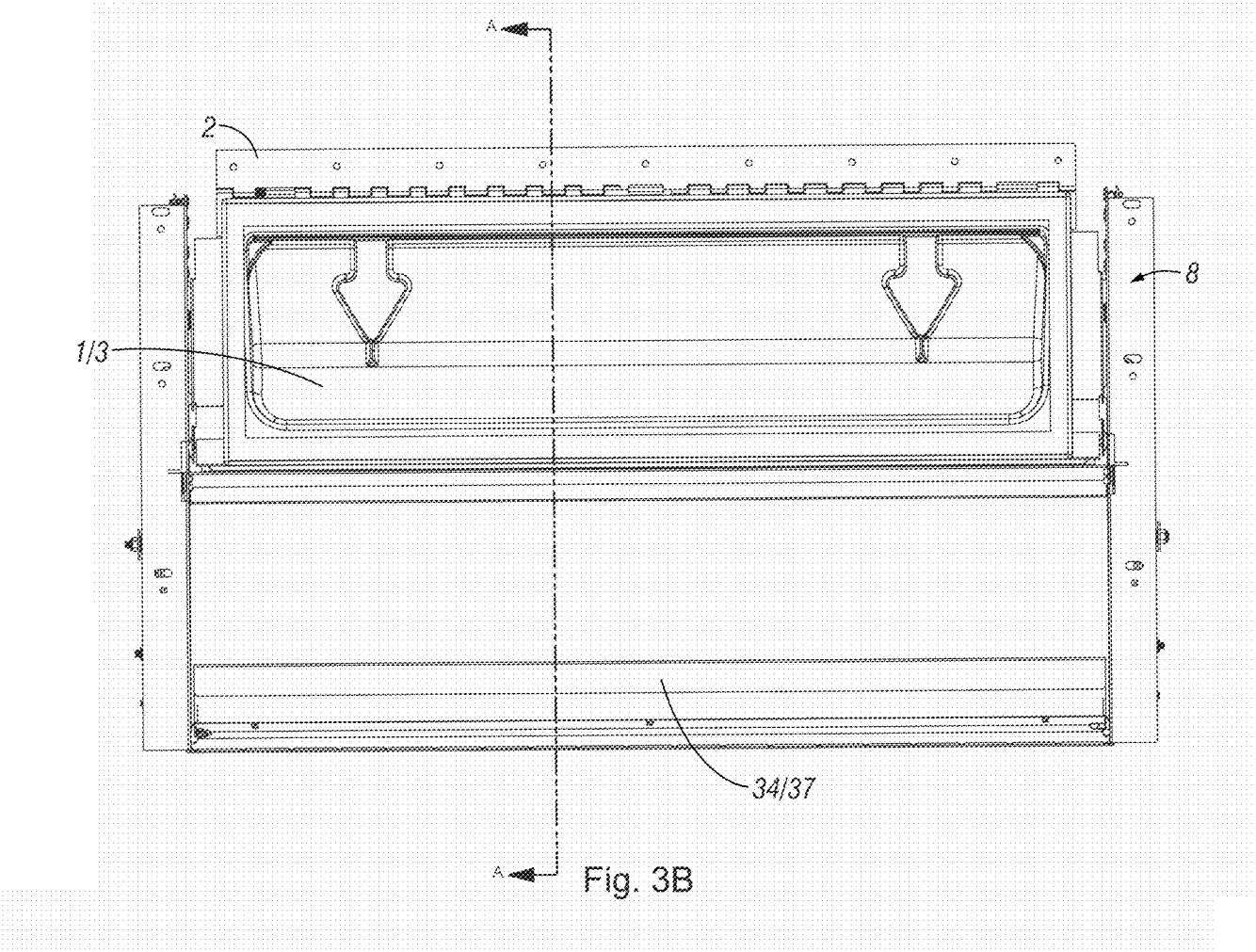
Figure 4A:
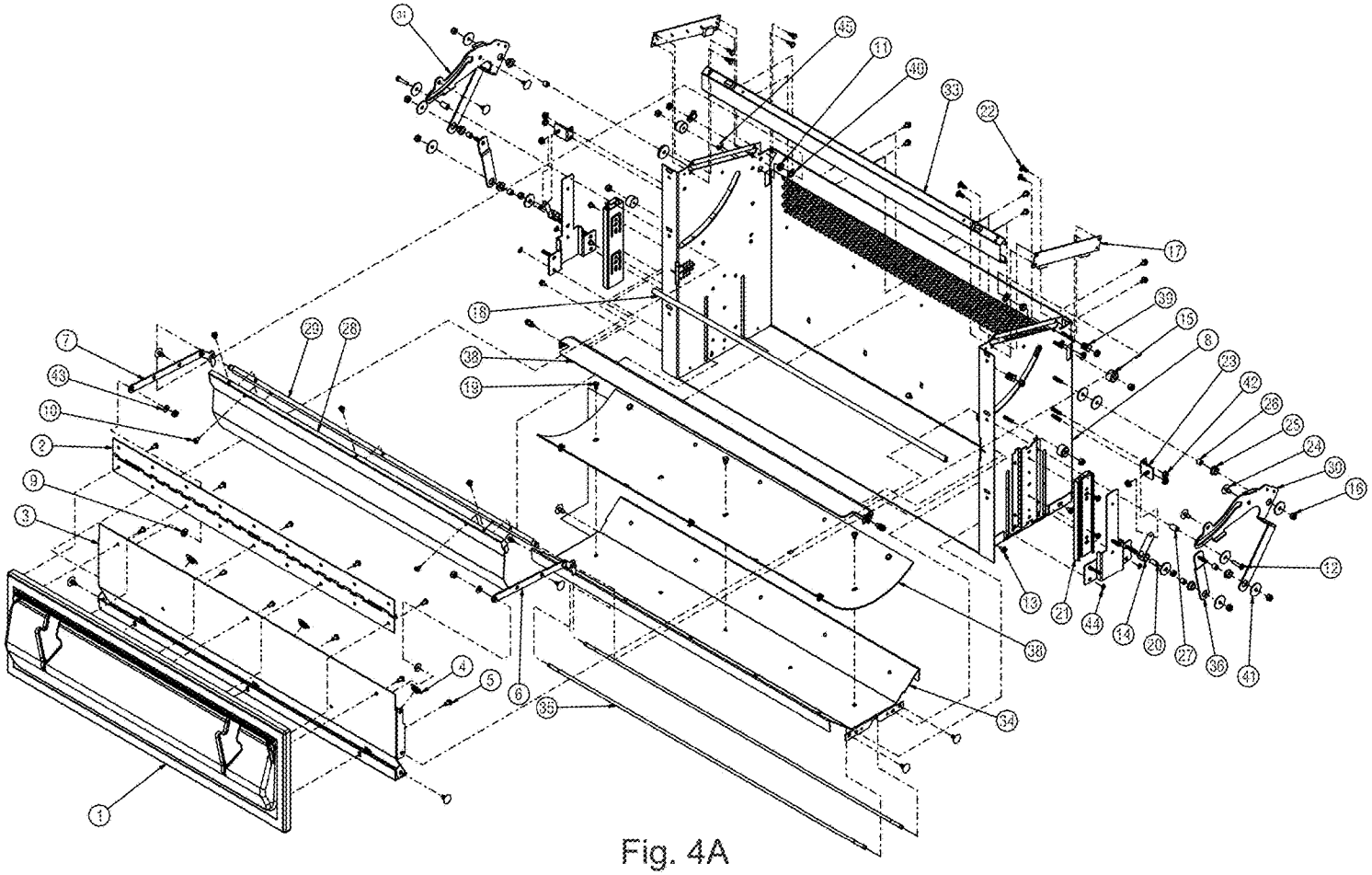
FIG. 4A is an exploded view of the assembly of FIGS. 3A-F.
Figure 4B:
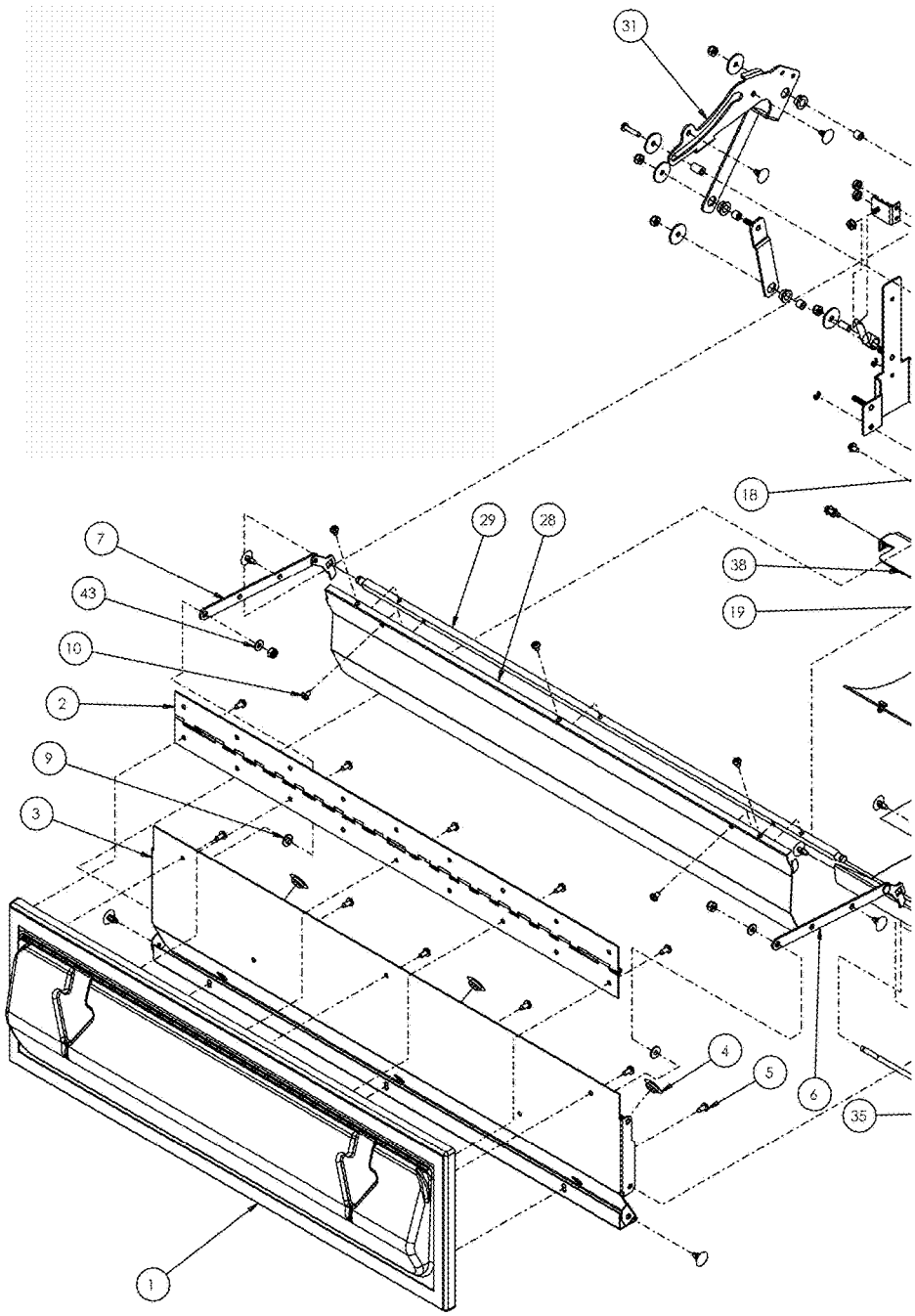
FIGS. 4B-D are enlargements of sections of FIG. 4A.
Figure 4C:
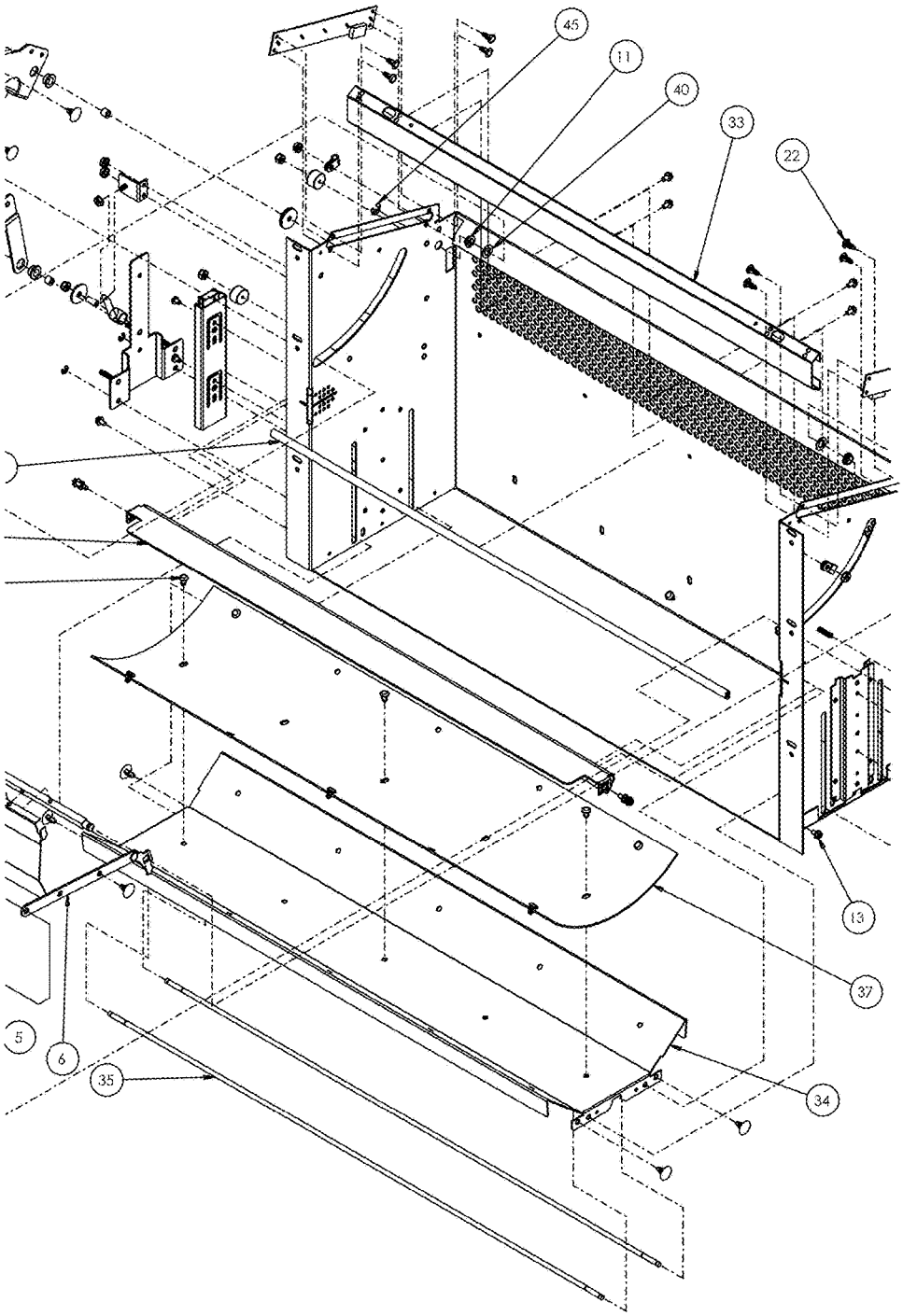
Figure 4D:
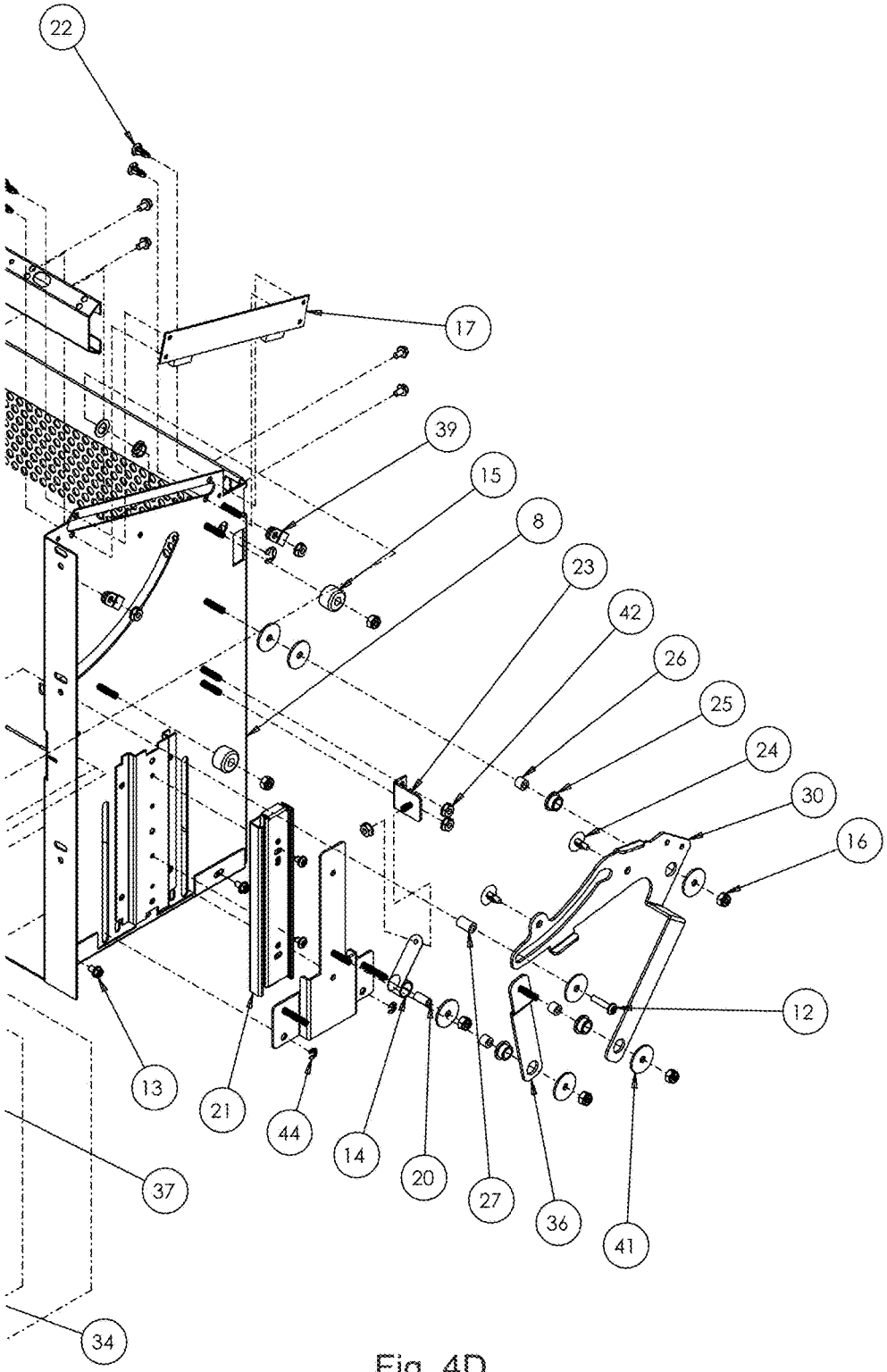
Figure 5:
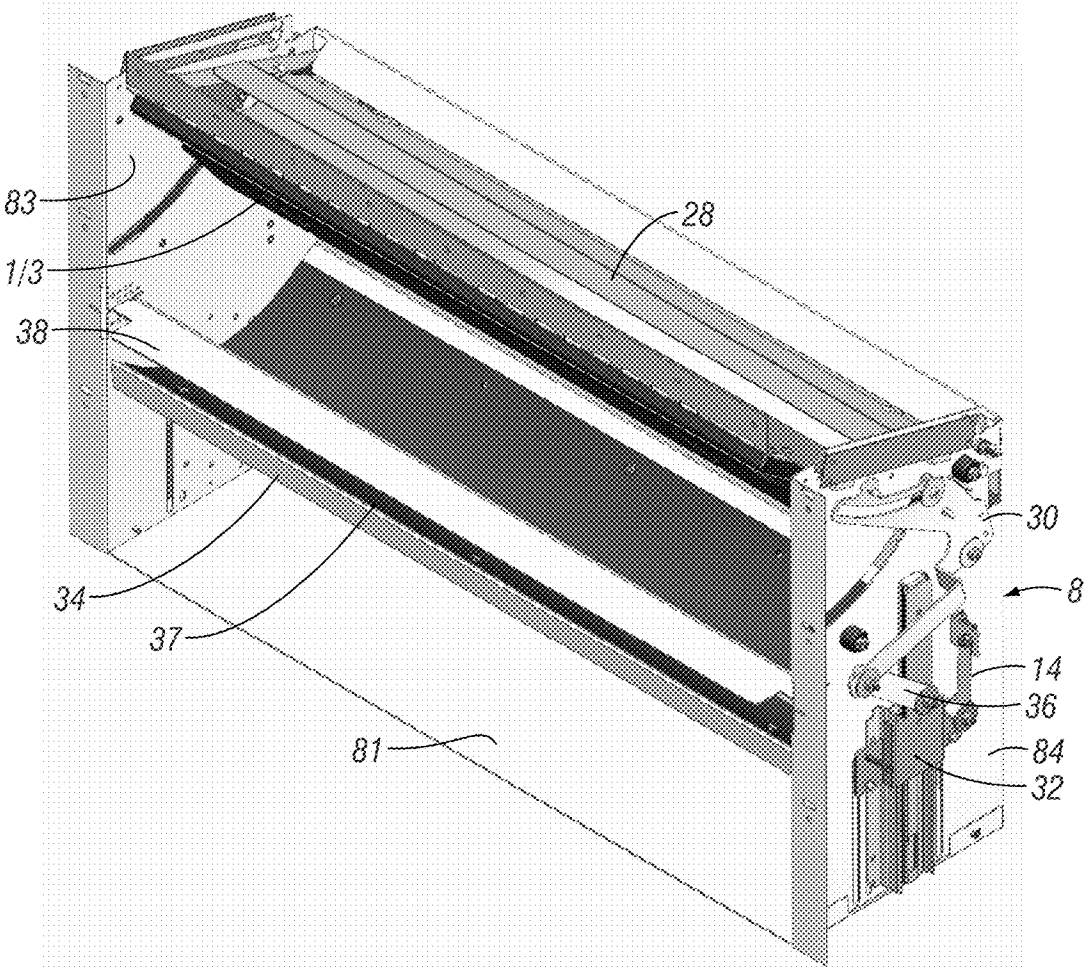
FIG. 5 is similar to FIG. 3A but shows the delivery door to a fully open position which actuates mechanical lifting of dispensing bin floor.

With respect to FIG. 3A and subparts, as well as FIG. 4A and subparts, FIG. 5, FIG. 6A and subparts, FIG. 7A and subparts, and FIG. 8A and subparts, Table 1 below itemizes a description of various parts of assembly 108' and include some details regarding specific characteristics of such components. It is to be understood, however, that the precise nature of these components can vary according to need or desire.

TABLE 1

| ITEM NO. | DESCRIPTION | QTY |
|---|---|---|
| 1 | DELIVERY DOOR FOAM ASSEMBLY/ALPINE | 1 |
| 2 | SPRING HINGE | 1 |
| 3 | DELIVERY DOOR ANTICHEAT | 1 |
| 4 | HOLE PLUG, BPF-½ | 3 |
| 5 | 8-18 × ⅜" PHIL PH TY-A BLACK | 11 |
| 6 | ANTI-CHEAT LINKAGE STAKE-ALPINE | 1 |
| 7 | ANTI-CHEAT LINKAGE STAKE-ALPINE | 1 |
| 8 | DELIVERY BOX WELD-ALPINE | 1 |
| 9 | SPACER BUSHING | 2 |
| 10 | 8-32 × ¼" PHIL PH TYP 23 ZN | 9 |
| 11 | SNAP-IN NYLON BEARING | 2 |
| 12 | 8-32 × ¾ PHIL PH MS | 2 |
| 13 | 8-18 × ⅜ PHIL PH TY-A/BLK | 14 |
| 14 | SPRING-CONSTANT FORCE | 2 |
| 15 | BUMPER | 4 |
| 16 | #8 HEX NYLOCK NUT | 1 |
| 17 | DELIVERY SENSOR | 1 |
| 18 | D-GASKET | 1 |
| 19 | SNAP RIVET | 9 |
| 20 | TUBULAR SPACER | 2 |
| 21 | ROLLER SLIDE | 2 |
| 22 | STANDOFF | 8 |
| 23 | FLOOR SPRING HOLDER STAKE | 2 |
| 24 | ARROW CLIP (Ø625 × .100) | 12 |
| 25 | FLANGE BEARING - Ø5/16" | 6 |
| 26 | ID.171 × OD.312 × 250 L SPACER | 6 |
| 27 | ID.171 × OD.312 × 500 L SPACER | 2 |
| 28 | DELIVERY ANTI-CHEAT BACK | 1 |
| 29 | DELIVERY SHAFT ALPINE-5W | 1 |
| 30 | DOOR-LIFT FLOOR LINK | 1 |
| 31 | DOOR-LIFT FLOOR LINK | 1 |
| 32 | FLOOR LIFT BRACKET | 2 |
| 33 | IVEND HARNESS COVER-ALPINE | 1 |
| 34 | LIFT FLOOR-ALPINE | 1 |
| 35 | LIFT FLOOR ROD - Ø3/16" | 2 |
| 36 | LINK FLOOR LIFT | 2 |
| 37 | PLASTIC FLOOR BASE | 1 |
| 38 | DOOR OPENING ANTICHEAT-ALPINE | 1 |
| 39 | ⅜ × 3/16 CLAMP | 3 |
| 40 | 5/16 ID FLAT WASHER | 2 |
| 41 | WASHER | 14 |
| 42 | 8-32 HEX NUT W/ETW | 9 |
| 43 | #8 FLAT WASHER | 2 |
| 44 | RETAINING RING - 3/16 | 4 |
| 45 | E-RING | 2 |

The open top to box 8 would be positioned under the lower edge of an access opening to cabinet 112. Delivery door 3 is mounted to the inside of front door 116 of cabinet 112 just below the access opening by a spring hinge 2. Spring hinge 2 in this version is basically a piano-type hinge with one or more springs that constantly bias delivery door 3 to a closed position against and around the back side of the access opening. A complete seal of that opening is desired with a refrigerated vending machine. Gaskets such as gasket 18' and a foam thermally-insulated cover 1 over delivery door 3, along with a spring hinge 2, promote this.

Delivery door 3 also serves as an anti-cheat component. It can be made of metal. Outwardly extending pins along its lower edge extend into curved slots 86 on opposite side walls 83, 84 of box 8. As shown in FIG. 3A, slots 86 have a lower end commensurate with where the lower edge of delivery door 3 would be in a closed position. Upper ends of slots 86 guide and provide an upper limit to opening of door 3 (approximately 54° from vertical) (see FIG. 6H). Thus, access door with thermally-insulating foam cover 1 pivots around spring hinge 2 from a vertical closed position shown in FIG. 3A to a fully pivoted back 54° opening shown in FIG. 5 by pins traveling in slots 86. A user can manually push on foam cover 1 to commence such opening.

Figure 3C:
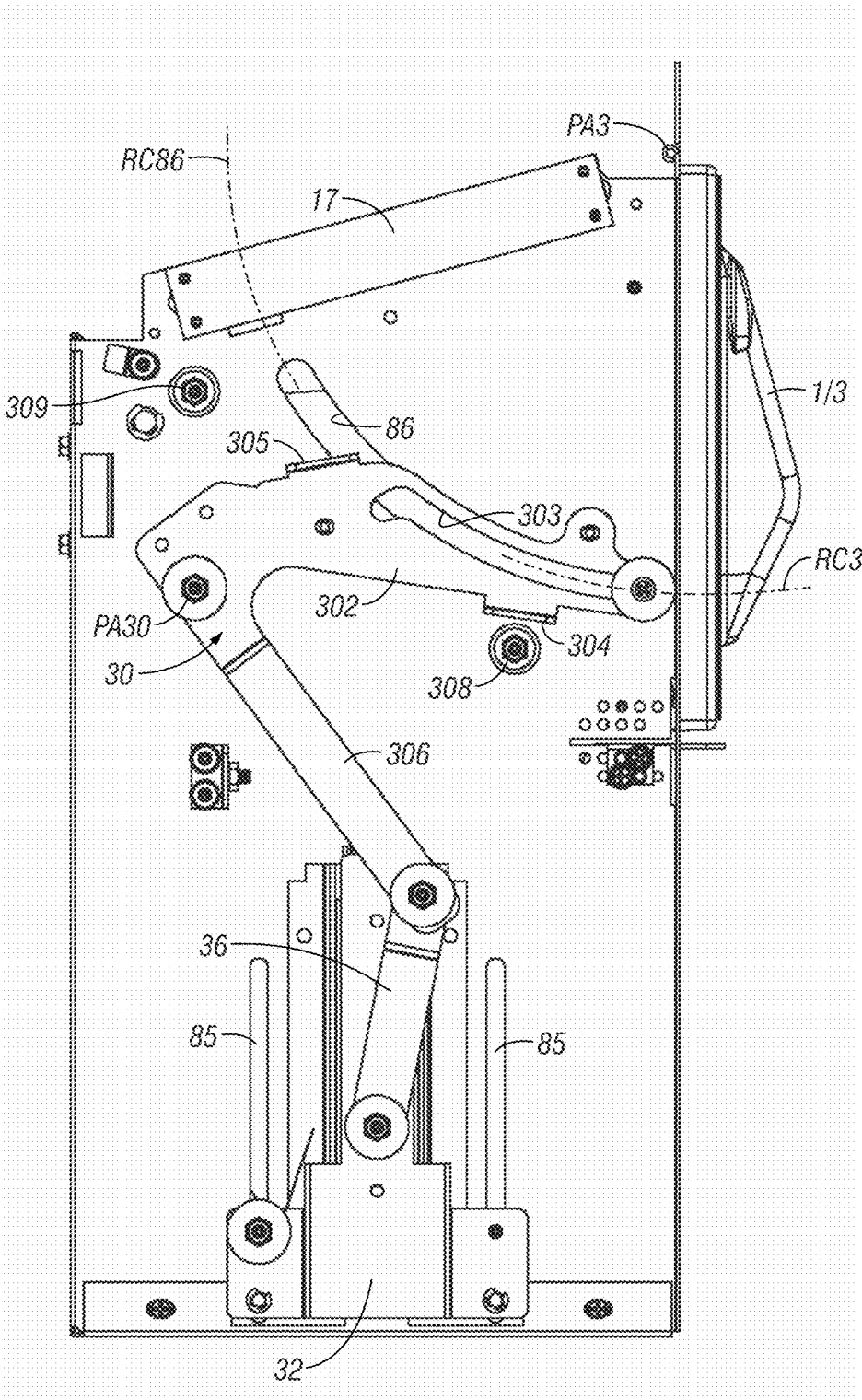
Figure 3D:
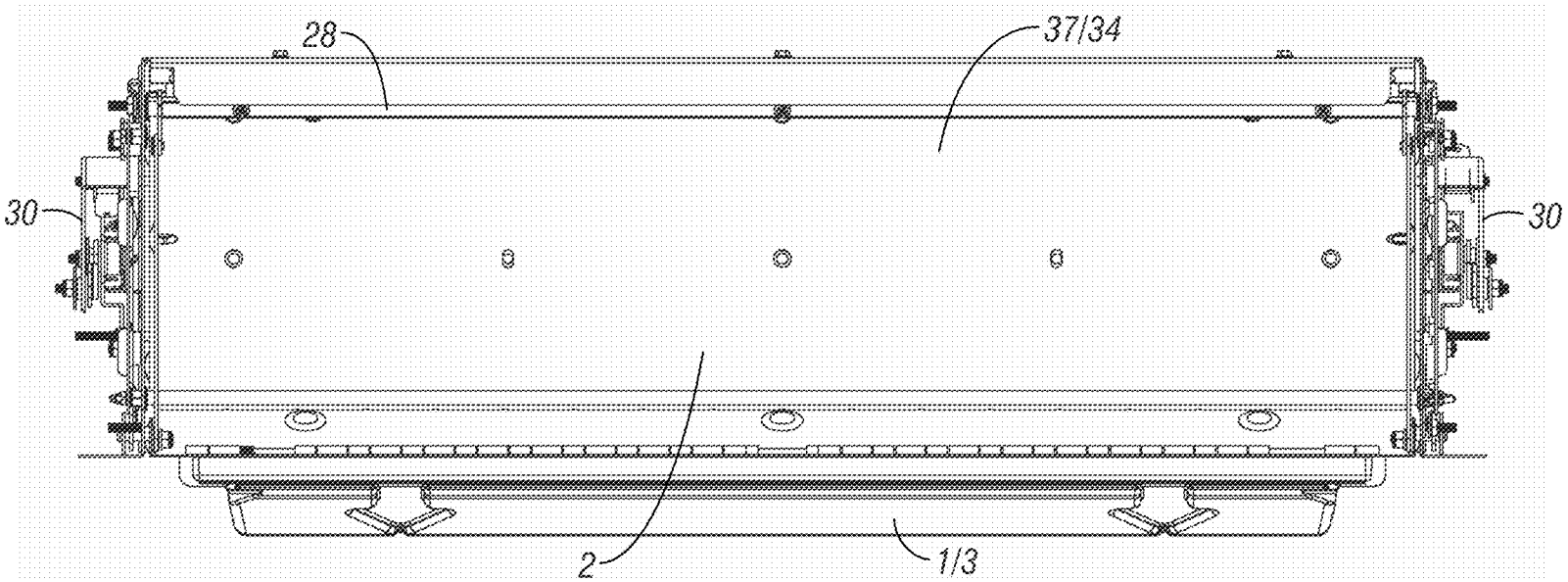
Figure 3E:
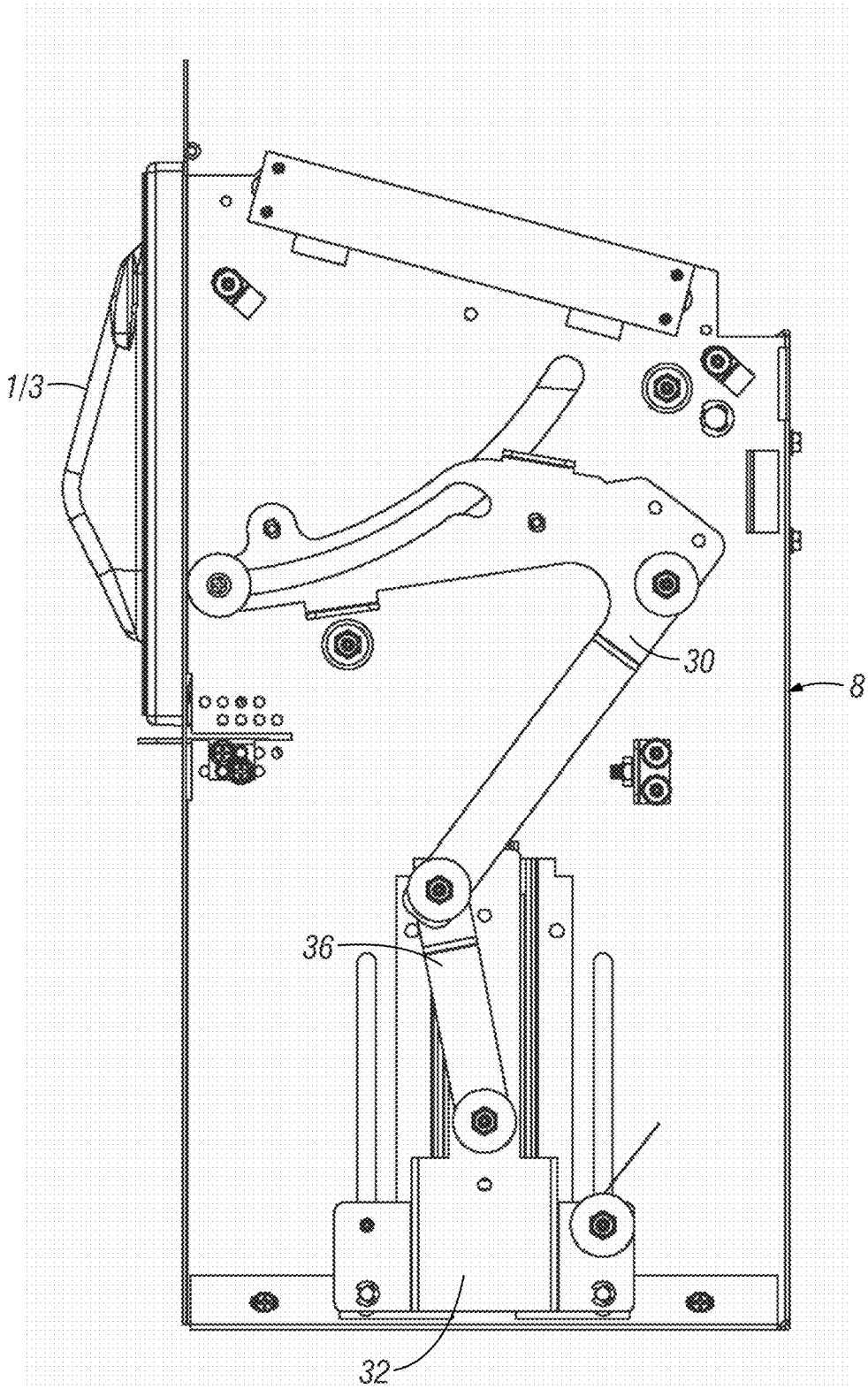
Figure 3F:
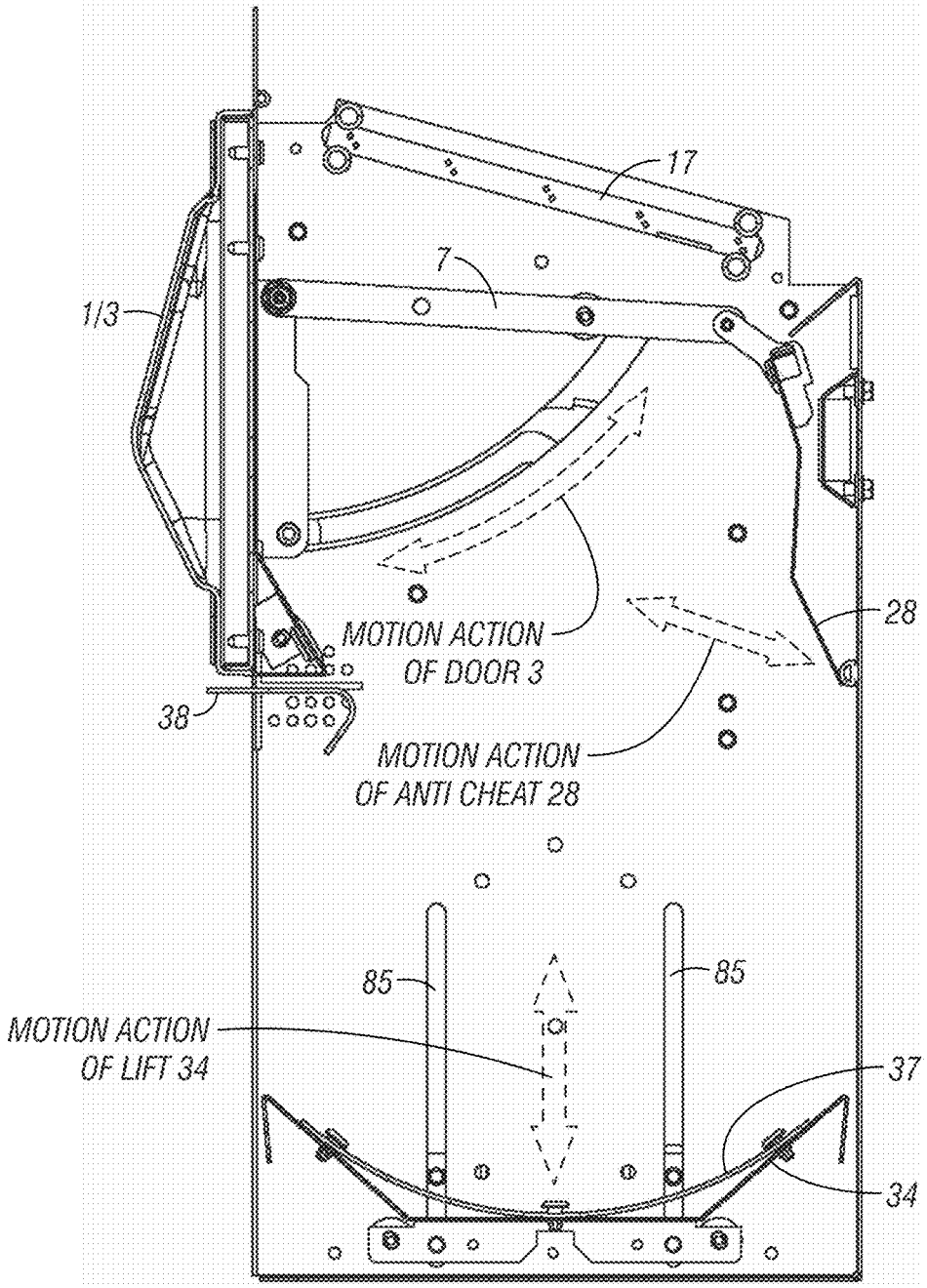

False floor 34 (here aluminum) is covered by a plastic floor base 37 (curved around its longitudinal access in a concave shape) (see FIG. 3F). As mentioned, lift floor 34 has a pair of outwardly extending pins from each opposite side that are journaled in vertical slot pairs 85 on each opposite box side 83, 84. In this manner, lift floor 34 is constrained to vertical movement commensurate with the vertical height of slots 85.

Plastic floor base 37 is curved in that manner to promote elongated vended items to fall down so that they end up in as low a profile as possible on floor base 37. This tries to ensure that elongated items such as bottles would not land on their base and have their head extend vertically. This could make it more difficult to extract. As can further be appreciated, it may conflict with the opening of door 3. The plastic material and its configuration relative to the underlying lift floor 34 also provides some cushioning or impact absorption. Other floor shapes, form factors, and materials are possible.

As illustrated in FIGS. 4A-D (an exploded view of the assembly), lift floor rods 35 are mounted through side flanges in lift floor 34 to provide structural robustness and function as the pins that move in slots 85.

As indicated in the drawings, lift floor 34 covers essentially the horizontal cross-section of bin 8. Plastic floor base 37 can be made of molded plastic. In this embodiment, the length of slots 85 are approximately 4-6 inches such that the range of possible movement from the lower-most home position to a fully raised portion is in the approximately 5 inch range for a typical sized vending machine shown in FIGS. 1A-D. Of course, different distances are possible according to need or desire. But as an example, if home position of floor 34 were approximately 10 inches from the floor or ground when bin 8 is installed in vending machine 110, the 5 inch lifting range would bring the floor to the minimum ADA 15 inch standard.

Door lift floor links 30, pivotally connected on the outside of each of left and right sides 83, 84 of box 8 at pivot axis PA30 (FIG. 3C), have an upper arm 302 which operatively connects to and responds to opening of delivery door 3 in certain circumstances. Lower arms 306 are operatively connected via floor lift links 36. When upper arms 302 respond to opening movement of door 3, links 30 pivot around PA30 and pull lift floor 34 upwardly.

A major feature of this embodiment is that partial opening of door 3 over a first sub-range of approximately 34° of the possible 54° does not move lift floor 34. Further opening of door 3 after the initial 34° commences lifting. Over that last 20°, links 30 would pivot, lower arms 306 would pull lift floor links 36 upwardly, and lift floor 34 would proportionally raise.

This is accomplished as follows.

Roller slides 21, similar to drawer slides, would be vertically positioned between slots 85 on opposite side walls 83, 84 of delivery box weld 8 as shown. One-half of each roller slide would be fixed in position on those side walls. The extendible half (outer half) would be connected to floor lift bracket 32 (an inverted T-shaped member). The lateral arms of T-shaped floor lift bracket 32 would be connected to the lift floor rods 35 that move in vertical slots 85. The lower end of lift floor link 36 would be pivotally attached to floor lift bracket 32. Therefore, any vertical movement of lift floor link 36 would result in smooth roller slide assisted vertical movement of lift floor 34.

The delay, so to speak, of lifting to lift floor 34 during the first 34° of delivery door opening is the result of commensurately curved slots 303 in upper arms 302 of door lift floor links 30 (see FIG. 3C). In a home position, slots 303 are aligned with slots 86 in box weld 80 (see FIG. 3C). The outwardly extending pins from the lower edge of delivery door 3 extend through both sets of slots. This is illustrated in FIGS. 6A, 7A, and 8A and their subparts. Floor lift floor links 30 thus remain in home position until the pins from the lower edge of delivery door 3 hit enlarged slot ends 307 in the top arms 302 of door lift floor links 30 (see FIG. 3C). At that point (commensurate with around 34°), further opening of door 3 starts to pivot links 30 upwardly. Lower arms 306 of links 30 then pull up on floor links 36. This pulls floor lift brackets 32 upwardly. Because brackets 32 are connected to lift floor rods 35, vertical slots 85 constrain that movement to vertical movement. Thus, the lift floor 34 would move proportionally vertically upward with further opening of door 3. Indent profile 307 serves to significantly delay and dampen the unassisted closure of door 1 from the fully open position. This delay allows the user to extract hand and item without fear of being trapped or injured by the closing door. This delay can be accentuated by the addition of spring 201.

Lowering of floor 34 would also be proportional to closing of door 3. However, when door 3 is lowered back to the approximately 34° from vertical position, floor 34 would be home position and stop moving. Pins on the lower end of door 3 would thus freely travel in aligned arm slots 303 and weld slots 86 and allow door 3 back to closed position.

It can therefore be seen that this embodiment provides a mechanical combination allowing a user to partially open delivery door 3 without lift floor 34 raising but then continue opening would cause a lifting.

Several features enhance that action.

For example, spring hinge 2 has been described as biasing door 3 to a closed position. As illustrated at the exploded view of FIGS. 4A-D and shown attached at FIG. 5, constant force springs 14 could be connected between floor lift brackets 32 and spaced apart floor spring holder stakes 23 on box 8. Those springs can be selected to assist the lifting of lift floor 34. When floor 34 is up or at a fully lifted position, springs 14 are at or near relaxed state and do not exert significant forces. But when floor 34 is in down or home position, springs 12 unwind from the relaxed state and exert upward bias on floor 34. As constant force springs, this would be a relatively constant force throughout the range of vertical movement. Springs 12 would not exert enough upward force to automatically raise floor 34 when in home position with no dispensed items (the mass of the components associated with lift floor 34 would not be overcome by the springs upward biasing forces). But they would assist in raising floor 34 with or without dispensed items once sufficient manual force on door 3 is exerted by the customer. In this example, such springs could add perhaps several pounds (e.g. 2 to 5) of force. This could be beneficial in meeting ADA requirements. The designer can select the same. Other forms of lift assists are possible. For example, different ways to assist/reduce force needed to move the components described above are possible. One example is placement of counter weights, such as on the dispenser floor, to help facilitate its return to a lower-most or home position after the dispensed item has been removed or the user decides to return the door to home position.

As shown in FIG. 3C, bumpers 308 and 309 can be installed along opposite side walls 83 and 84. They could cooperate with flanges 304 and 305 on upper arm 302 of link 30. Essentially it could act as a mechanical stop or rest when floor 34 is in home position (see flange 304 and bumper 308). Similarly, they can act as a mechanical stop when door 3 approaches its fully opened position (see flange 305 and bumper 309).

The configuration and geometry of links 30, slots 303 and 86, link arms 36 are coordinated with the size and movement of door 3. It is to be appreciated, however, by those skilled in the art, that obvious variations to these specifics are possible depending on need or desire. Also, a range of possible variations of coordination of the components is possible according to need or desire. The designer would take into consideration the factors felt necessary for an application towards one or more of the aspects of the discussed combination.

Another potential feature can be coordinated with opening of door 3. As mentioned, door 3 provides a partial anti-cheat component against someone trying to reach a hand or tool up towards dispensers 122. When door 3 is in fully open position such as FIG. 5, it covers a substantial amount of the horizontal plane at or near the top of box 8. But it does not cover that whole plane. A rear anti-cheat plate 28 is fixed to a shaft 29 along its top edge. Shaft 29 has a square cross-section along most of its length except for around opposite ends. The round ends would be journaled at opposite sides of box 8 to define a pivot axis PA28 along or near the back top of box 8. Anti-cheat linkage stakes 7, having a longer portion and a shorter portion pivotally connected at adjacent ends, would attach at front ends along the sides of dispensing door 3 (a distance below spring hinge 2). The rear ends of anti-cheat stakes 7 would have square openings that would matingly slide over the square cross-section of shaft 29. When installed, rear anti-cheat plate 28 would basically hang vertically when door 3 is in closed position. However, when door 3 is started to open, including during its first 34° of opening, stakes 7 would start to move backwards and then at some point cause rotation of shaft 29. The more door 3 is open, the more plate 28 would pivot forwardly and upwardly to meet and slightly overlap door 3. This would provide a more complete covering of the horizontal cross-section at the top of the box for anti-cheat purposes.

FIGS. 4A-D and 3A also show a delivery door opening anti-cheat 38 could be mounted along the lower edge of the access opening and be made of a robust material such as metal.

Still further, a delivery sensor subsystem could be mounted to box 8. In this example, an optical sensor system including sensor array 17 at opposite sides 83 and 84 of box 8 at its top could sense and report if an item passes into box 8. An example is the I-Vend® system available from Fawn Engineering, Des Moines, Iowa USA. This is an example of an added optional feature that can enhance another aspect of this invention. As can be appreciated, the assembly of FIGS. 3A-5 is fairly compact and basically self-contained. All of the features of door opening that can selectively control bin floor lifting as well as back anti-cheat pivoting are relatively non-complex even though the movement relationship facilitated by these components is subtle and complex. The dispensing sensor can be preassembled. Thus, a feature is this entire combination can be retrofitted into an existing machine to take advantage of these features without any or much additional structure or components. On the other hand, this can be original equipment to the vending or dispensing apparatus. As can further be appreciated, the entire assembly is fairly lightweight. Some of the materials enhance this. An aluminum lift floor 34 and plastic floor base 37 promote this. For those components, lighter weight means less lifting force needed. Appropriate plastics can also be used for some of the components depending on application which may reduce cost and weight. Additionally, as discussed previously, space utilization is a part of the embodiment shown in the drawings. The components that facilitate the non-linear bin floor lifting are built into the sides of the delivery bin. As such, they do not add much to the volume defined by the delivery bin. This allows the entire assembly to be beneficially applied to a wider range of dispensed item sizes because more space can be used for the bin. As can be appreciated, if the function of the bin floor lift is desired, and if a relatively large sized item is vended, it may end up supported on the bin floor on its base. In the case of a beverage bottle, when the floor lifts, the top of the dispensed item could block the complete opening of the access door. Thus, this embodiment promotes more space in the bin to accommodate larger vended or dispensed items that will work and allow complete door opening than if the bottom to top distance in the bin were more limited. The form factor of this embodiment also provides flexibility for retrofitting into existing machines. In other words, if the general bin size is similar to those in existing vending machines, a bin with the lift assist according to this embodiment can be more easily swapped into an existing machine. Still further, the mechanical solution of the embodiment does not require interconnection with motors, drive trains, or the like, which could occupy space or make it more difficult to install or design into machines.

As can be appreciated from FIGS. 4A-D and other drawings, various spacers, bumpers, bearings, and the like can be utilized to enhance or promote long and accurate operation.

Operation

To further illustrate the cooperation of components for mechanical door opening and its commensurate functions, FIGS. 6A-H, FIGS. 7A-G and FIGS. 8A-G are presented.

Figure 6A:
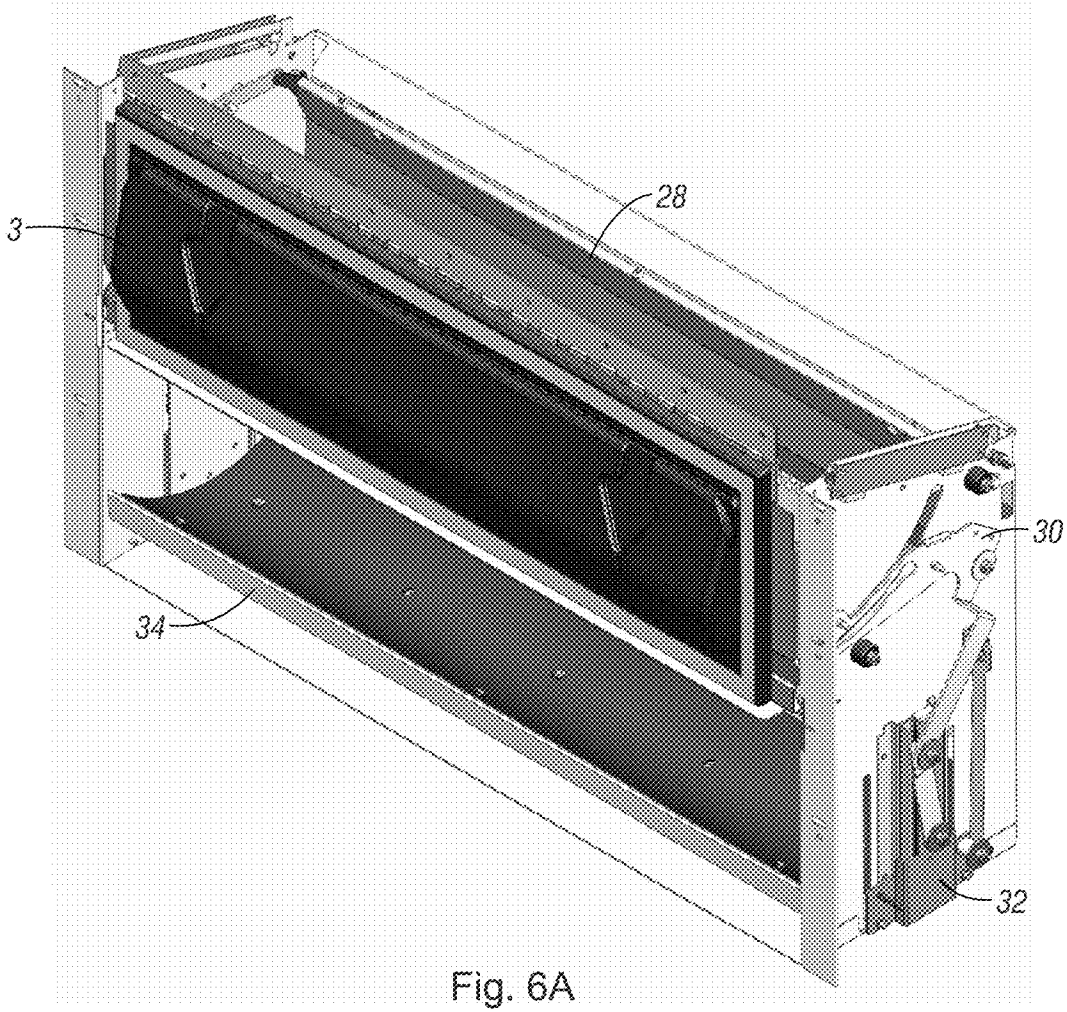
FIG. 6A is similar to FIG. 5 showing in perspective the apparatus of FIG. 3A in isolation with the delivery door in a closed vertical position and the bin floor in a lowered home position.
Figure 6B:
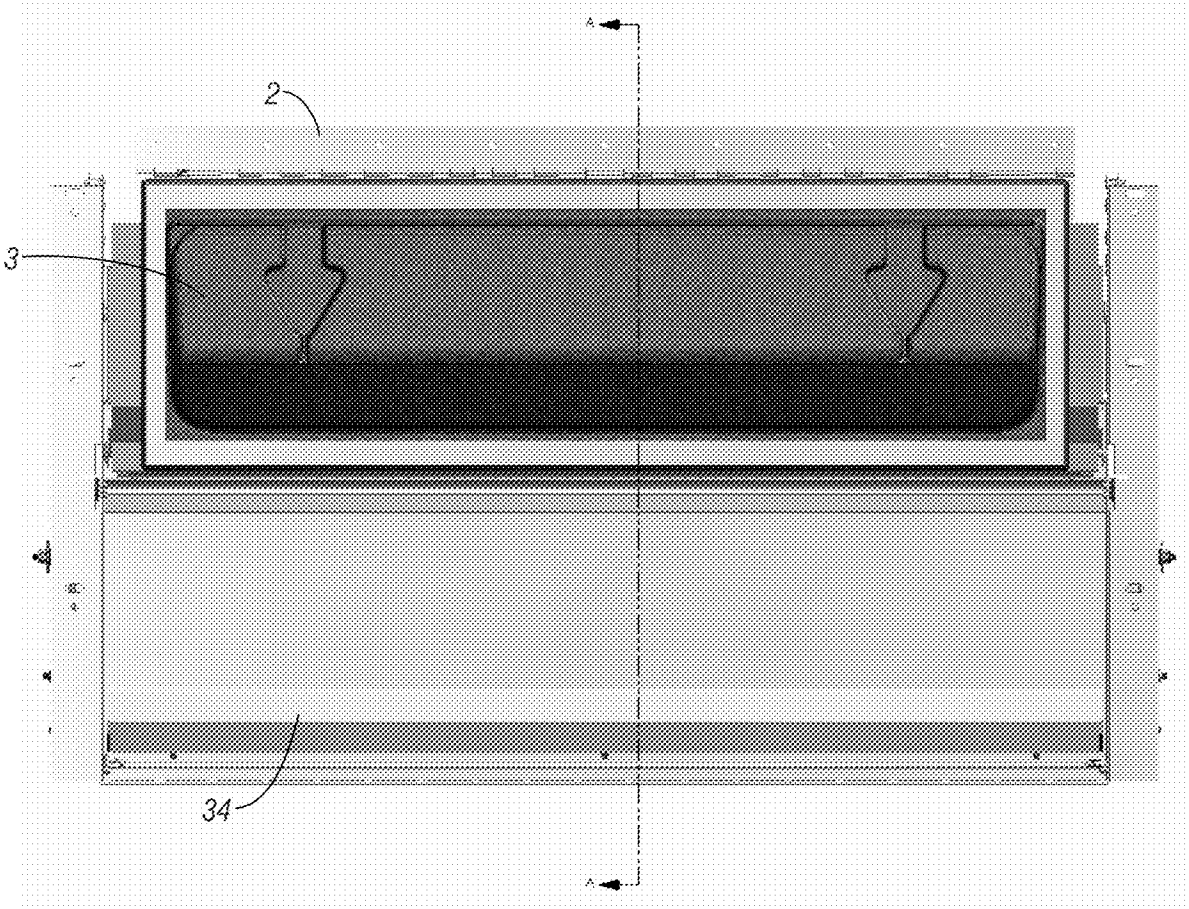
FIGS. 6B-H are isometric views and sectional views showing different viewing orientations of that position.
Figure 6C:
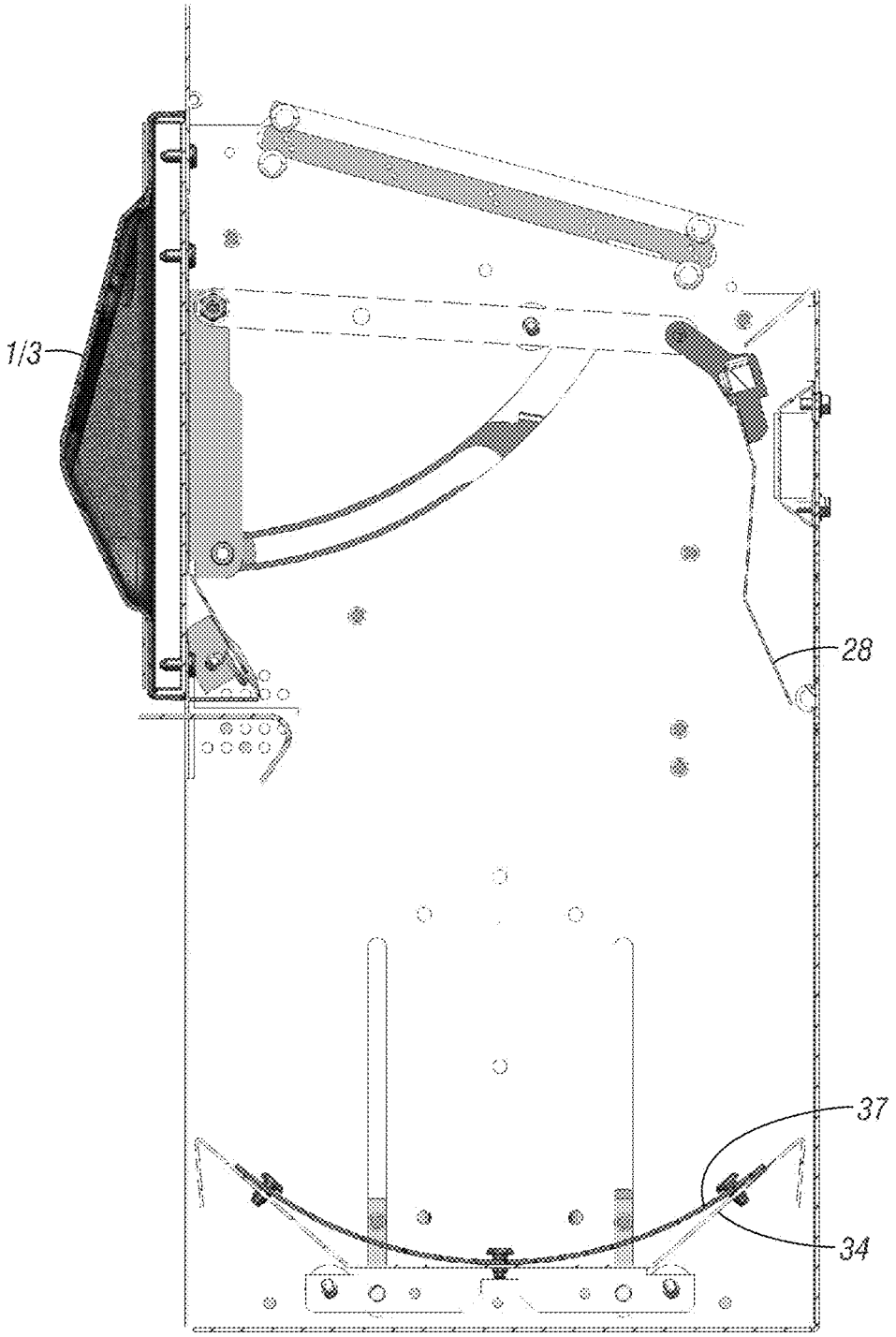
Figure 6D:
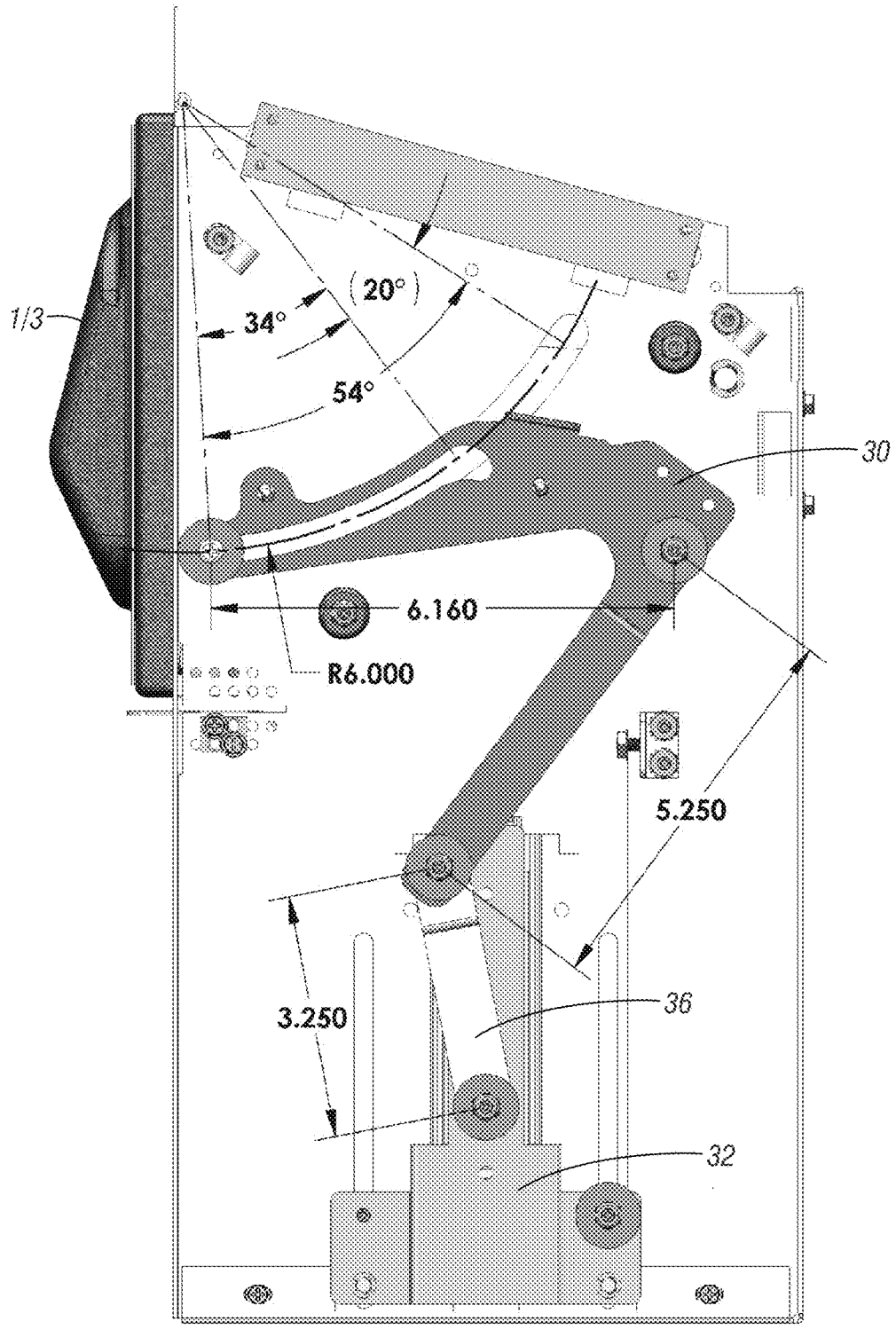
Figure 6E:
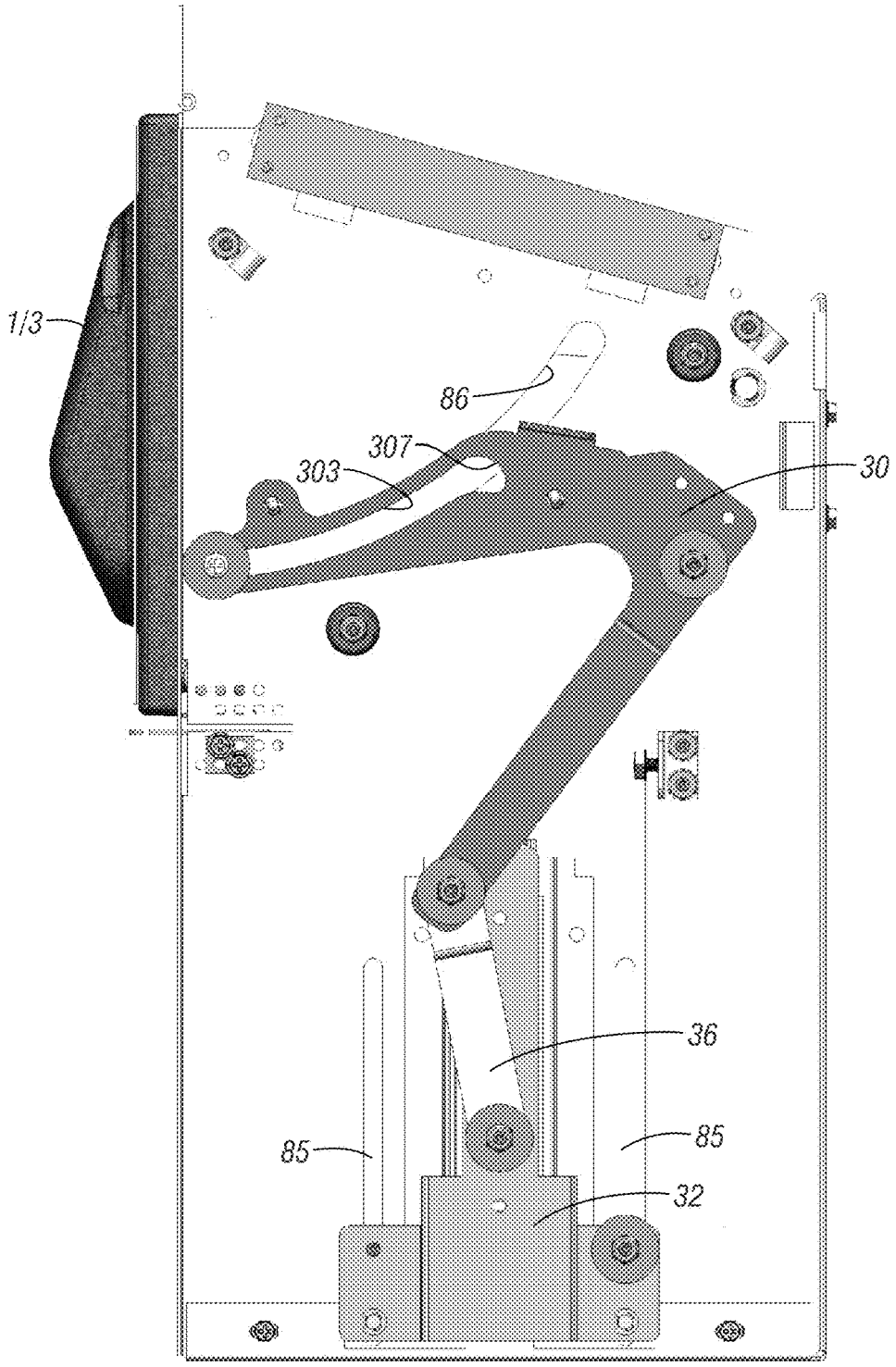
Figure 6F:
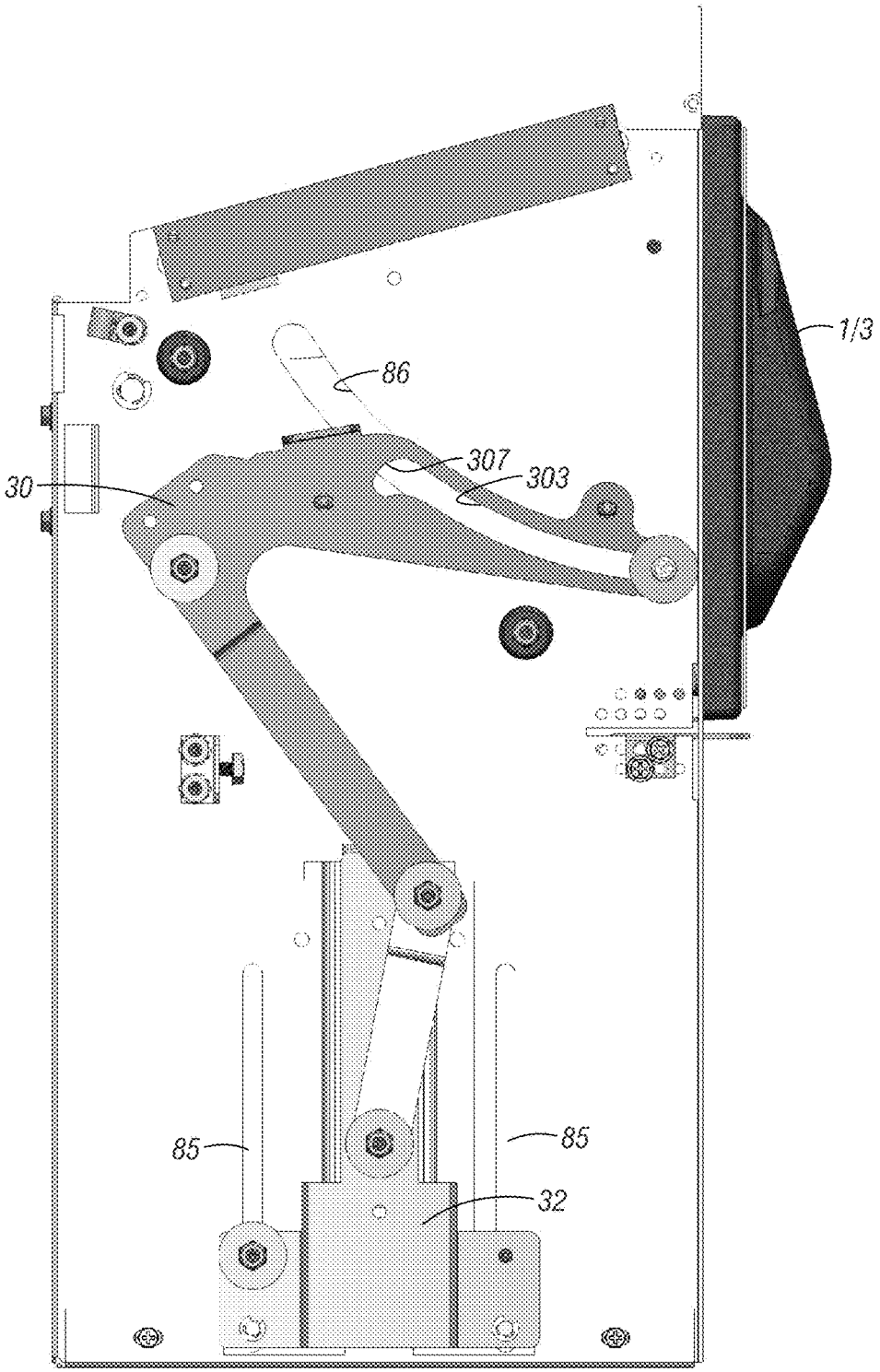
Figure 6G:
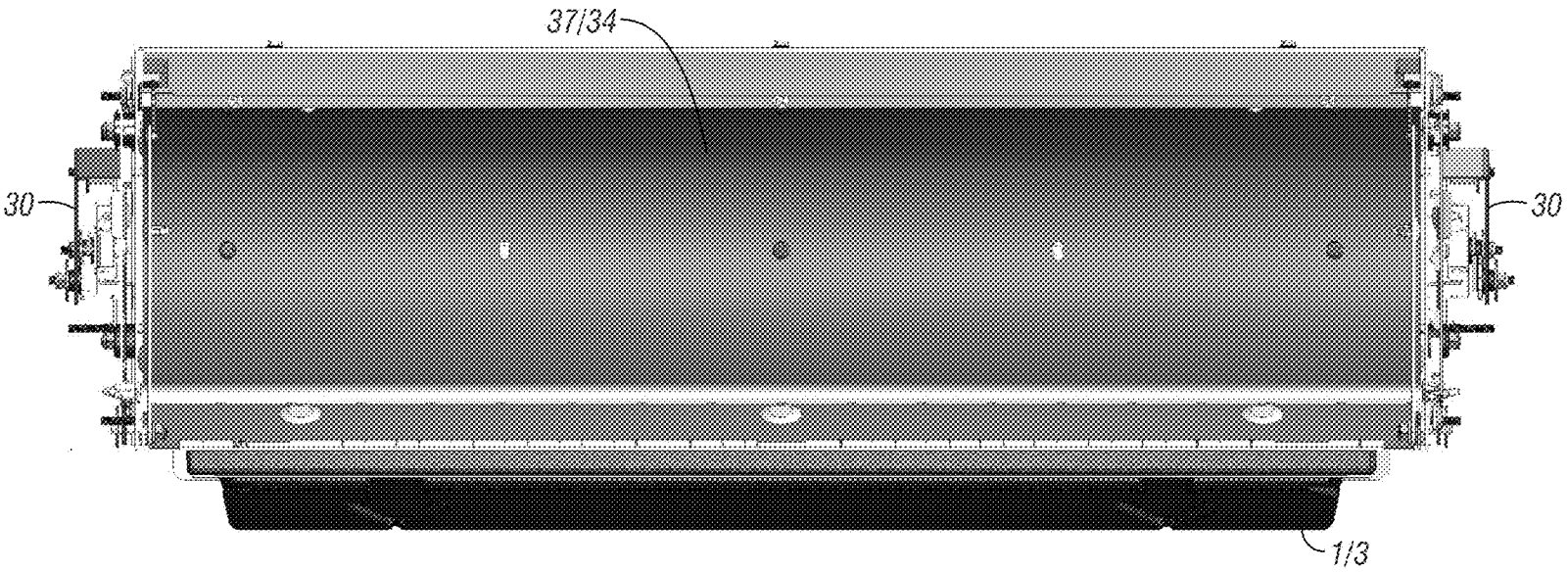
Figure 6H:
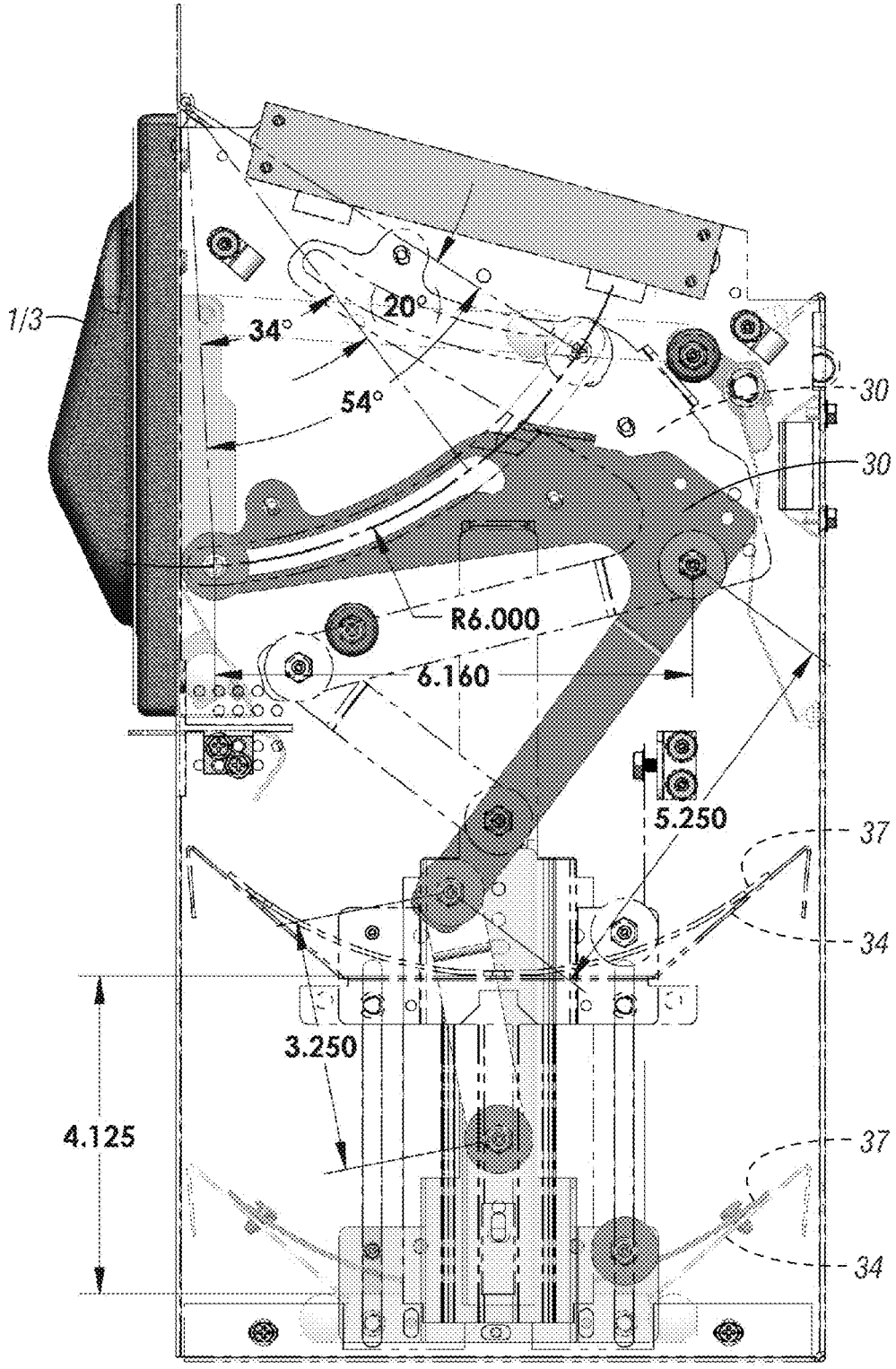

FIG. 6A is a perspective of the assembly in normal or home position. Door 3 is closed, lift floor 34 is in bottom or home position, and back anti-cheat is vertical or close thereto (open). FIGS. 6B-H show various views of those components in those positions as well as the mechanical connections and relationships between them. In particular, FIGS. 6D and 6H provide added dimensional and angle information for this particular size and configured example.

Figure 7A:
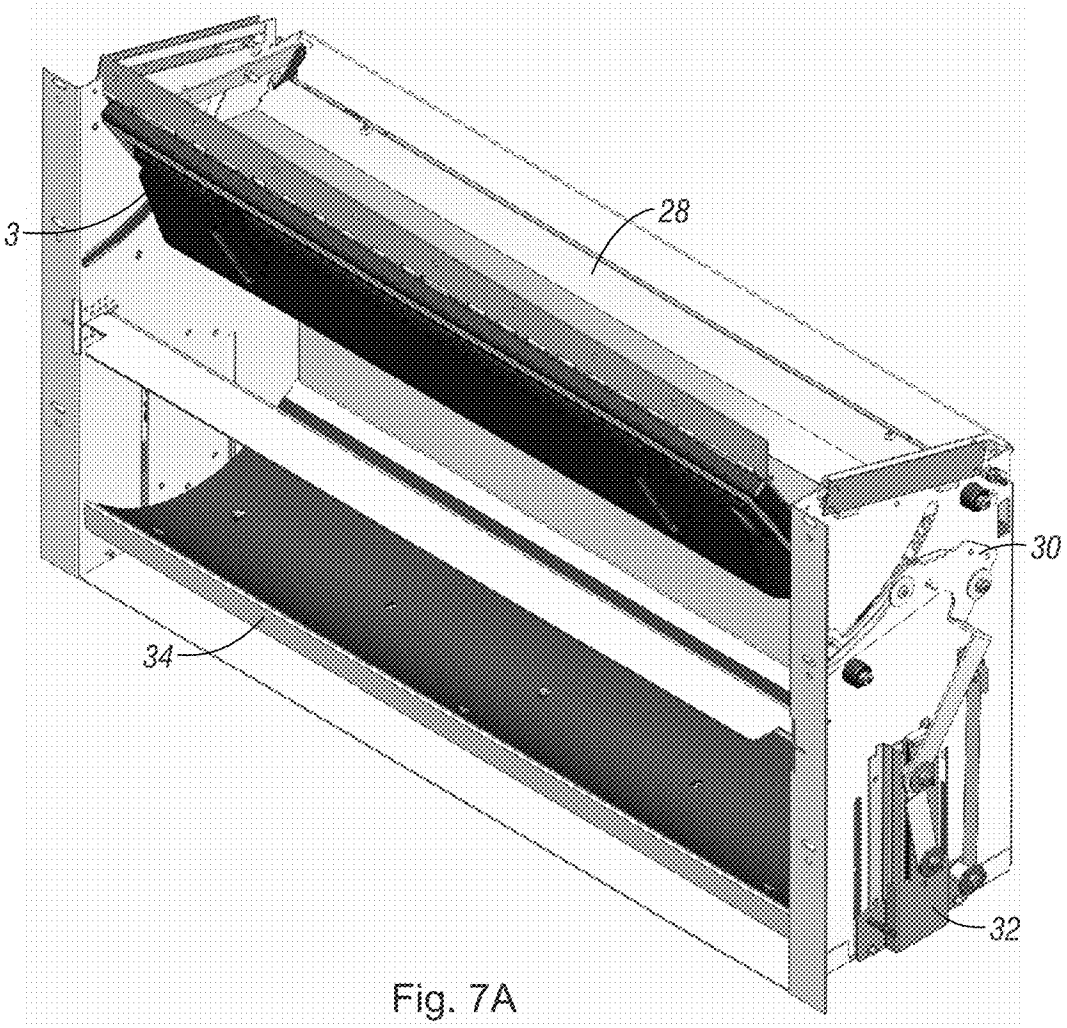
FIG. 7A is similar to FIG. 6A but shows the delivery door pivoted open to approximately 60%°-70%° from closed and showing how the bin floor would remain in lowered or home position over that range of motion.
Figure 7B:
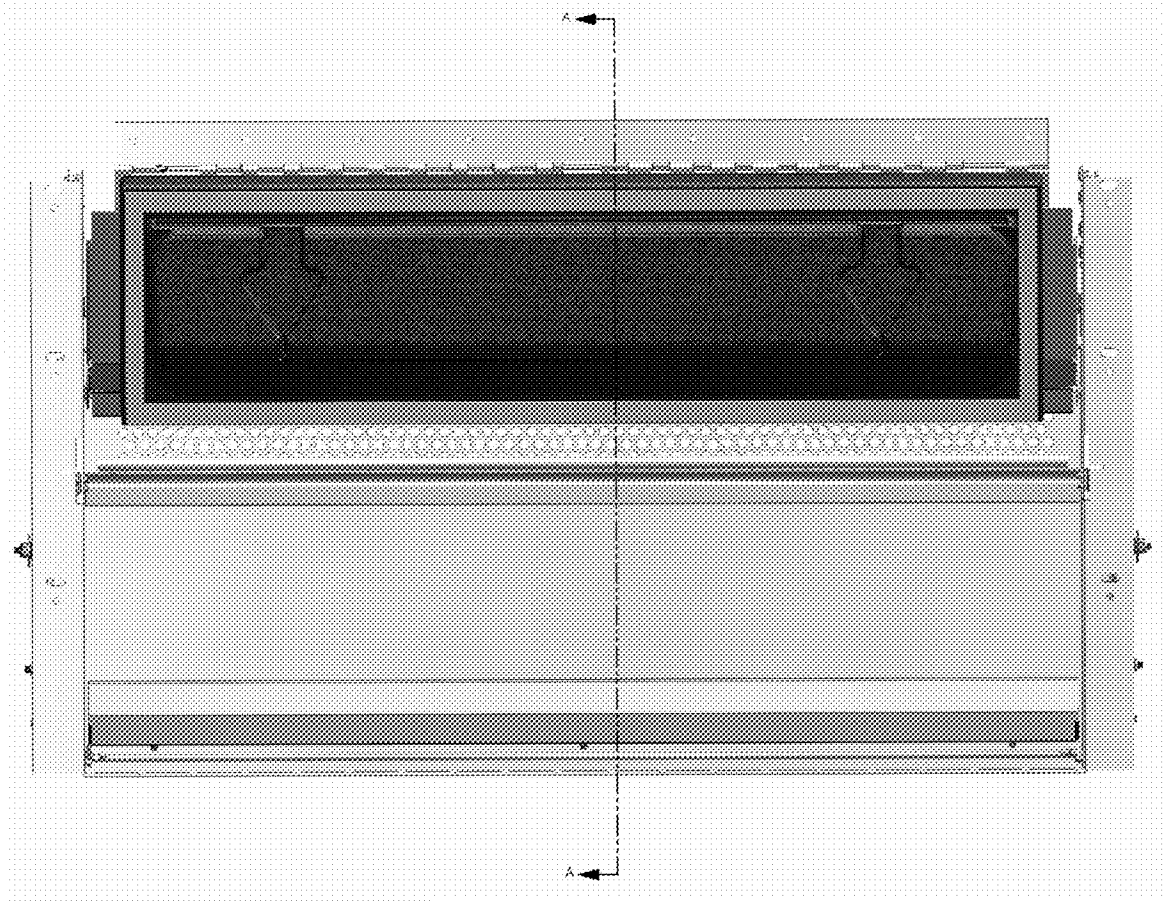
FIGS. 7B-G are similar views to FIGS. 6B-G but in this second position.
Figure 7C:
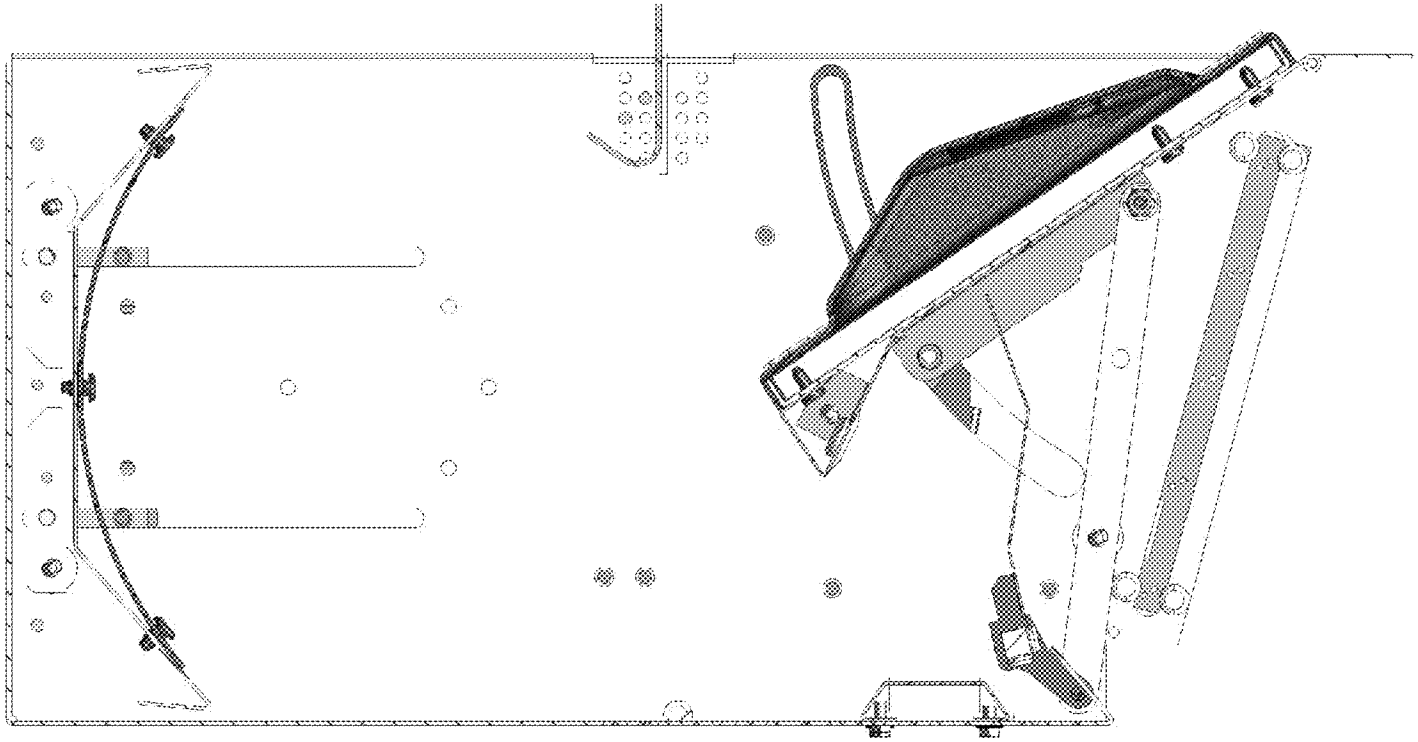
Figure 7D:
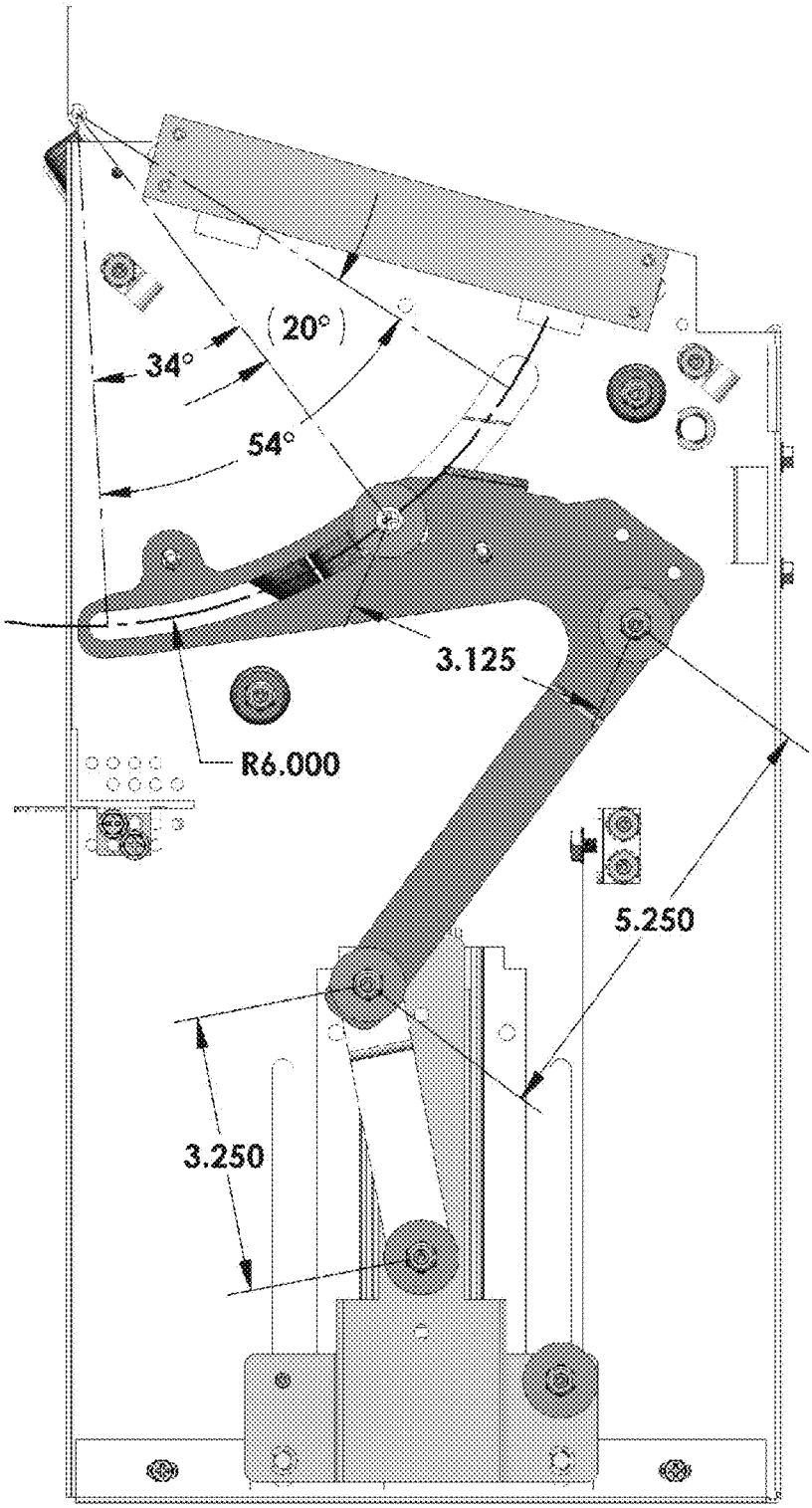
Figure 7E:
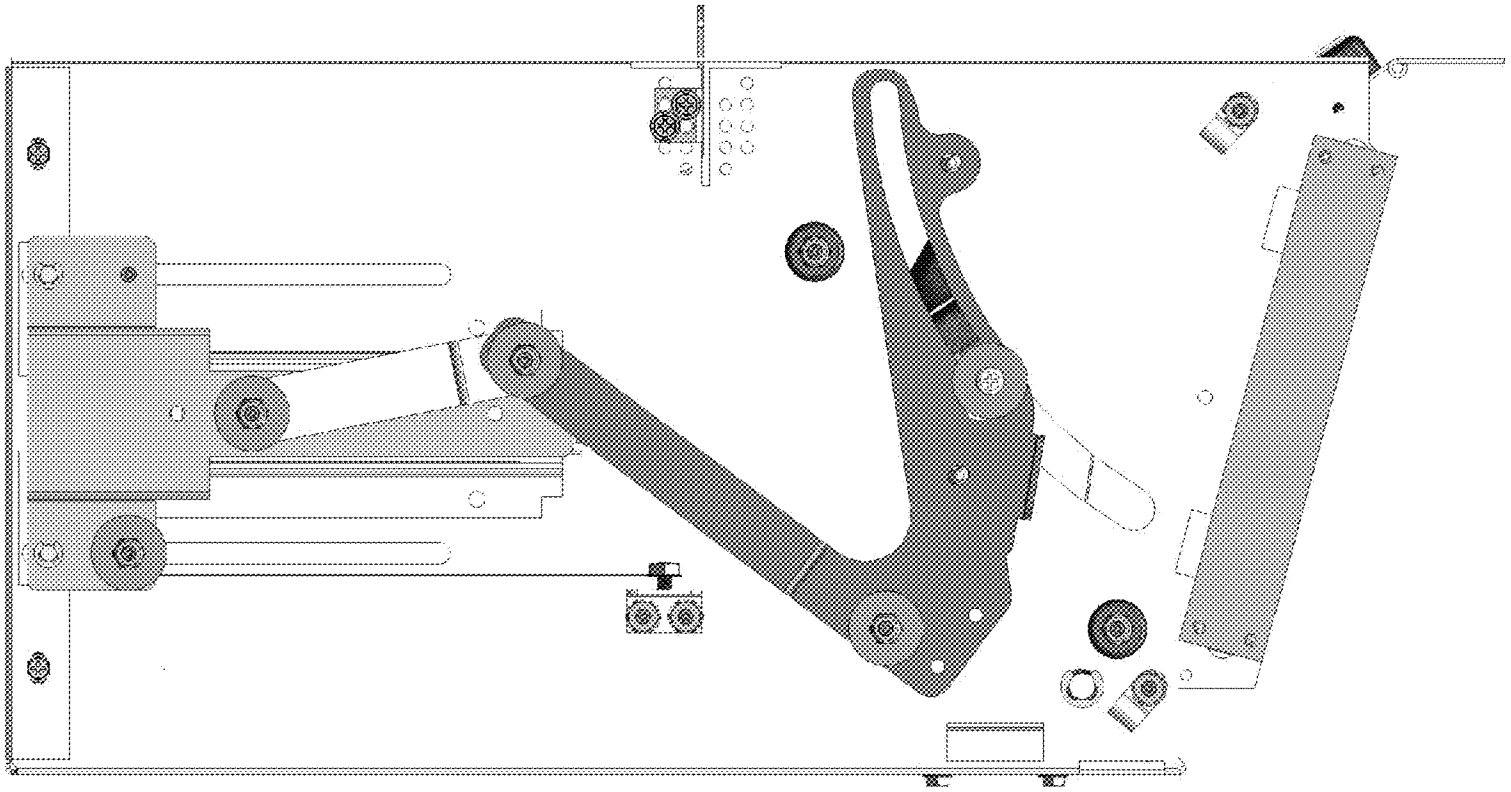
Figure 7F:
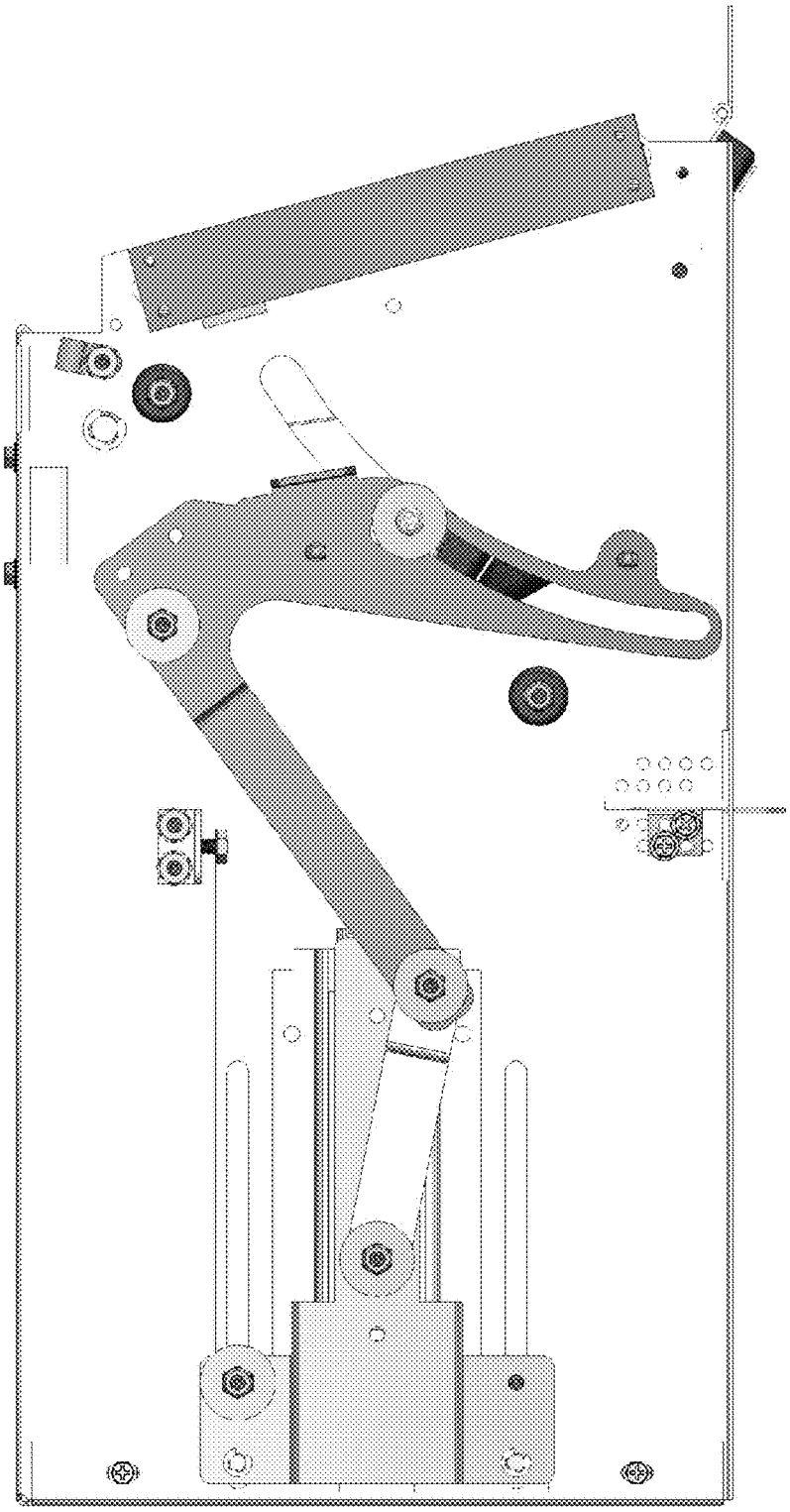
Figure 7G:
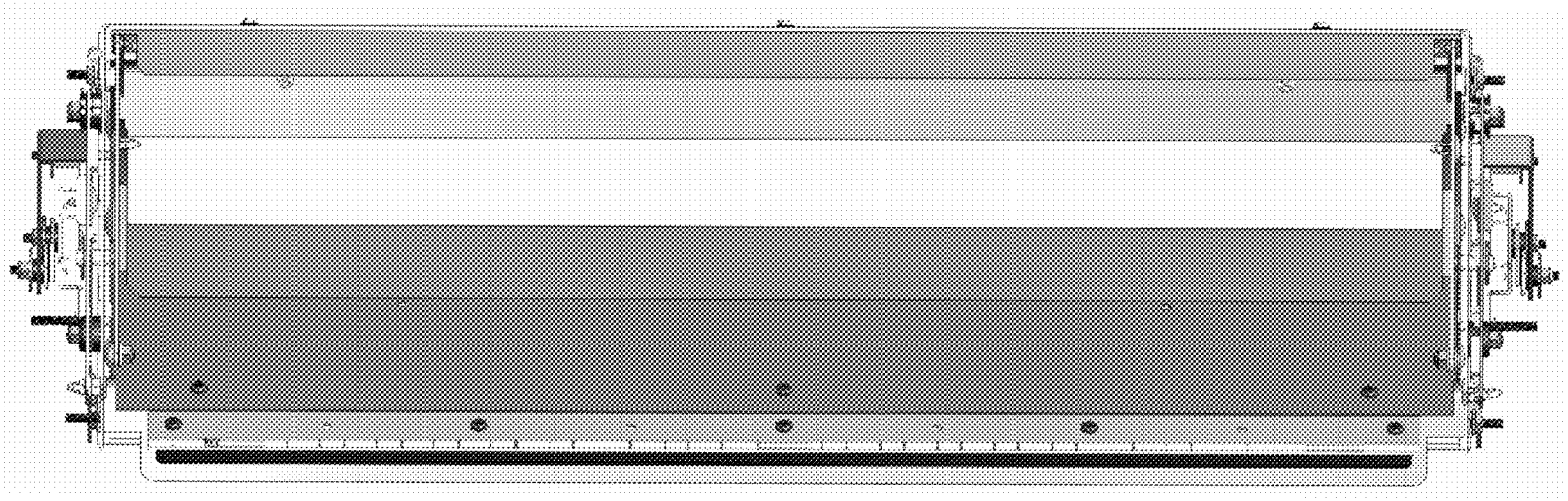

FIG. 7A is a perspective of door 3 opened to what will be called the transition point (approximately 34°) when pins extending from its lower edge move to the enlarged end portions 307 of slots 303 and upper arms 302 of door lift floor links 30. In essence, links 30 remain in the same position as in FIGS. 6A-6H. Thus, floor 34 remains in home position over any of that range of motion of door 3.

Figure 8A:
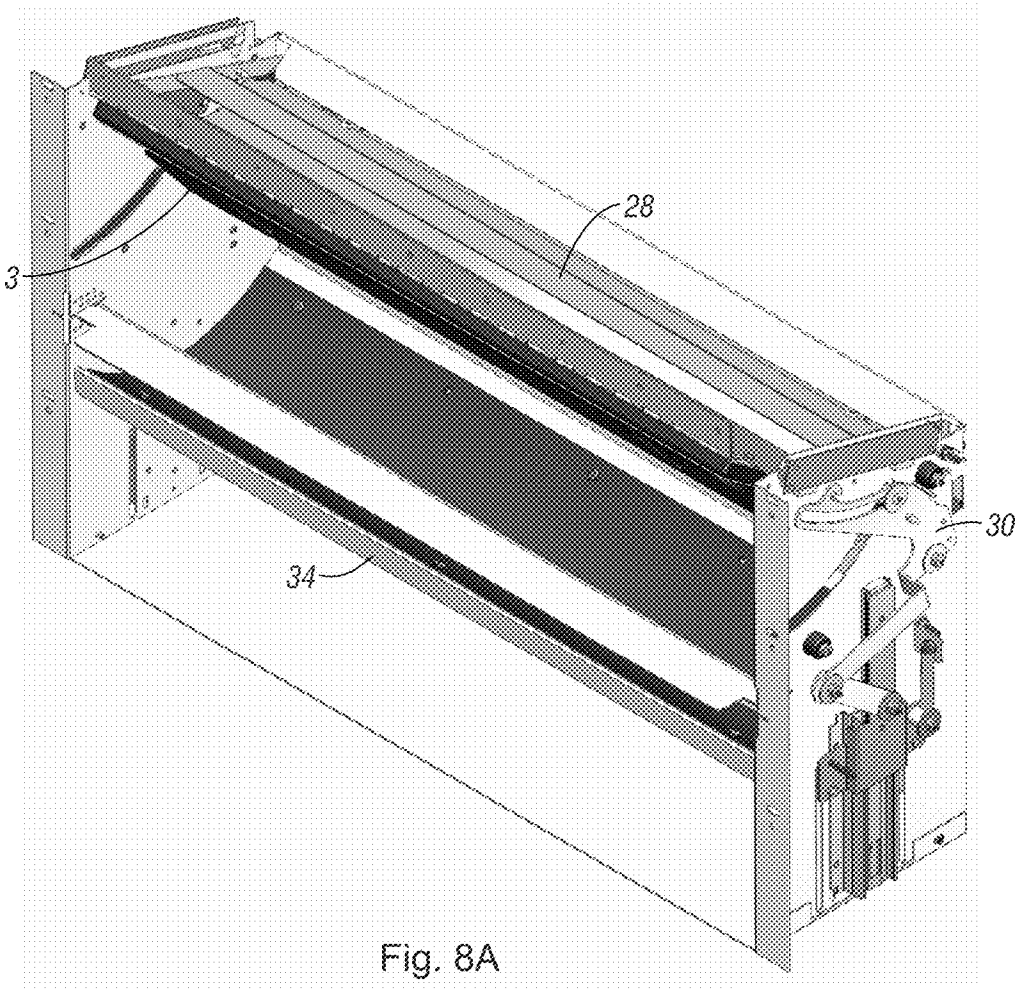
FIG. 8A is similar to FIG. 7A but shows the delivery door moved further inwardly and upwardly to its fully opened position and showing how mechanical linkage would raise the bin floor in response.
Figure 8B:
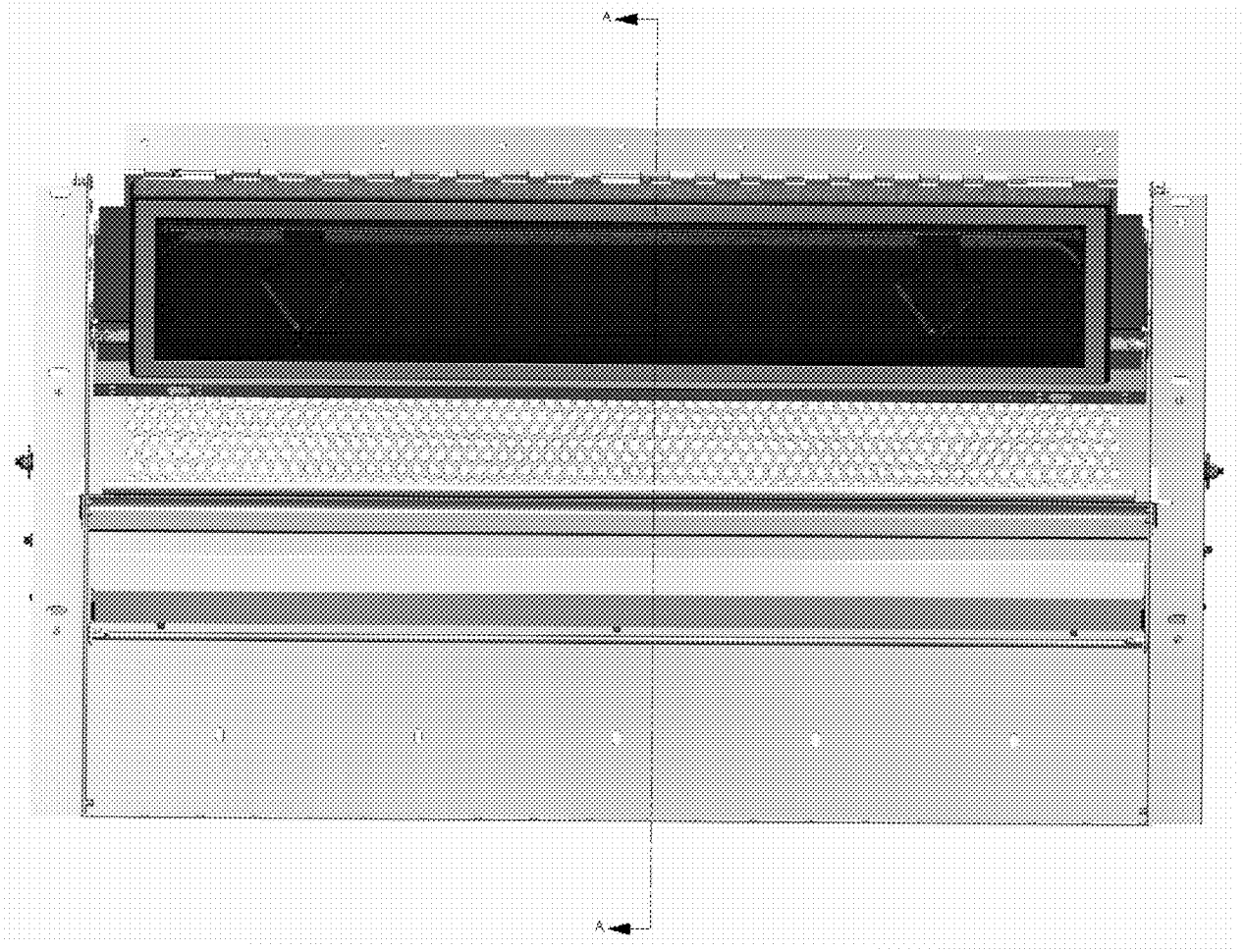
FIGS. 8B-G are isometric and sectional views of this position.
Figure 8C:
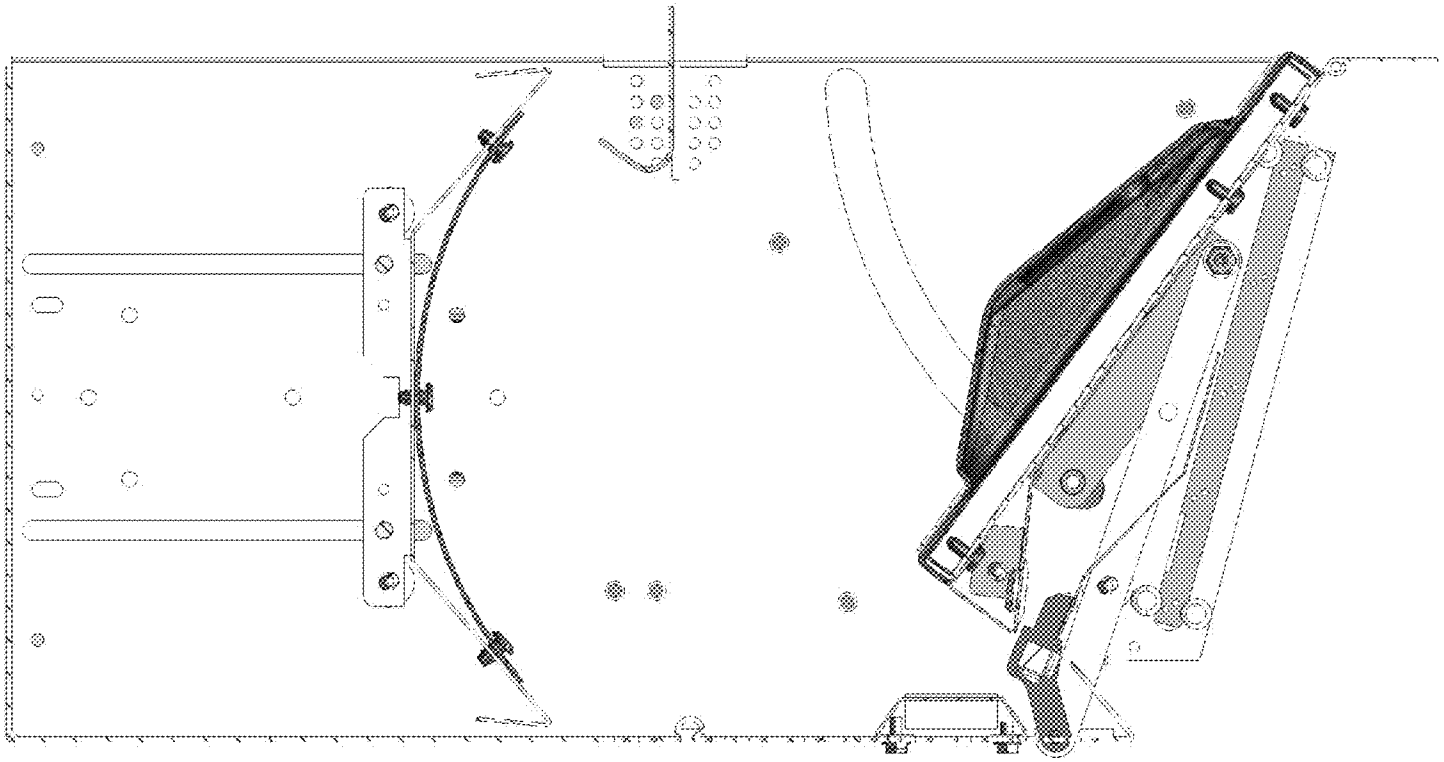
Figure 8D:
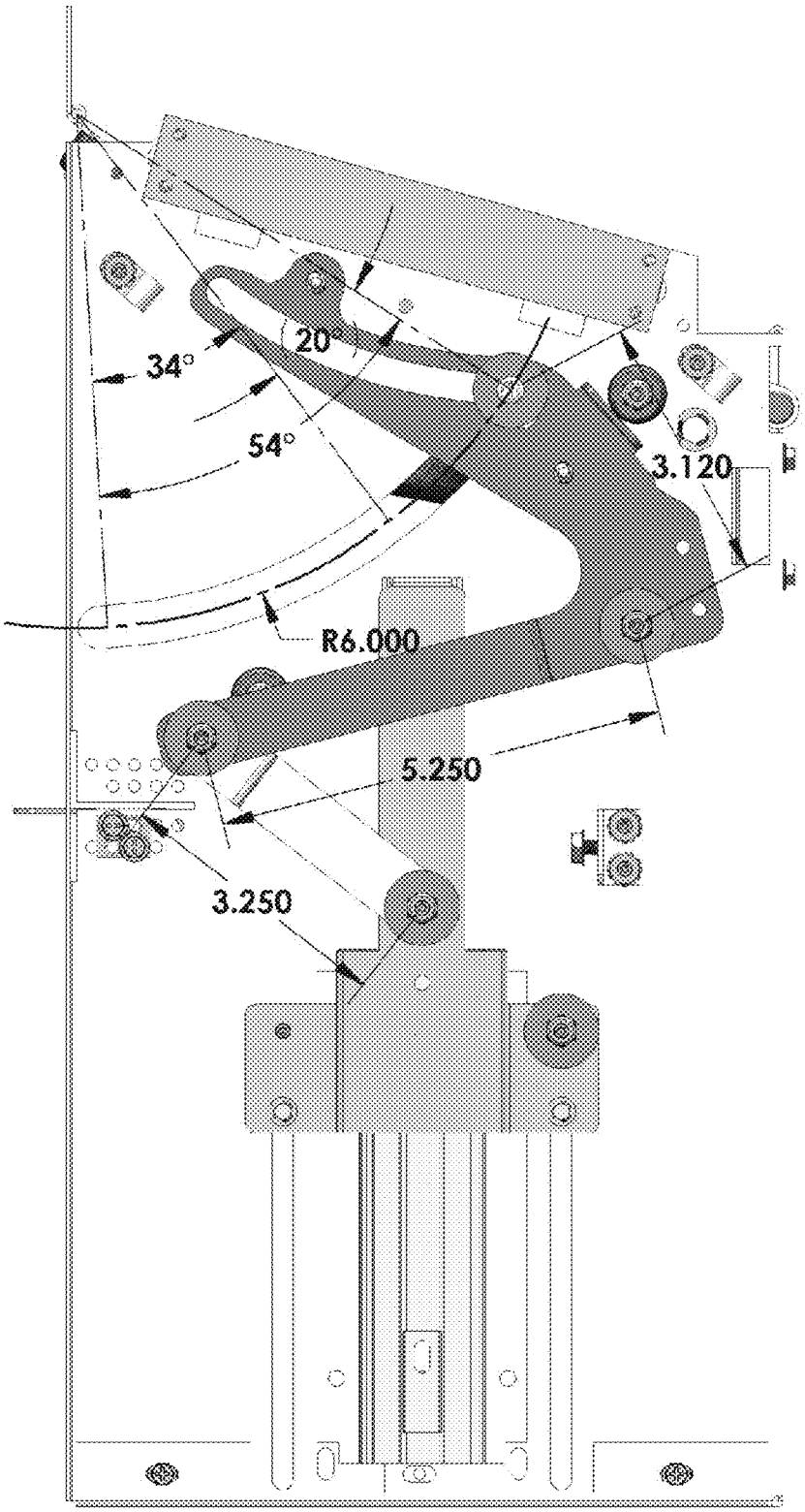
Figure 8E:
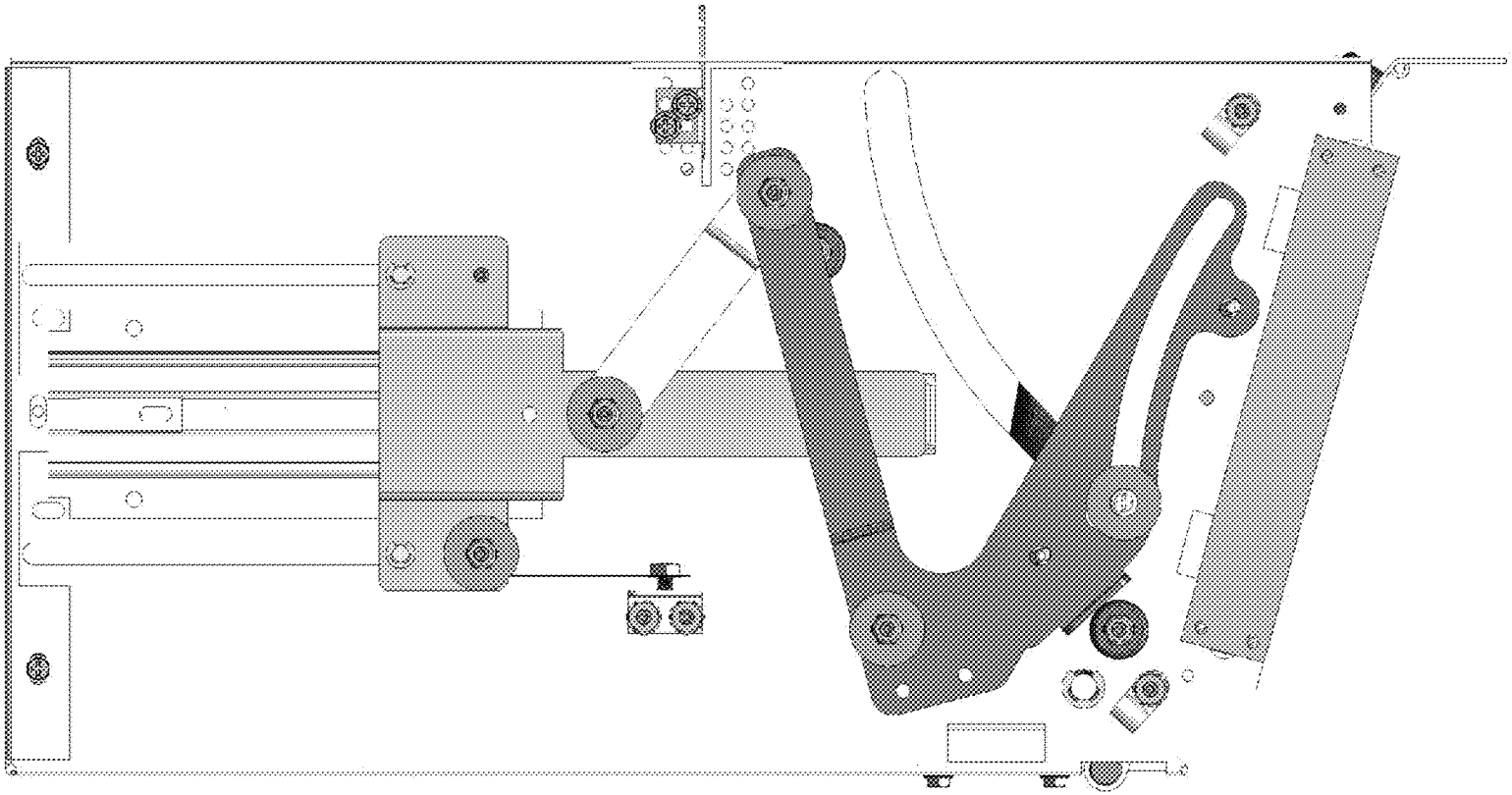
Figure 8F:
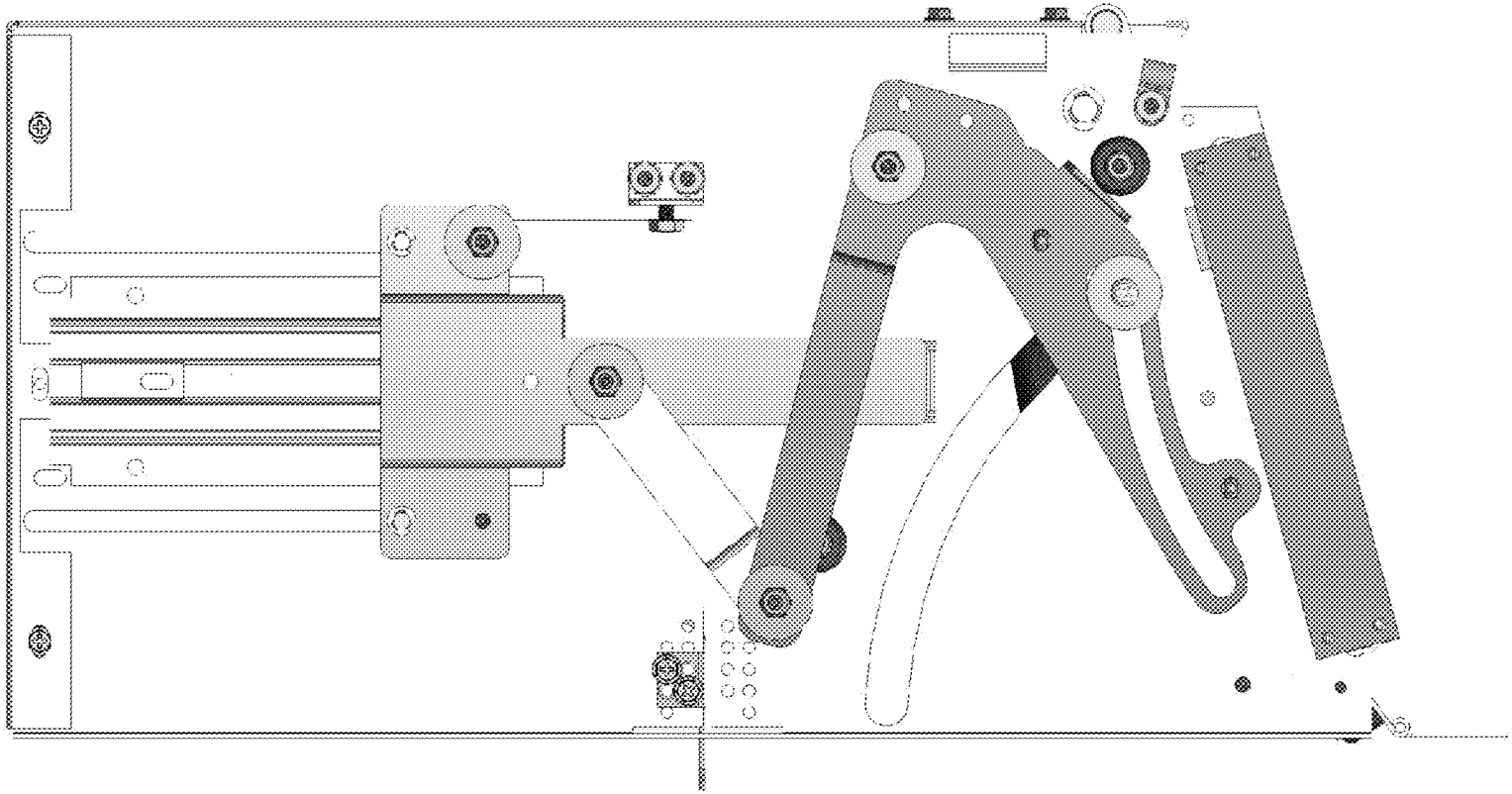
Figure 8G:
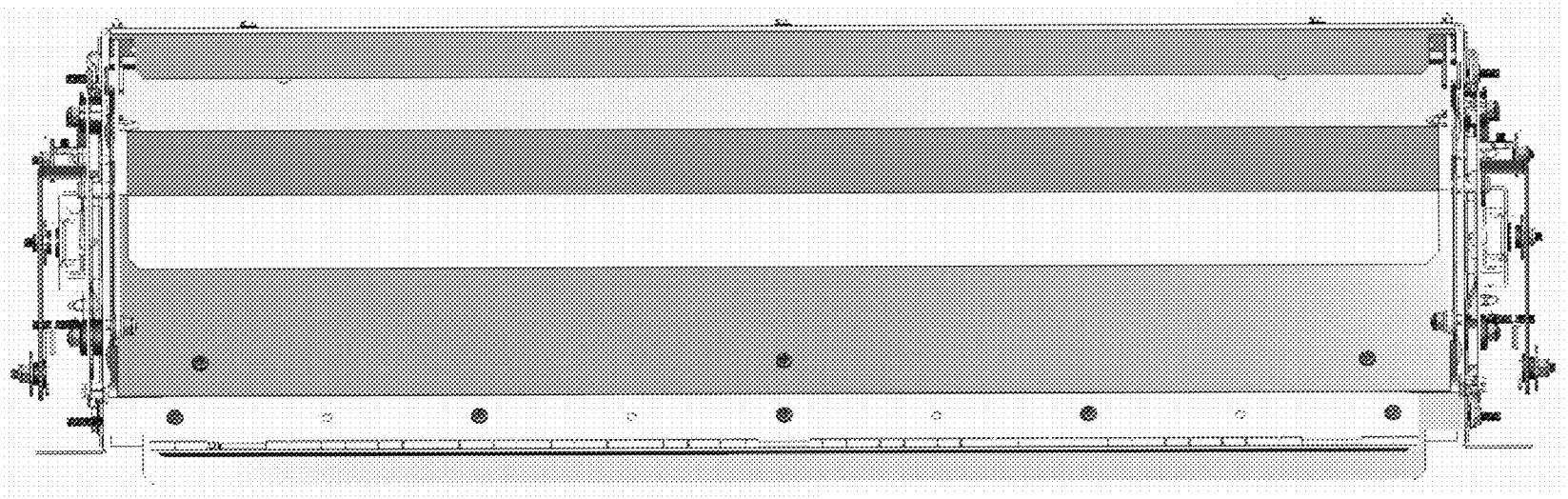
Figure 9A:
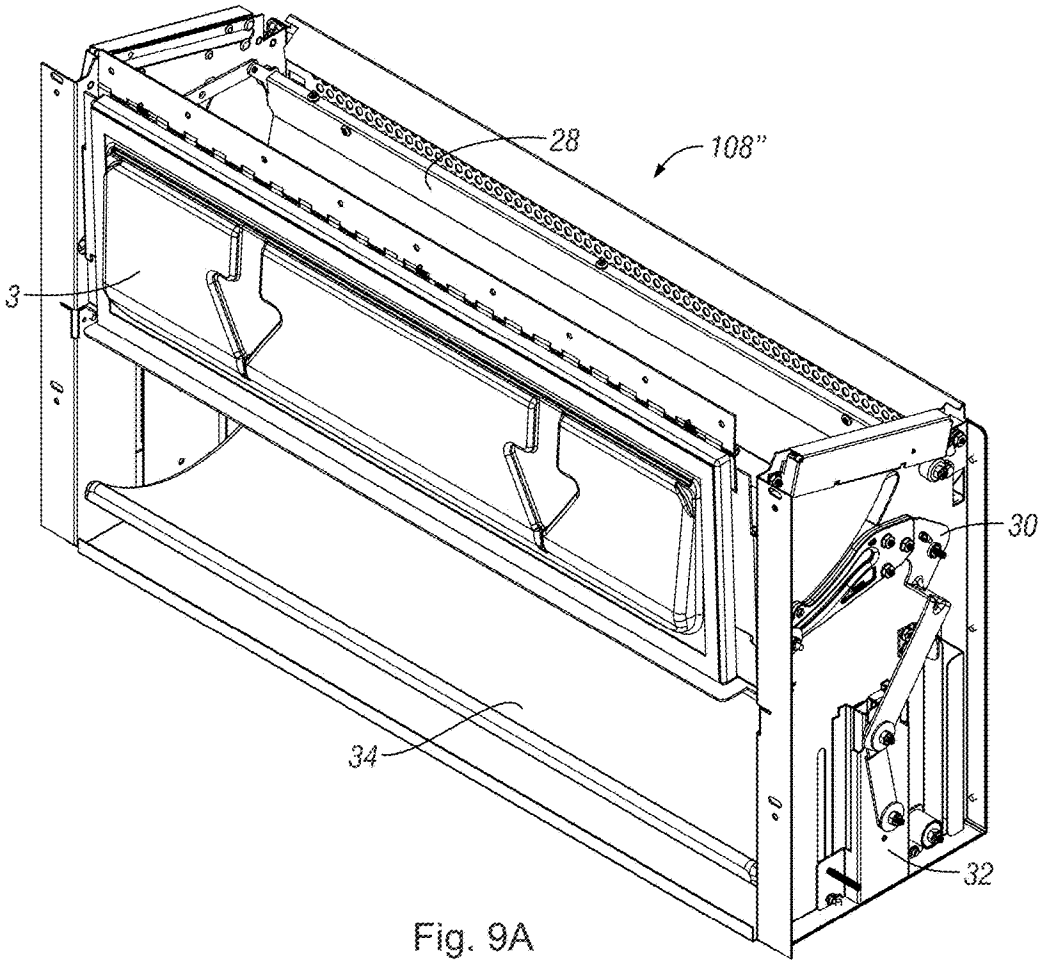
FIGS. 9A-F are similar to FIGS. 3A-F but illustrate an alternative but similar embodiment of a delivery bin according to aspects of the present invention.
Figure 9B:
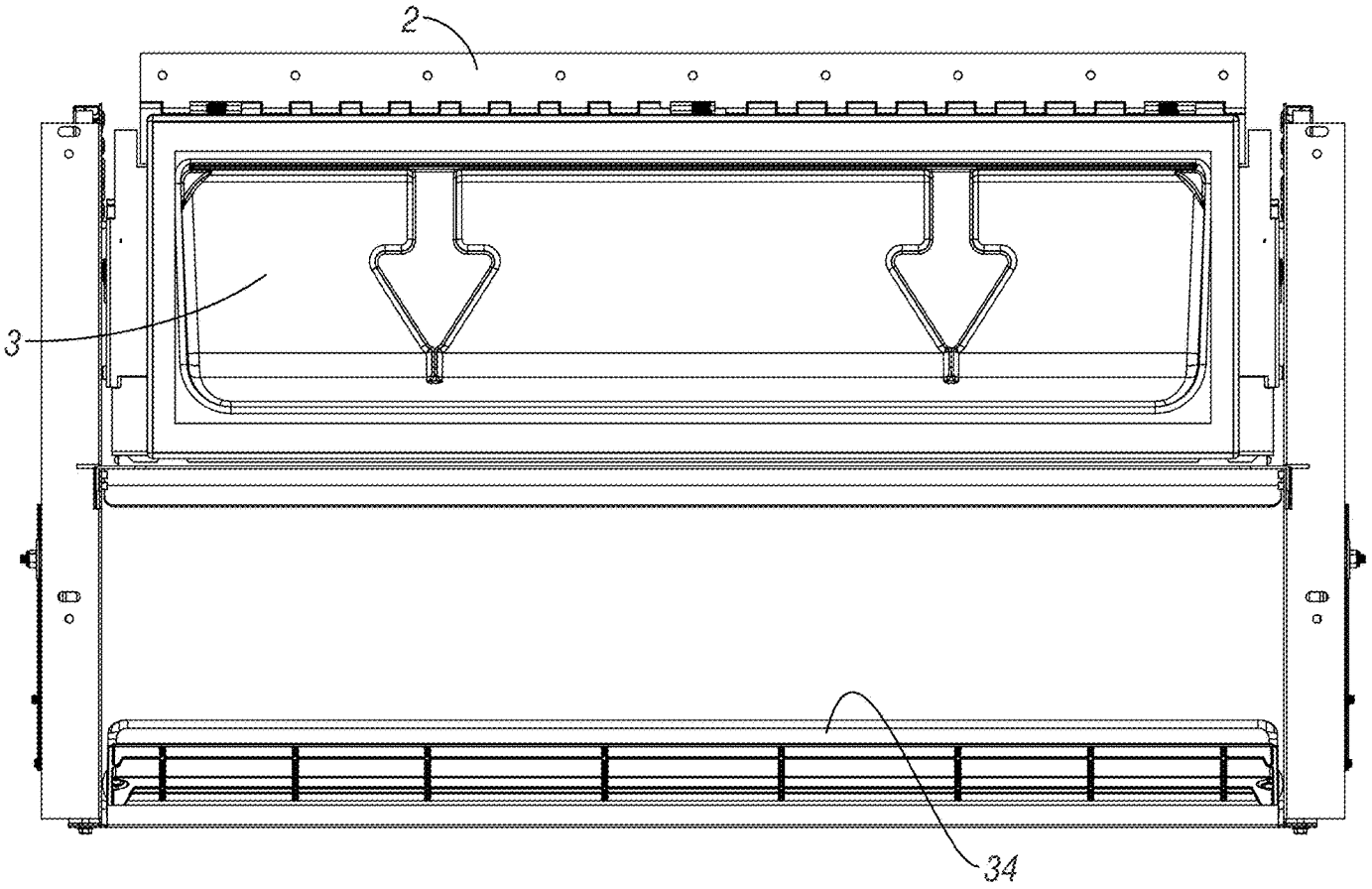
Figure 9C:
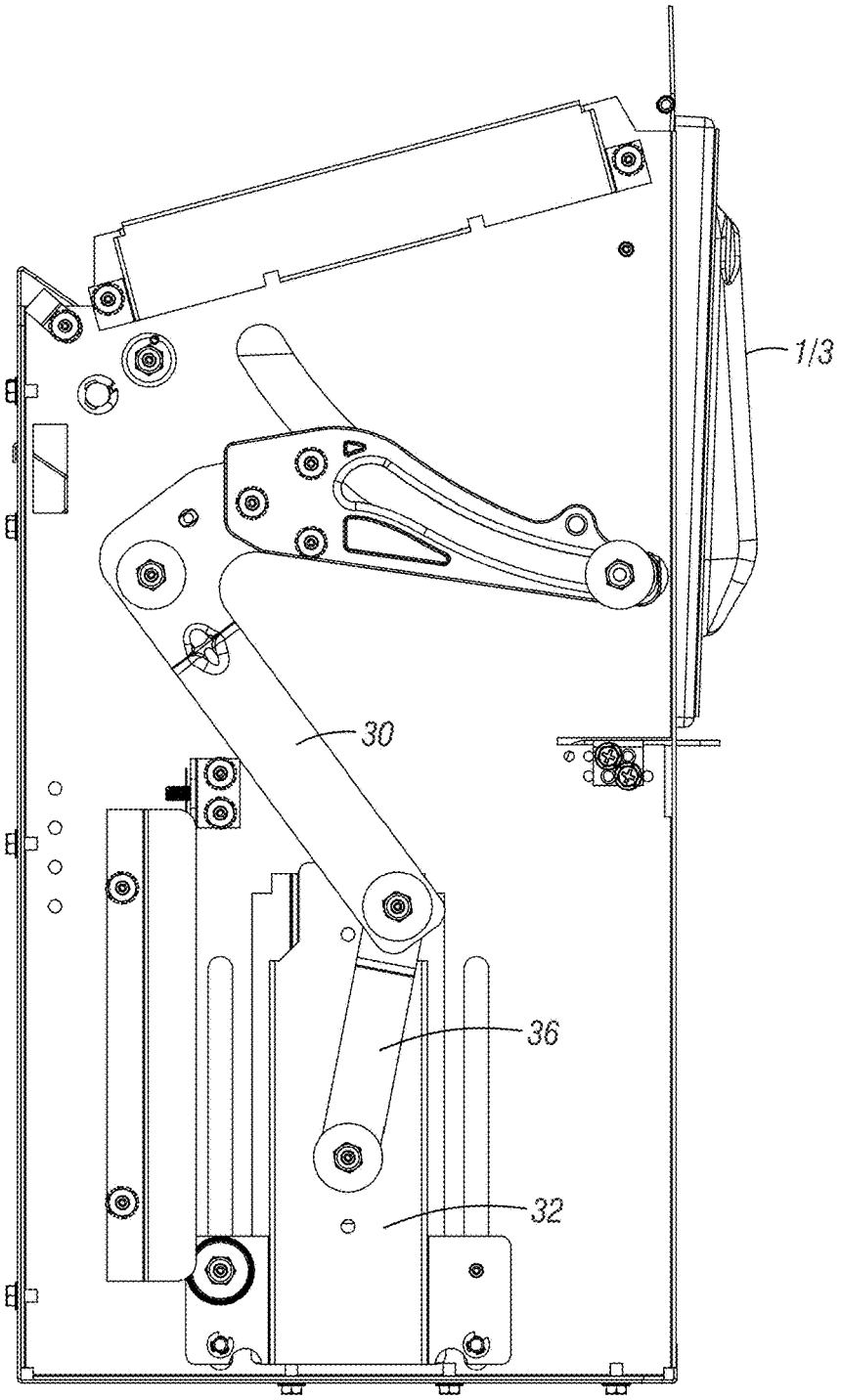
Figure 9D:
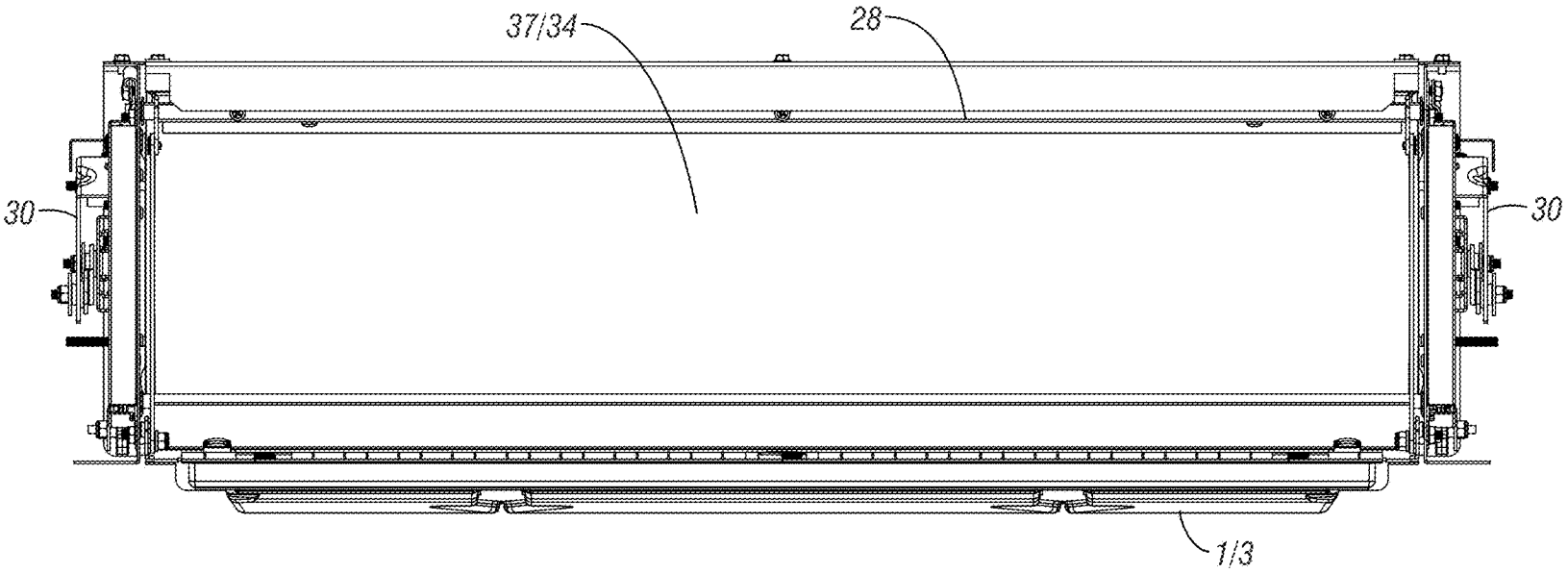
Figure 9E:
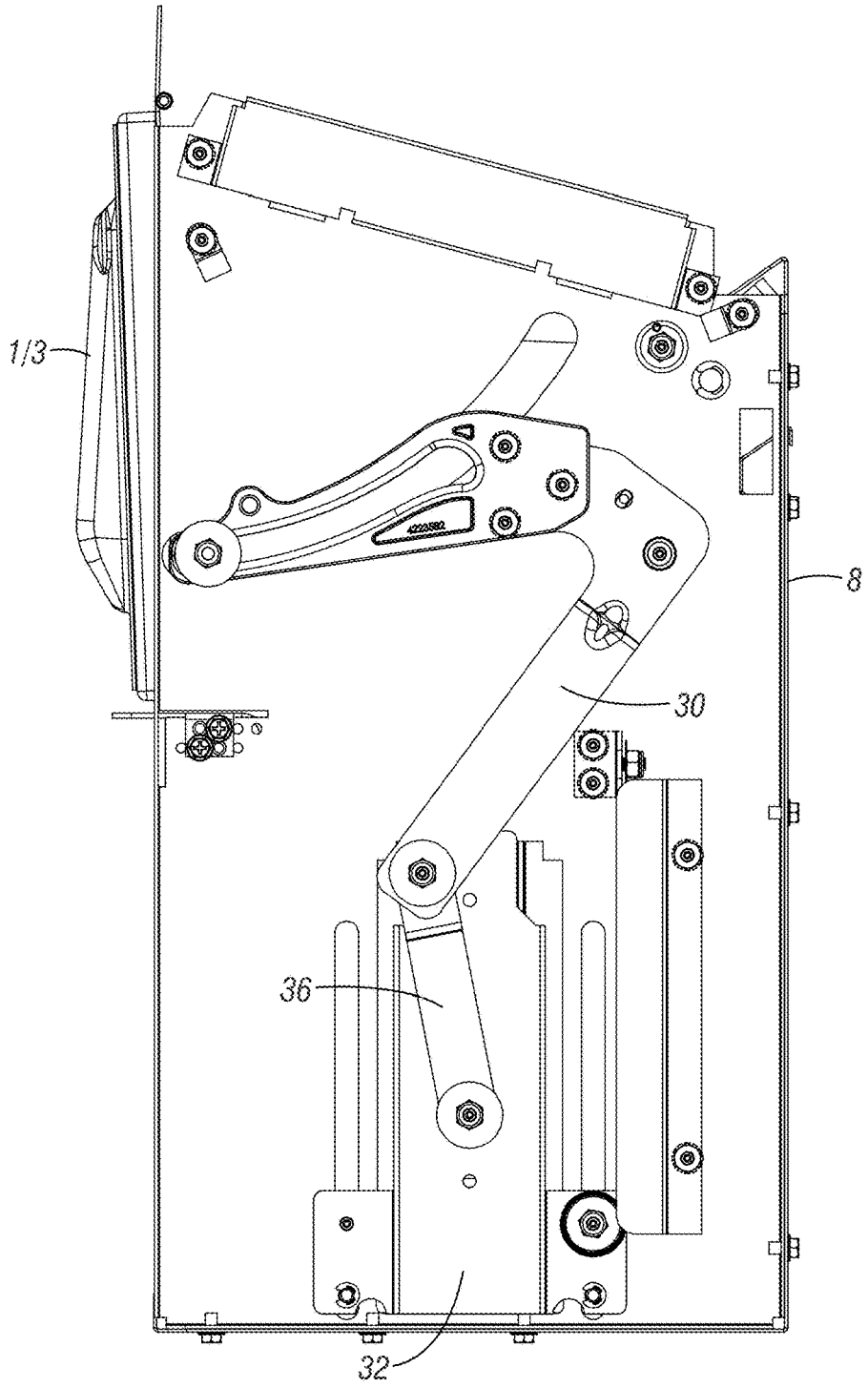
Figure 9F:
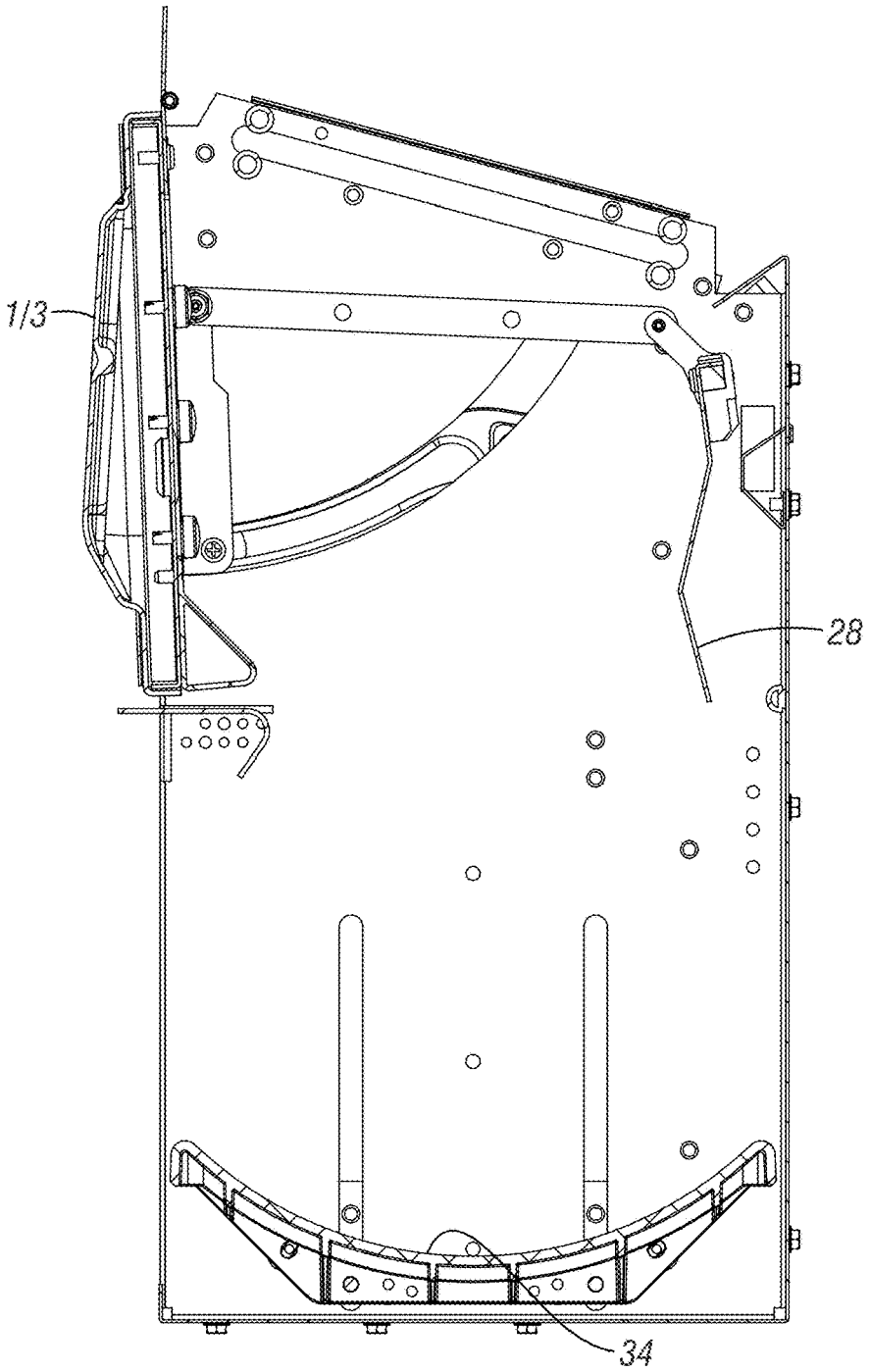

Then, FIG. 8A is a perspective of door 3 all the way in its fully up position (approximately 20 additional degrees or 54° from vertical). It and its subparts 8B-G illustrate how the links 30 pivot and then pull or lift floor 34 towards the top of its vertical range of motion. It is to be understood that by selection of the geometry of the components and slots, the relationship of pivoting movement of door 3 versus the amount of lifting of floor 34 can be engineered. But an important feature is that the relationships allow a partial opening of door 3 without lifting of floor 34. The user can select whether or not to continue opening and then lift floor 34.

A subtle feature of the invention is that when during that first opening 34° of door 3, there is no lifting and thus the user only feels the weight and the closing bias of door spring 2. But the user can see at least partially into bin 8 and/or reach into bin 8 all the way down to floor 34 if needed. Sometimes that is all that is needed to retrieve a dispensed item. This can be done with one hand by the user's back of the hand pushing on door 34 and then reaching further in and retracting the item. Optionally lighting could supply additional visual assistance.

However, when the user opens the door to at or near 34° from vertical, the linkage connection of door to floor kicks in. The customer senses tactilely the increased resistance because the weight of floor 34 (and potential weight of dispensed product) is now a factor. This gives the customer a tactile feel of the transition point. It provides the ability for an intuitive understanding that there is a difference and that it involves an additional mass. Either with that tactile feedback and/or vision of at least a portion of lift floor 34, the customer can quickly associate that additional resistance to lifting of the bin floor. As can be appreciated, a user can intuitively and easily understand how the lift assist can benefit the user. Single hand operation (which can be supplemented by mechanical means) and the non-linear movement allows a customer or user to first begin opening of the access door to first identify if the item has been vended and where it is in the bin. This can be done many times with just a slight opening of the door even though the bin floor is in its lower-most position. With the mechanical action, the force needed to open the access door that initial amount is small. The user can attempt to grab the dispensed item and remove it, with one hand, without further opening of the access door. Again, two hands are not required, which can be important for the user experience. However, the non-linear movement would provide tactile feedback to the user when the access door is opened to the point that bin floor lifting commences. The user simply feels more resistance at the point the floor starts to lift. As can be understood, this point in access door opening effectively can be feedback to the user that if the user sees the item and can grab it and remove it, that is all that is required. But, the user, whether by desire or need, can with a single hand or arm, sense that point and use his/her strength to continue opening of the access door. Again, tactile feedback informs the user that something else is now happening. That something else is easily perceived, if not by intuition then by sight, that the bin floor moves proportionally with further door opening. By trial and error, the user can immediately feel that the floor can be further raised or lowered by single-handed operation of the access door. The customer experience, as well as this added lift feature, subtly provide benefits for the user. As mentioned, one particle benefit can be relative the ADA. Both for machine owner operator and user, it provides an easy, intuitive way for a user to lift a dispensed item, under their control, to the minimum ADA height. But benefits in other contexts apply as well.

Thus, that understanding allows the customer to decide whether or not the item can be retrieved without further opening of the door and lifting of the floor or it can prompt the customer to continue door opening to get the floor closer to the access opening. The customer can decide whether or not that is needed.

In either case, once the customer does not need access to the bin, the customer can release door 3. Constant force springs 14 would dampen any closing motion and thus any slamming of either door or floor back to closed and home positions. Spring hinge 2, however, and the mass of floor 34 would promote full closing and sealing of door 3 around its access opening (for insulation purposes).

It can therefore be seen that the subtle cooperation of the components provides for these features. It can therefore be seen that a designer can balance competing factors and produce beneficial results according to objects of the invention.

Options and Alternatives

It will be appreciated that the above described exemplary embodiment is but one form the invention can take. Variations obvious to those skilled in the art will be included within the invention.

As a few examples, the 54° total door opening range and the 34°/20° split between no floor lift and floor lift can be varied according to need or desire. Likewise the exemplary embodiment is indicated as having a floor lift of 4.125 inches. That also can be adjusted according to need or desire.

As would be appreciated by those skilled in the art, the specific materials, form factors, scale and applications can vary while utilizing the invention.

Another example is optional features that relate to the particular application. For example, as shown in FIGS. 4A-D, back wall 82 of the dispensing bin could be at least partially perforated for air exchange, especially if the machine is refrigerated. Additionally, delivery door cover 1 can be thermally insulated and the opening to which it closes could include sealing mechanisms, again particularly beneficial if a machine is refrigerated.

Still further, such features as the concave plastic floor base 37 are not required. The system with the delayed floor lift could be applied without that feature if desired.

The foregoing are but a few examples of some variations possible.

Some specific examples of options and alternatives are illustrated in FIGS. 9A-F, 10A, 11, and 12A-D. Those figures illustrate an alternative embodiment to that of FIGS. 3-8 and any subparts. For example, it will be noticed that the assembly 108" in these drawings is similar to assembly 108'. Some differences in the specific parts include the following. Some of the parts can be made of different materials than embodiment 108'. For example, certain parts can be made of plastic instead of metal. One example, is illustrated at FIGS. 9-12 and subparts. Linkage arm 30 could be made of two pieces (30A and 30B). It would have the same function as link 30 of FIGS. 3-8 and subparts but could be made of two pieces that are riveted, screwed, or otherwise rigidly fastened together. This could allow one piece to be made of one material and the other of a different material. One example would be piece 30A of metal and piece 30B of plastic. The reverse could be true. This could save cost and weight.

Figure 10:
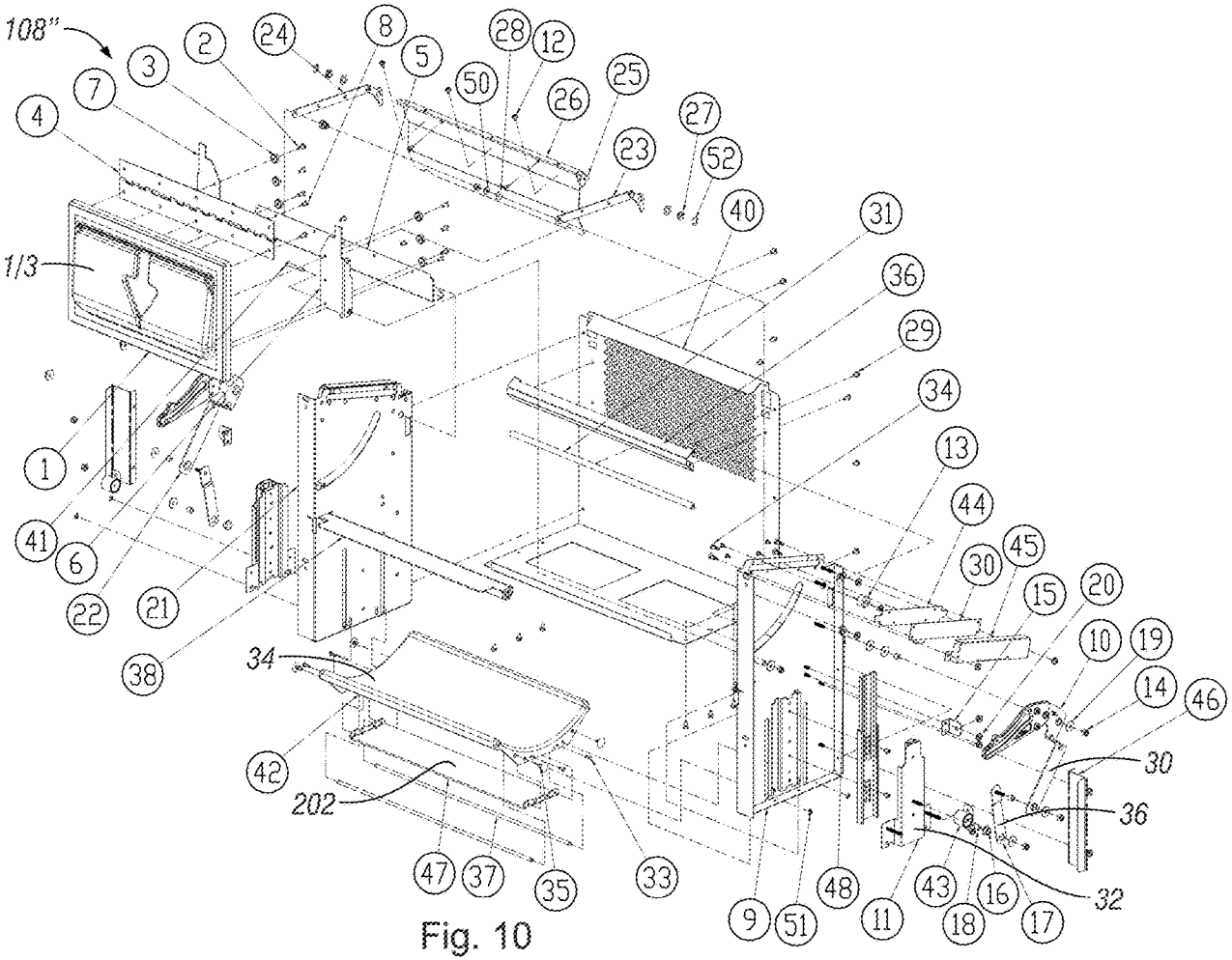
FIG. 10 is similar to FIG. 4A but illustrates the alternative embodiment of FIGS. 9A-F in exploded view.
Figure 11:
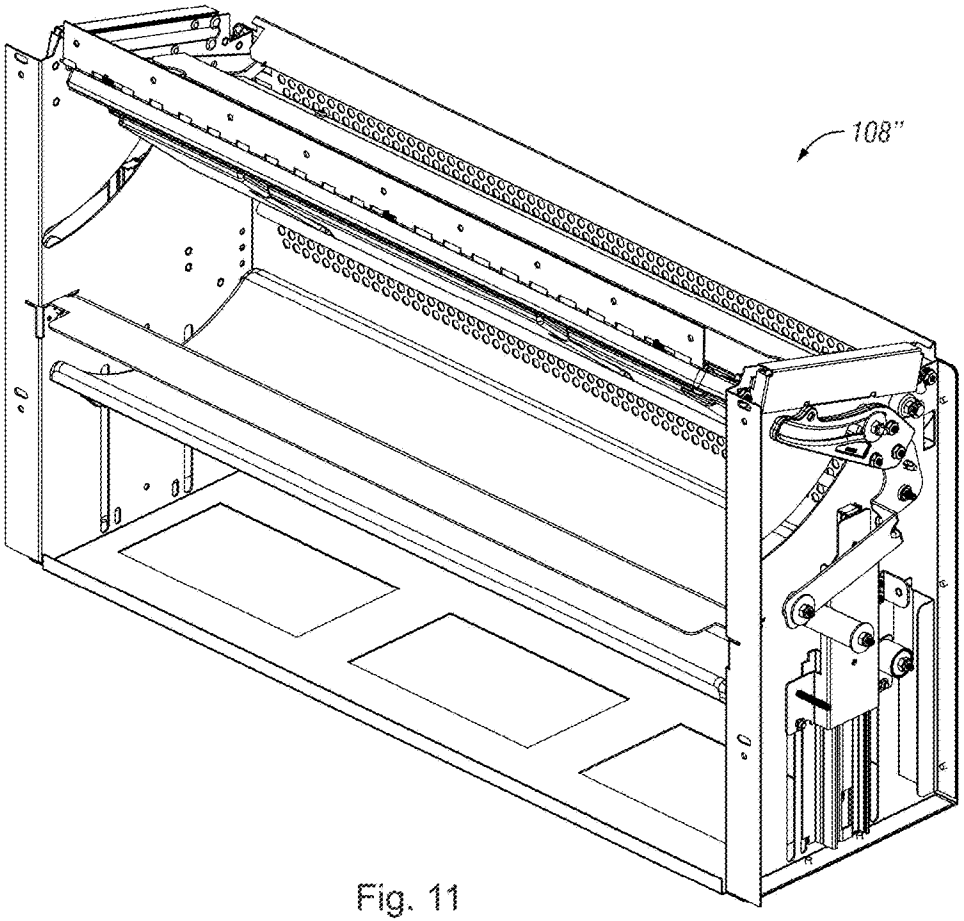
FIG. 11 is similar to FIG. 5 but shows the alternative embodiment of FIGS. 8 A-G with access door completely raised and bin floor proportionally raised.

Note also in FIGS. 9-12 and subparts that material costs can be reduced by judicious removal of material where not structurally needed. An example would be the void shown in piece 30B of FIGS. 9-12 and subparts. Another example is illustrated with openings in the bottom floor of the bin frame as shown in FIG. 11.

Another example is form factor of some of the parts. The same non-linear proportional mechanical lifting of bin floor 34 can be achieved through pushing door 1. As indicated in FIGS. 9-12 and subparts, the linkage components 30 and 36, as well as slides 32 are similar with small variances.

Table 2 below lists one example of the components of the exploded view of FIG. 10. It is to be understood, of course, that variations are possible.

TABLE 2

| ITEM NO. | DESCRIPTION | QTY |
|---|---|---|
| 1 | DELIVERY DOOR FOAM ASSY ALPINE- 3W | 1 |
| 2 | 8-32 × 3/8 PHIL PH TYP 23 | 11 |

TABLE 2-continued

| ITEM NO. | DESCRIPTION | QTY |
|---|---|---|
| 3 | HINGED SCREW COVER | 6 |
| 4 | SPRING HINGE | 1 |
| 5 | DEL DOOR ANTI-CHEAT/EXTRUSION | 1 |
| 6 | DEL DOOR SIDE BRACKET STAKE ASSY/RH | 1 |
| 7 | DEL DOOR SIDE BRACKET STAKE ASSY/LH | 1 |
| 8 | 8-32 × 3/8" PHIL UNDERCUT FH TYP 23 ZN | 4 |
| 9 | DELIVERY WRAPPER SIDE WELD/ALPINE | 1 |
| 10 | DELIVERY LIFT LINK ASSY/RH | 1 |
| 11 | SLIDE & FLOOR LIFT BRACKET WELD | 2 |
| 12 | 8-32 × 1/4" PHIL PH TYP 23 ZN | 9 |
| 13 | BUMPER | 2 |
| 14 | #8 HEX NYLOCK NUT | 16 |
| 15 | FLOOR SPRING HOLDER STAKE ASSY | 2 |
| 16 | FLANGE BEARING-05/16" | 2 |
| 17 | LINK FLOOR LIFT STAKE ASSY | 2 |
| 18 | ID.166 × OD.312 × .250 L SPACER | 6 |
| 19 | WASHER .6250D × .175ID × .062 | 12 |
| 20 | 8-32 HEX NUT W/ETW | 15 |
| 21 | DELIVERY WRAPPER SIDE WELD/ALPINE | 1 |
| 22 | DELIVERY LIFT LINK ASSY-LH | 1 |
| 23 | ANTI-CHEAT LINKAGE STAKE-ALPINE | 1 |
| 24 | ANTI-CHEAT LINKAGE STAKE-ALPINE | 1 |
| 25 | DELIVERY SHAFT ALPINE-5W | 1 |
| 26 | DELIVERY ANTI-CHEAT BACK/3W | 1 |
| 27 | SNAP-IN NYLON BEARING | 2 |
| 28 | SPACER BUSHING | 2 |
| 29 | 8-18 × 3/8 PHIL PH TY-A/BLK | 21 |
| 30 | DELIVERY SENSOR | 1 |
| 31 | D-GASKET | 1 |
| 32 | SNAP RIVET | 8 |
| 33 | SNAP RIVET | 4 |
| 34 | STANDOFF-5/16" | 8 |
| 35 | ARROW CLIP (0.625 × .100) | 4 |
| 36 | IVEND HARNESS COVER-ALPINE | 1 |
| 37 | LIFT FLOOR ROD-03/16" | 2 |
| 38 | DOOR OPENING ANTICHEAT-ALPINE | 1 |
| 39 | ID.166 × OD.312 × .625 L SPACER | 2 |
| 40 | DELIVERY WRAPPER BACK/ALPINE/3w | 1 |
| 41 | 8-32/ × 1 1/4" PH PH MS ZN | 2 |
| 42 | DELIVERY BOX FLOOR/ALPINE | 1 |
| 43 | CF SPRING & SPOOL ASSEMBLY | 2 |
| 44 | I-VEND SENSOR LENS/ALPINE | 2 |
| 45 | IVEND METAL COVER | 2 |
| 46 | CF SPRING COVER | 2 |
| 47 | COUNTERBALANCE-FLOOR WT/3W | 1 |
| 48 | 3/8 × 3/16 CLAMP | 3 |
| 49 | 5/16 ID FLAT WASHER | 2 |
| 50 | #8 FLAT WASHER | 2 |
| 51 | RETAINING RING - 3/16" | 4 |
| 52 | E-RING | 2 |

Figure 12A:
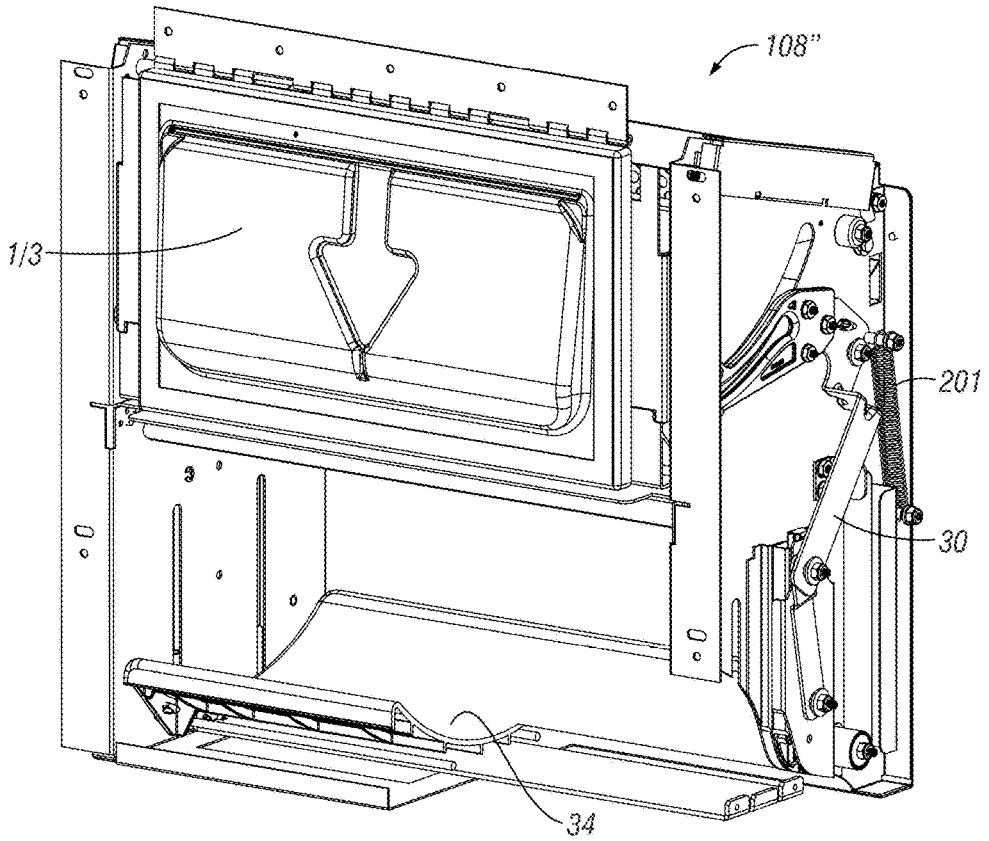
FIGS. 12A-D are similar to FIGS. 6A, 6E, 6D, and 6H respectively but relative to the alternative embodiment of FIGS. 9A-F.
Figure 12B:
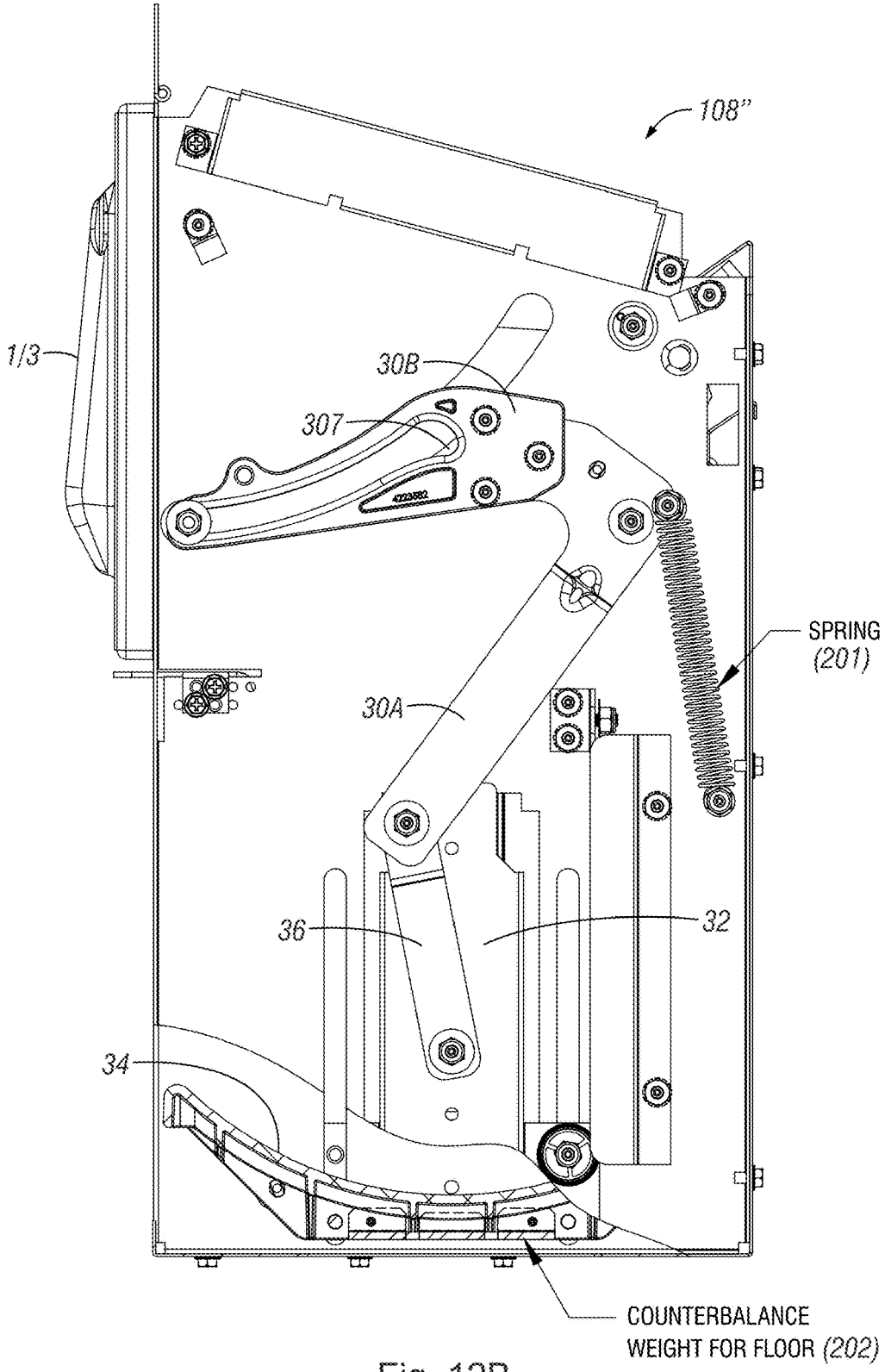
Figure 12C:
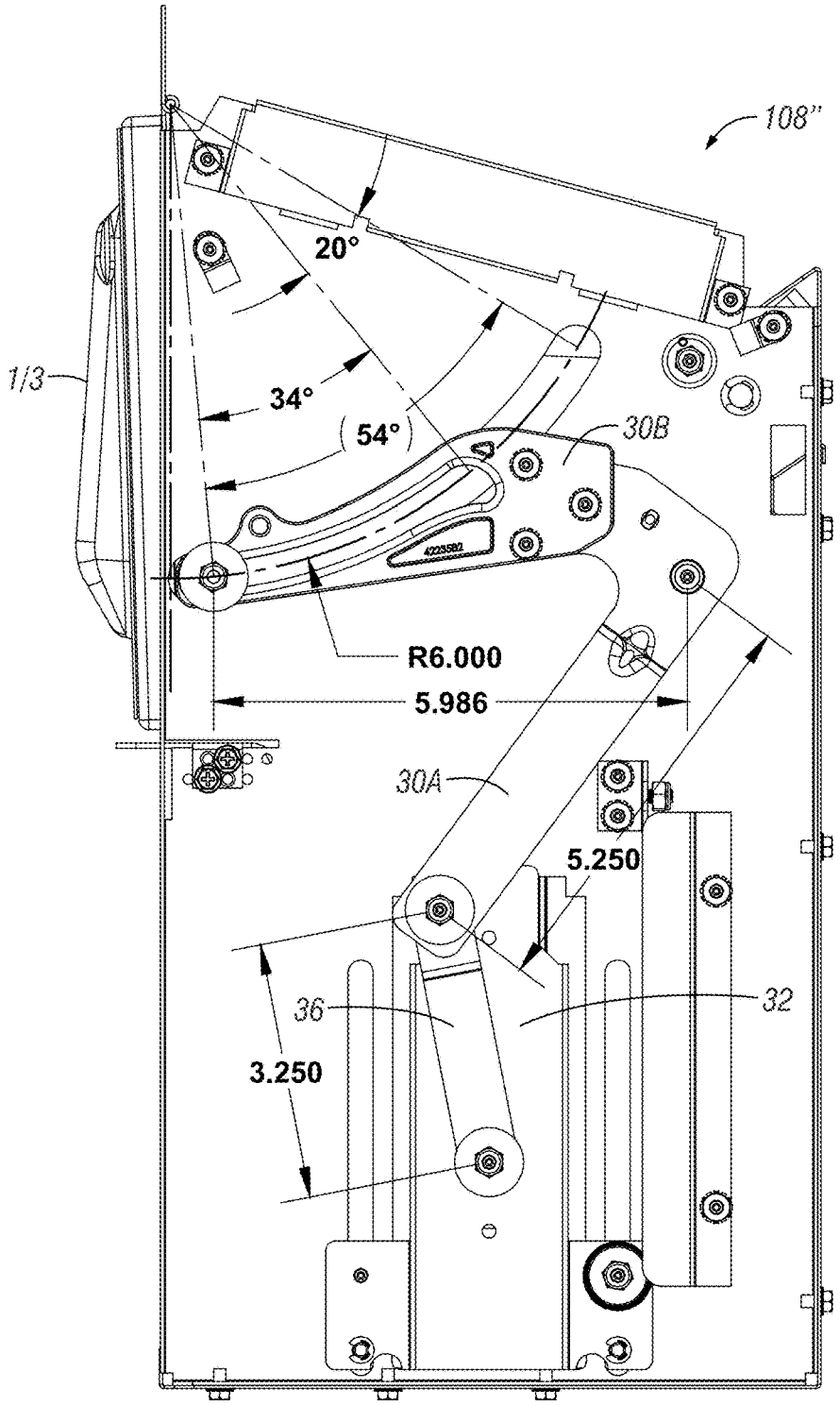
Figure 12D:
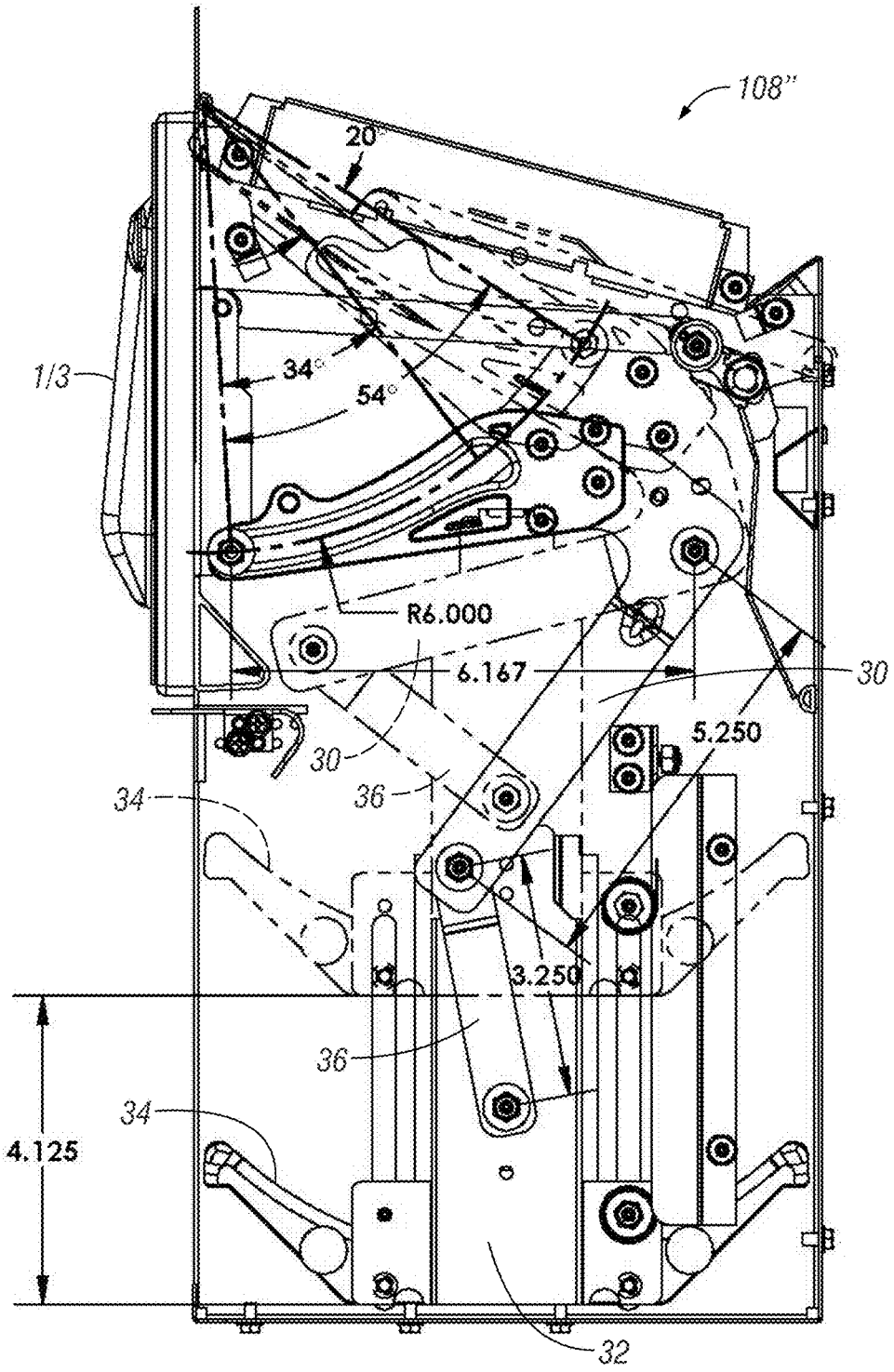

By further example of options and alternatives, FIGS. 12A-B show one optional feature. A lift-assist spring 201 can be connected between the elbow of linkage member 30 and sidewall 84 of the delivery box of frame 8. It can be selected to be in tension (stretched) when door 1 and lift floor 34 are in the home position (closed and down). That tension can be selected to help a user push open door 1 and, if opening proceeds to that point, assists lifting floor 34. One example of a spring force could be one to five pounds. This might be effectuated with just one spring 201 on one side or it could be effectuated by a combination of a pair of springs, one on each side of bin 108". This could be applied, as well, to bin 108'. This would help a customer or user open the access door and raise the bin floor if it gets to that point. It could make it easier on the user or smoother on the user for a better user experience.

Another optional feature comprises adding a counterbalance 202 to lift floor 34. Essentially it is an added element that presents additional mass to the lift floor. It could be selected according to need or desire to help gravity move floor 34 back to a home position once the user backs off of force on door 1.

It is to be appreciated that embodiment 108" includes features of and operates substantially similarly to bin assembly 108' as previously described. It is further mentioned that, as roughly indicated in FIG. 12A, the form factor or size of delivery bin 108' or 108" could vary. As can be appreciated, for any of a variety of applications, it would not need to span an entire width of a vending machine. Products could be funneled to it or otherwise directed thereto. Or, for different types of dispensing machines different than a full size glass front multiple dispenser machine such as in FIGS. 1A-D and 2A-C, a delivery bin 108' or 108" of less width can have the built in non-linear proportional floor lift linkage and any of the other features described herein. Of course, it could also have a wider width than FIGS. 2A-C.

What is claimed is:

1. A delivery receptacle assembly such as for use in a vending, inventory control, or dispensing machine comprising:

a. a delivery box for placement in a delivery area inside a vending, inventory control or dispensing machine, the delivery box having a height, width, and depth defining an interior space for receiving dispensed items from above into the interior space, and including:

i. a raiseable floor having a mass across substantially the interior space and movable between a lower home and a fully raised position, and ii. an access opening at least substantially across the width;

b. an access door having a mass mounted at the delivery box for providing access to the interior space of the delivery box through the access opening movable between a closed position across the access opening and an open position;

c. a mechanical linkage operatively connected between the raiseable floor and the access door, the linkage providing:

i. a first range of movement of the access door between the closed position to a partially open position for viewing of or access to at least a portion of the interior space through the access opening without raising of the floor so that lifting force required is primarily the mass of the access door;

ii. a second range of movement of the access door to:

(1) raise the raiseable floor member mechanically from the lower home position towards the fully raised position over the second range of movement upon further opening of the access door from the partially open position towards the fully open position;

(2) create a mechanical dwell that at least temporarily resists the mass of the access door and raiseable floor upon closing of the access door while in the second range of movement.

2. The delivery receptacle assembly of claim 1 wherein the access door:

a. has a width and height, and the width spans at least a substantial amount of the interior space;

b. is positioned above, forward, and substantially vertical relative the raiseable floor in the closed position;

c. swings inwardly and upwardly around a substantially horizontal axis when moved from the closed position.

3. The delivery receptacle assembly of claim 1 wherein the access door includes a seal at or near its perimeter adapted to seal the access door against a cabinet opening of a vending, inventory control, or dispensing machine cabinet when in the closed position.

4. The delivery receptacle assembly of claim 1 in combination with a vending, inventory control, or dispensing machine having a cabinet and cabinet opening, wherein the cabinet opening is 15 inches or more above a supporting surface of the vending inventory control, or dispensing machine and coincident with the access door of the delivery receptacle assembly, and the raiseable floor moves to a position 15 inches from the machine's supporting surface in its raised position resulting in enhanced/improved accessibility.

5. The delivery receptacle assembly of claim 1 wherein the linkage comprises:

a. at least one arm extending between the access door and the raiseable floor, the at least one arm actuating movement of the raiseable floor in response to movement of the access door over the second range of movement.

6. The delivery receptacle assembly of claim 1 wherein the raiseable floor of the dispensing receptacle body has a concave top surface along at least a substantial part of its length.

7. The delivery receptacle assembly of claim 1 further comprising an anti-cheat panel which moves from a retracted to a blocking position when the access door is moved past the partially open position.

8. The delivery receptacle assembly of claim 3 further comprising a retention member associated with the access door of the cabinet to hold the access door in a sealed position unless moved by manual force, the retention member comprising a magnetic component.

9. The delivery receptacle assembly of claim 8 wherein the raiseable floor is raised from the home position to the fully raised position upon opening the access door from the partially opened position to a fully opened position.

10. The delivery receptacle assembly of claim 5 wherein the linkage comprises two arms, one connected to the raiseable floor and the other to the access door.

11. The vending, inventory control, or dispensing machine of claim 4 wherein the floor movement comprises:

a. leaving the floor at or near its said lower position when the customer access door is moved anywhere to or from the closed and a partially open position; and b. correlated raising and lowering the floor when the customer access door is moved anywhere to or from the partially open position to the open position.

12. The vending, inventory control, or dispensing machine of claim 4 comprising;

a. plural vertical drop dispensers at different vertical heights across a width of the interior of the cabinet;

b. a customer interface including an item selection and a bill/coin/token acceptor; and c. a programmable machine controller operatively connected to:

i. the dispensers; and ii. the customer interface.

* * * * *